US011229827B2

(12) United States Patent
Yi et al.

(10) Patent No.: US 11,229,827 B2
(45) Date of Patent: Jan. 25, 2022

(54) GOLF CLUB HAVING AN ADJUSTABLE WEIGHT ASSEMBLY

(71) Applicant: Acushnet Company, Fairhaven, MA (US)

(72) Inventors: Sang Yi, Carlsbad, CA (US); Richard Sanchez, Temecula, CA (US); Richard L. Cleghorn, Oceanside, CA (US); Thomas Orrin Bennett, Carlsbad, CA (US)

(73) Assignee: Acushnet Company, Fairhaven, MA (US)

( * ) Notice: Subject to any disclaimer, the term of this patent is extended or adjusted under 35 U.S.C. 154(b) by 0 days.

(21) Appl. No.: 17/122,887

(22) Filed: Dec. 15, 2020

(65) Prior Publication Data

US 2021/0128994 A1 May 6, 2021

Related U.S. Application Data

(63) Continuation-in-part of application No. 16/843,640, filed on Apr. 8, 2020, now Pat. No. 10,918,917, which is a continuation-in-part of application No. 16/708,255, filed on Dec. 9, 2019, now Pat. No. 11,090,536, which is a continuation-in-part of application No. 16/535,844, filed on Aug. 8, 2019, now Pat. No. 10,926,143, which is a continuation-in-part of application No. 16/387,859, filed on Apr. 18, 2019, now Pat. No. 10,695,628.

(51) Int. Cl.

| | |
|---|---|
| ***A63B 53/06*** | (2015.01) |
| ***A63B 53/04*** | (2015.01) |
| *A63B 102/32* | (2015.01) |

(52) U.S. Cl.
CPC .. *A63B 53/0466* (2013.01); *A63B 2053/0491* (2013.01); *A63B 2102/32* (2015.10)

(58) Field of Classification Search
CPC ..... A63B 2053/0491; A63B 2053/0495
USPC ..... 473/324–350
See application file for complete search history.

(56) References Cited

U.S. PATENT DOCUMENTS

| | | | | |
|---|---|---|---|---|
| 2,155,830 A * | 4/1939 | Howard | ..... | A63B 60/52 473/246 |
| 4,085,934 A | 4/1978 | Churchward | | |
| 5,050,879 A | 9/1991 | Sun | | |

(Continued)

FOREIGN PATENT DOCUMENTS

| | | |
|---|---|---|
| JP | 01043278 | 2/1989 |
| JP | 2005296582 | 10/2005 |

(Continued)

*Primary Examiner* — Alvin A Hunter

(57) ABSTRACT

A golf club head includes a body having an outer surface and a recessed channel defined in the outer surface of the body. A chamber is defined at one end of the recessed channel. The golf club head also includes a weight assembly having a weight at least partially disposed within the recessed channel and configured to slide therein. A cover having a first end and an opposite second end, the second end including a projection, and a fastener coupling the first end of the cover to the body. The fastener secures the first end of the cover to the body while the projection of the second end of the cover engages with the chamber of the recessed channel to retain a position of the weight within the recessed channel between the first end and the second end of the cover.

17 Claims, 42 Drawing Sheets

(56) References Cited

U.S. PATENT DOCUMENTS 6,277,032 B1 * 8/2001 Smith ..... A63B 53/0466 473/336
6,409,612 B1 6/2002 Evans
6,592,468 B2 7/2003 Vincent
6,663,505 B1 12/2003 Solari
6,860,818 B2 3/2005 Mahaffey
7,108,609 B2 * 9/2006 Stites ..... A63B 53/06 473/256
7,121,956 B2 * 10/2006 Lo ..... A63B 53/0466 473/335
7,166,041 B2 * 1/2007 Evans ..... A63B 60/02 473/334
7,611,424 B2 * 11/2009 Nagai ..... A63B 53/0466 473/334
7,704,163 B2 * 4/2010 Stites ..... A63B 60/02 473/334
7,775,905 B2 * 8/2010 Beach ..... A63B 53/0466 473/334
7,806,782 B2 * 10/2010 Stites ..... A63B 53/06 473/334
7,871,339 B2 * 1/2011 Sanchez ..... A63B 53/047 473/335
8,016,694 B2 * 9/2011 Llewellyn ..... A63B 53/04 473/334
8,043,167 B2 * 10/2011 Boyd ..... A63B 53/0466 473/334
8,192,303 B2 * 6/2012 Ban ..... A63B 53/04 473/335
8,202,175 B2 * 6/2012 Ban ..... A63B 53/04 473/338
8,206,243 B2 * 6/2012 Stites ..... A63B 53/0466 473/334
8,444,505 B2 * 5/2013 Beach ..... A63B 60/00 473/334
8,696,491 B1 * 4/2014 Myers ..... A63B 60/02 473/334
8,790,195 B1 * 7/2014 Myers ..... A63B 53/0466 473/338
8,894,506 B1 * 11/2014 Myers ..... A63B 60/52 473/334
8,968,116 B1 * 3/2015 Myers ..... A63B 60/00 473/338
9,180,349 B1 * 11/2015 Seluga ..... A63B 53/047
9,211,453 B1 * 12/2015 Foster ..... A63B 60/04
9,259,627 B1 * 2/2016 Myers ..... A63B 53/04
9,289,660 B1 * 3/2016 Myers ..... A63B 53/06
9,364,728 B1 * 6/2016 Myers ..... A63B 60/02
9,440,126 B2 * 9/2016 Boyd ..... A63B 53/06
9,561,413 B2 * 2/2017 Nielson ..... A63B 60/02
9,597,561 B1 * 3/2017 Seluga ..... A63B 53/06
9,597,563 B2 * 3/2017 Voshall ..... A63B 53/0466
9,623,302 B1 * 4/2017 Myers ..... A63B 53/06
9,636,553 B1 * 5/2017 Myers ..... A63B 60/02
9,694,256 B2 * 7/2017 Myers ..... A63B 53/0466
9,694,261 B2 * 7/2017 Nunez ..... A63B 60/04
9,707,459 B1 * 7/2017 Myers ..... A63B 60/52
9,731,175 B1 * 8/2017 Myers ..... A63B 60/52
9,757,630 B2 * 9/2017 Mata ..... A63B 60/52
9,868,036 B1 * 1/2018 Kleinert ..... A63B 53/0466
9,878,223 B2 * 1/2018 Foster ..... A63B 60/52
9,937,392 B2 * 4/2018 Myers ..... A63B 60/04
10,029,161 B2 * 7/2018 Knutson ..... A63B 53/0466
10,065,094 B2 * 9/2018 Wallin ..... A63B 60/02
10,183,203 B1 1/2019 Yi et al.
10,188,916 B2 * 1/2019 Harbert ..... A63B 60/00
10,213,665 B1 * 2/2019 Day ..... A63B 53/0466
10,398,952 B1 * 9/2019 Yi ..... A63B 53/0466
10,543,406 B2 * 1/2020 Carter ..... A63B 53/047
10,556,161 B2 * 2/2020 Jertson ..... A63B 53/0466
10,576,337 B2 * 3/2020 Soracco ..... A63B 60/04
10,695,628 B1 * 6/2020 Yi ..... A63B 53/0433
10,918,917 B2 * 2/2021 Northcutt ..... A63B 53/0466
10,926,143 B2 * 2/2021 Bennett ..... A63B 60/02
2006/0122004 A1 * 6/2006 Chen ..... A63B 53/0466 473/335
2008/0020861 A1 * 1/2008 Adams ..... A63B 53/04 473/334
2008/0261715 A1 * 10/2008 Carter ..... A63B 60/00 473/291
2010/0075773 A1 * 3/2010 Casati, Jr. ..... A63C 5/075 473/334
2015/0306473 A1 * 10/2015 Breier ..... A63B 53/06 473/336
2015/0321055 A1 * 11/2015 Golden ..... A63B 60/42 473/338
2019/0105544 A1 4/2019 Carter
2020/0330834 A1 10/2020 Northcutt
2020/0330835 A1 10/2020 Bennett
2020/0330836 A1 10/2020 Bennett
2021/0138318 A1 5/2021 Northcutt
2021/0138319 A1 5/2021 Bennett

FOREIGN PATENT DOCUMENTS

JP 2005296582 A * 10/2005
JP 2005323978 11/2005
JP 2005323978 A * 11/2005
JP 2006320493 11/2006
JP 2006320493 A * 11/2006
JP 2010069106 4/2010
JP 2010069106 A * 4/2010 ..... A63B 60/02
JP 2010136772 6/2010
JP 2010136772 A * 6/2010 ..... A63B 60/02
JP 2010148702 7/2010
JP 2010148702 A * 7/2010 ..... A63B 53/0466
JP 2010252964 11/2010
JP 2010252964 A * 11/2010
JP 2012125291 7/2012
JP 2012125291 A * 7/2012
JP 2012139450 7/2012
JP 2012139450 A * 7/2012
JP 2014223548 12/2014
JP 2014223548 A * 12/2014 ..... A63B 53/04

* cited by examiner

GOLF CLUB HAVING AN ADJUSTABLE WEIGHT ASSEMBLY

CROSS-REFERENCE TO RELATED APPLICATIONS

This application is a continuation-in-part of U.S. patent application Ser. No. 16/843,640, filed Apr. 8, 2020, which is a continuation-in-part of U.S. patent application Ser. No. 16/708,255, filed Dec. 9, 2019, which is a continuation-in-part of U.S. patent application Ser. No. 16/535,844, filed Aug. 8, 2019, which is a continuation-in-part of U.S. patent application Ser. No. 16/387,859, filed Apr. 18, 2019, now U.S. Pat. No. 10,695,628, and which are hereby incorporated by reference in their entireties. To the extent appropriate, the present application claims priority to the above-referenced applications.

BACKGROUND

The flight characteristics of a golf ball after being struck by a golf club are dependent on not only on the swing of the golf club but also on the golf club itself. For example, flight characteristics of the golf ball, such as fades, draws, launch angles, ball spin, and speed are impacted by the design of the golf club. By adjusting one or more design properties of the golf club, the flight characteristics of the golf ball can be improved, thereby increasing golf club performance. In some examples, adjusting a center of gravity (CG) and/or a moment of inertia (MOI) of a head of the golf club through selective weight placement impacts the flight characteristics of the golf ball. However, these adjustable weights need to be both securely attached to the golf club head and selectively moveable. As such, improvements to adjustable weight assemblies for golf club heads are desired.

SUMMARY

In an aspect, the technology relates to a golf club head including: a body having an outer surface; a recessed channel defined in the outer surface of the body, wherein a chamber is defined at one end of the recessed channel; and a weight assembly including: a weight at least partially disposed within the recessed channel and configured to slide therein; a cover having a first end and an opposite second end, wherein the second end includes a projection; and a fastener coupling the first end of the cover to the body, wherein the fastener secures the first end of the cover to the body while the projection of the second end of the cover engages with the chamber of the recessed channel to retain a position of the weight within the recessed channel between the first end and the second end of the cover.

In an example, the body includes at least one locating lug disposed within the recessed channel, and the weight includes a hollow shaped and sized to receive at least a portion of the at least one locating lug to at least partially define the position of the weight within the recessed channel. In another example, the at least one locating lug includes a plurality of locating lugs having at least two different spacing distances. In still another example, the cover includes a flange and the weight includes a groove shaped and sized to receive at least a portion of the flange to slidingly engage the weight with the cover. In yet another example, the cover includes at least one locating lug and the weight includes a hollow shaped and sized to receive at least a portion of the at least one locating lug to at least partially define the position of the weight within the recessed channel.

In an example, the body includes a partial wall disposed within the recessed channel and the weight includes a recess shaped and sized to receive at least a portion of the partial wall to slidingly engage the weight with the body.

In another example, the fastener defines a fastener axis that the cover moves relative to the body along, and the body includes a lip disposed within the recessed channel proximate the chamber, the lip extending substantially parallel to the fastener axis. In still another example, the body further includes: a striking face including a lower edge and an opposite upper edge; a sole extending from the lower edge; and a crown extending from the upper edge, the recessed channel and the weight assembly are disposed on a rear perimeter of the body opposite the striking face and proximate where the sole and the crown couple together. In yet another example, the fastener is rotatable between about 2-3 turns to release the cover and allow the weight to slide at least partially within the recessed channel. In an example, the golf club head is a metalwood-type golf club head.

In another aspect, the technology relates to a golf club head including: a body including: a striking face including a lower edge and an opposite upper edge; a sole extending from the lower edge; and a crown extending from the upper edge, wherein one or more of the striking face, the sole, and the crown, define an outer surface of the body; a recessed channel formed in the outer surface, wherein both a chamber and a fastener receiver are defined at each end of the recessed channel; and a weight assembly including: a cover having a first end and an opposite second end, wherein the second end includes a projection; a weight disposed at the first end of the cover; and a fastener mounted on the first end of the cover, wherein the cover is selectively coupled to the body at the recessed channel so that the projection of the second end is engaged with the chamber at one end and the fastener is engaged with the fastener receiver at the opposite end.

In an example, the weight defines the first end of the cover. In another example, the weight is removable from the cover. In still another example, the weight is a first weight and the weight assembly further includes at least one second weight, and a weight chamber is defined at each end of the recessed channel proximate the fastener receiver configured to receive the at least one second weight. In yet another example, the cover secures the at least one second weight within the weight chamber. In an example, the cover has a dog-bone type shape.

In another aspect, the technology relates to a golf club head including: a body including: a striking face including a lower edge and an opposite upper edge; a sole extending from the lower edge; and a crown extending from the upper edge, wherein one or more of the striking face, the sole, and the crown, define an outer surface of the body; a recessed channel formed in the outer surface; and a weight assembly including: a cover having a first end and an opposite second end, wherein the second end is pivotably coupled to the body at the recessed channel; and a fastener mounted on the first end of the cover and configured to secure the first end of the cover to the body; and a weight slidably coupled to the cover and movable between the first end and the second end, wherein when the fastener secures the cover to the body, the weight is disposed at least partially within the recessed channel and a position of the weight within the recessed channel between the first end and the second end of the cover is indirectly retained by the fastener.

In an example, the second end of the cover includes a hook with a hard stop engaged with the body. In another example, the second end of the cover is coupled to the body at a pin. In still another example, the recessed channel and the weight assembly are disposed on a rear perimeter of the body opposite the striking face and proximate where the sole and the crown couple together.

This summary is provided to introduce a selection of concepts in a simplified form that are further described below in the Detailed Description. This summary is not intended to identify key features or essential features of the claimed subject matter, nor is it intended to be used to limit the scope of the claimed subject matter.

BRIEF DESCRIPTION OF THE DRAWINGS

Non-limiting and non-exhaustive examples are described with reference to the following Figures.

DETAILED DESCRIPTION

The technologies described herein contemplate a golf club head, such as a fairway metal, driver, or other golf club head, that includes an adjustable weight assembly. Through the weight balance of the golf club head, the flight characteristics of the golf ball can be improved, thereby increasing golf club performance. In the examples described herein, the weight assembly enables for the CG and/or MOI of a head of the golf club to be adjusted through selective weight placement to impact the flight characteristics of the golf ball, such as fades, draws, launch angles, ball spin, and speed. Additionally or alternatively, the weight assembly enables for the swing weight of the golf club head to be adjustable (e.g., increasing or decreasing the weight of the club head).

In examples, the present technologies provide a golf club head with a recessed channel defined therein. A slidable weight is disposed at least partially within the channel and secured therein by a cover and a fastener. The cover is configured to retain the weight within the channel indirectly so that the fastener never engages with the weight. This configuration enables for the size, shape, and/or density of the weight to be defined so that the CG and MOI of the golf club head can be finely tuned. Additionally, the cover includes additional features that increase securement of the weight within the channel and reduce undesirable rattling or movement during the golf club swing. Furthermore, the weight assemblies described herein allow for the weight to be adjusted quickly and easily without requiring any component to be fully detached from the club head. Thereby reducing lost or misplaced components during club head adjustment. In an aspect, the weight is engaged with the cover so that the two components can move together with respect to the golf club head. Additionally, the weight is restricted from tilting relative to the cover so as to reduce or prevent binding of the weight within the channel.

Figure 1:
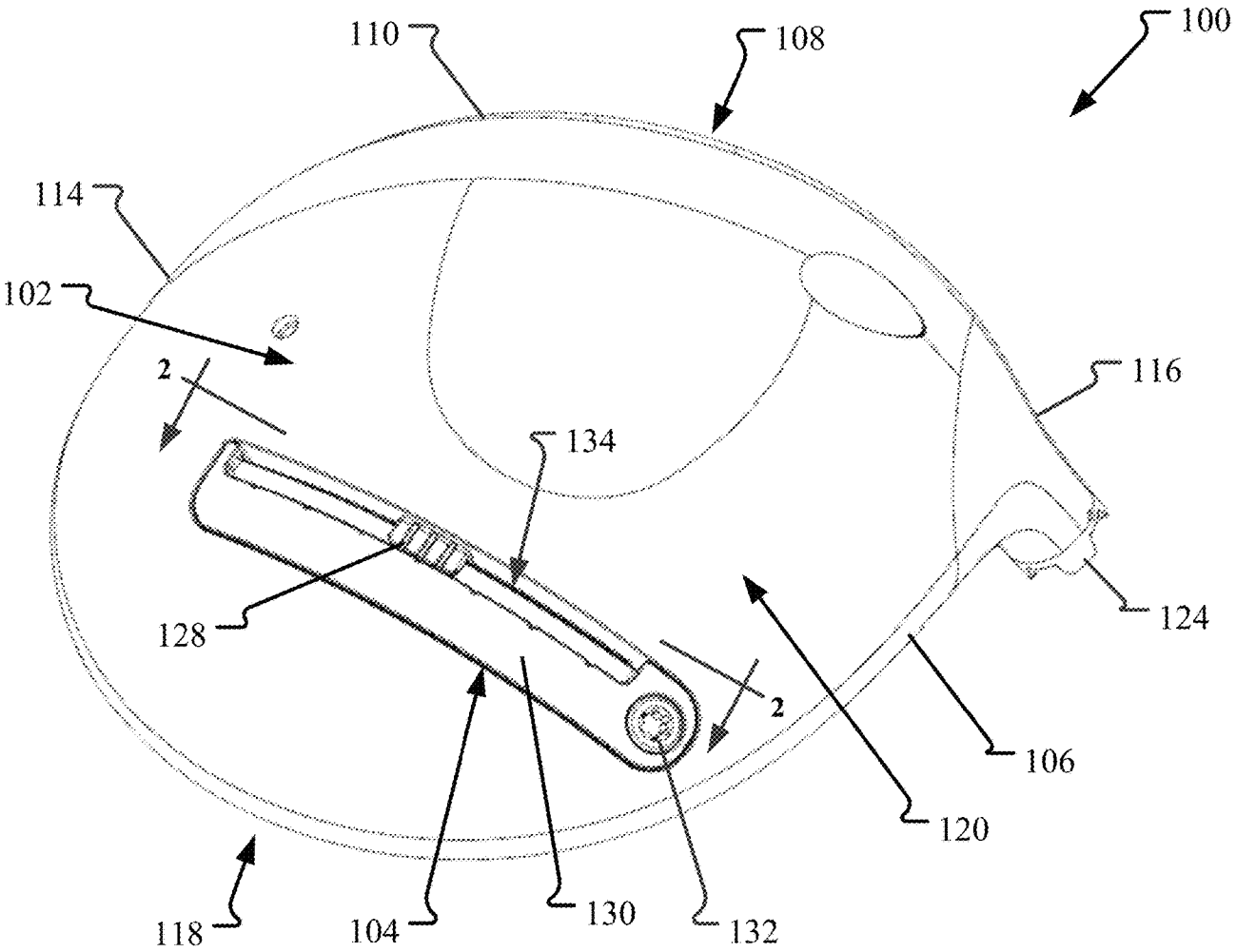
FIG. 1 is a perspective view of a sole of a golf club head with an exemplary weight assembly.

FIG. 1 is a perspective view of a sole 102 of a golf club head 100 with an exemplary weight assembly 104. The golf club head 100 is a metalwood-type golf club head having a body 106 that includes a striking face 108 positioned towards the front of the club head 100 and having a lower edge 110 and an upper edge 112 (e.g., shown in FIG. 8) each extending between a toe 114 and heel 116 of the club head 100. The sole 102 extends from the lower edge 110 on the bottom side of the club head 100 and a crown 118 extends from the upper edge 112 on the top of the club head 100. The sole 102, the striking face 108, and the crown 118 are coupled together so as to define an outer surface 120 of the body 106 with an interior cavity 122 (shown in FIG. 2) formed within. A hosel 124 is disposed at the heel 116 and is configured to couple to a shaft (not shown). In some examples, a skirt 126 (shown in FIG. 8) may also form a portion of the club head 100 and is positioned between the crown 118 and the sole 102. In such examples and for purposes of this application, the crown 118 may still be considered to be attached or coupled to the sole 102, via the skirt 126. Furthermore, the body 106 may form any type club head, such as an iron-type club head or hybrid-type club head, as required or desired.

In operation, the sole 102 generally provides the lower surface of the club head 100 when the club head 100 is placed in an address position. The club head 100 defines a center of gravity (CG) and a moment of inertia (MOI) that impact flight characteristics of a golf ball (not shown) when hit with the striking face 108. The weight assembly 104 is coupled to the club head 100 such that the CG and/or the MOI of the club head 100 can be selectively adjusted as required or desired. In the example, the weight assembly 104 includes a movable weight 128, a cover 130 configured to secure the weight 128 in place, and a fastener 132 for coupling the weight assembly 104 to one or more other portions of the club head 100. In some examples, the weight 128 may be formed from tungsten. In examples, the weight 128 may be between about 2 grams to 15 grams. In some specific examples, the weight 128 may be about 9 grams.

A recessed elongated channel 134 is formed in the outer surface 120 of the club head 100. More specifically, the channel 134 is substantially linear and defined in the sole 102 of the club head 100. In other examples, the channel 134 may be defined at any other location of the body 106 (e.g., the crown 118 or the skirt 126) as required or desired. The channel 134 is sized and shaped to receive at least a portion of the weight 128 so that the weight 128 can be slidable therein. In the example, the channel 134 extends substantially linearly in a toe 114—heel 116 direction so that the CG and the MOI of the club head 100 can be adjusted (by selectively moving the weight 128) for fade or draw bias. The channel 134 can be angularly offset from the plane of the striking face 108 as illustrated in FIG. 1. In other examples, the channel 134 may extend substantially parallel to the striking face 108. In the example, the fastener 132 is positioned proximate to the heel side of the channel 134. In other examples, the fastener 132 may be positioned at any other location relative to the channel 134 to enable the weight assembly 104 to function as described herein. For example, at approximately a midpoint of the channel 134 as described in reference to FIG. 26 or proximate the toe side of the channel 134.

In operation and through use of the fastener 132, the cover 130 is coupled to the body 106 and extends at least partially over the channel 134 so as to selectively secure the weight 128 to the club head 100. Additionally, the cover 130 covers at least a portion of the channel 134 so as to reduce dust and dirt from accumulating therein. However, the fastener 132 is separate from the weight 128 and only indirectly (e.g., via the cover 130) secures the weight 128 to the club head 100. In examples, the fastener 132 and the cover 130 are adapted to retain the weight 128 in the channel 134 only by contact with the cover 130 such that the fastener 132 never engages the weight 128. As described herein, when the fastener 132 indirectly retains the weight 128, the fastener 132 never engages the weight 128 directly and it is a separate component (e.g., the cover 130) that directly engages the weight 128 for securement to the club head 100.

The cover 130 may be loosened or completely removed, via the fastener 132, from the club head 100 to enable the weight 128 to slide within the channel 134 and selectively adjust the CG and the MOI as required or desired. Because the weight 128 is selectively moveable, the weight assembly 104 (e.g., the fastener 132, the weight 128, and the cover 130) enables the movement of the weight 128, while also securing the weight 128 to one or more portions of the club head 100 so that undesirable movement (e.g., during a club swing) is reduced or prevented. By separating the fastener 132 from the weight 128, the size, shape, and/or density of the weight 128 may be configured so that the CG and the MOI of the club head 100 may be more finely tuned, thereby increases the performance of the golf club head 100. The weight assembly 104 is described further below.

Figure 2:
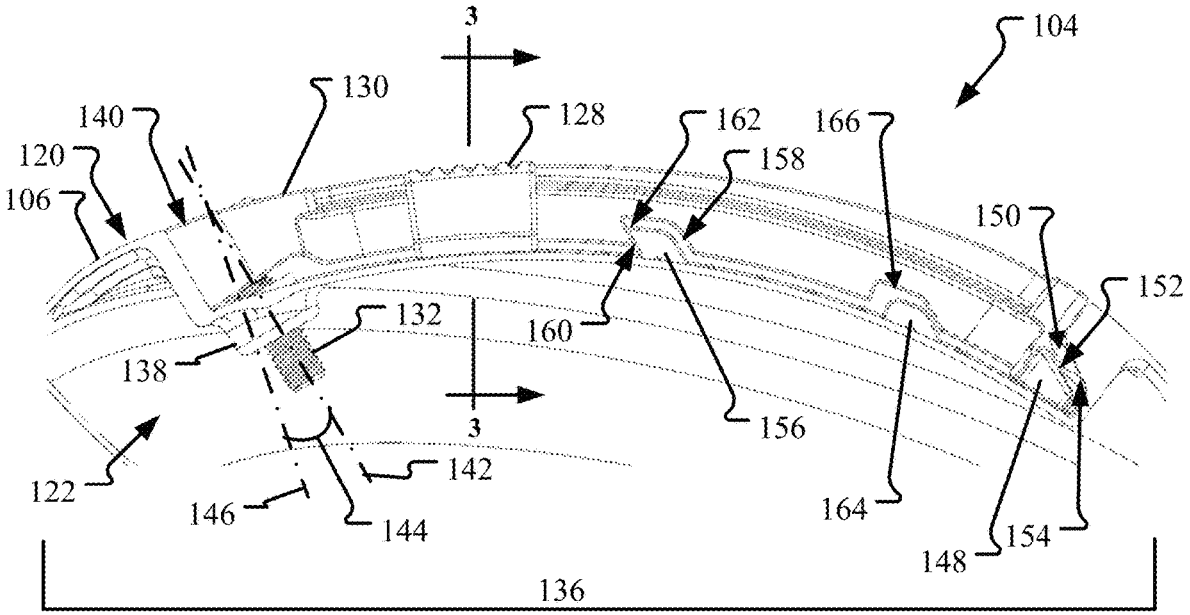
FIG. 2 is a cross-sectional view of the golf club head taken along line 2-2 in FIG. 1 where the weight assembly is in a locked configuration.
Figure 3:
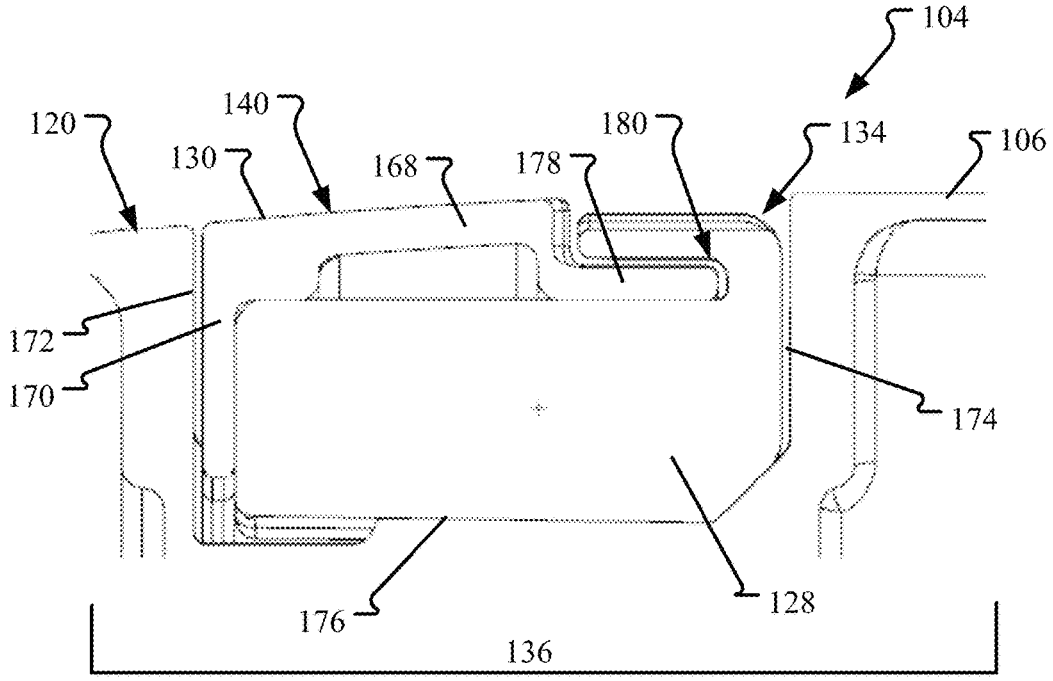
FIG. 3 is a cross-sectional view of the weight assembly taken along line 3-3 in FIG. 2.

FIG. 2 is a cross-sectional view of the golf club head 100 taken along line 2-2 in FIG. 1 and showing the weight assembly 104 in a locked configuration 136. FIG. 3 is a cross-sectional view of the weight assembly 104 taken along line 3-3 in FIG. 2. Referring concurrently to FIGS. 2 and 3, when the weight assembly 104 is in the locked configuration 136, the cover 130 is disposed within the channel 134 and the weight 128 is secured within the channel 134 such that movement is restricted. In the example, to lock the cover 130 to the body 106, the fastener 132 may be a threaded bolt that threadingly engages with a nut 138 positioned within the heel end of the channel 134. In some examples, the nut 138 may be integrally formed within the body 106.

When the cover 130 is in the locked configuration 136, an exterior surface 140 of the cover 130 is substantially aligned (e.g., flush) with the outer surface 120 of the body 106. Additionally, the fastener 132 defines a fastener axis 142. In the example, the fastener axis 142 is disposed at an angle 144 relative to a plane 146 that is normal to the exterior surface 140 of the cover 130 proximate the fastener 132. The angle 144 defines the orientation that the cover 130 may move relative to the body 106. The angle 144 may be between about 0° (e.g., aligned with the plane 146) and about 88°. In examples, the angle 144 may be between about 20° and 50°. In one example, the angle 144 may be about 45°.

In the example, only a single fastener 132 is used to couple the cover 130 to the body 106 and the fastener 132 is positioned at the heel end of the weight assembly 104. As such, to connect the toe end of the cover 130 to the body 106, the cover 130 may include one or more projections 148 that extend from the toe end. The projection 148 is sized and shaped to be received within one or more corresponding chambers 150 defined at the toe end of the channel 134. When the weight assembly 104 is in the locked configuration 136, the projection 148 is received at least partially within the chamber 150 and engaged therewith. By engaging the cover 130 to the body 106 at a position opposite from the fastener 132, when the weight 128 is positioned away from the fastener 132, the cover 130 still enables securement of the weight 128 within the channel 134 and reduces or prevents movement of the weight 128 in the locked configuration 136. In the example, the projection 148 extends in the toe-heel direction of the cover 130 and includes at least one oblique surface 152 that frictionally engages with a corresponding at least one oblique surface 154 of the chamber 150. In some examples, the oblique surfaces 152, 154 may be substantially parallel to the fastener axis 142. In other examples, the oblique surfaces 152, 154 may be oriented at a different angle than the fastener axis 142 (e.g., steeper or shallower angles). Additionally or alternatively, the projection 148 and chamber 150 may extend substantially orthogonal to the toe-heel direction (e.g., in and out of the page of FIG. 2).

The cover 130 may also be engaged with the body 106 at one or more intermediate positions between the fastener 132 and the opposite end. A seat 156 may protrude into the channel 134 at a location between the toe end and the heel end, for example, proximate a midpoint location of the channel 134. The seat 156 is sized and shaped to be received within a corresponding notch 158 defined in the cover 130. When the weight assembly 104 is in the locked configuration 136, the seat 156 is received at least partially within the notch 158 and engaged therewith. This engagement of the cover 130 to the body 106 at a position away from the fastener 132, also secures the weight 128 within the channel 134 and reduces or prevents movement of the weight 128 in the locked configuration 136. In the example, the seat 156 extends in the toe-heel direction of the channel 134 and includes at least one oblique surface 160 that frictionally engages with a corresponding at least one oblique surface 162 of the notch 158. In some examples, the oblique surfaces 160, 162 may be substantially parallel to the fastener axis 142. In other examples, the oblique surfaces 160, 162 may extend at angle relative to the bottom of the channel 134 between about 3° and 88°. In one example, the oblique surfaces 160, 162 may extend at an angle relative to the bottom of the channel 134 of about 30°.

A cam 164 may also protrude into the channel 134 at a location between the toe end and the heel end, for example, between the seat 156 and the chamber 150. The cam 164 is sized and shaped to receive within a corresponding cutout 166 defined in the cover 130. When the weight assembly 104 is in the locked configuration 136, the cam 164 is received at least partially within the cutout 166. The cam 164 and the cutout 166 are described further below in reference to FIG. 4.

In the example, the cover 130 is substantially L-shaped with a long leg 168 and a short leg 170. In the locked configuration 136, the long leg 168 forms the exterior surface 140 and the short leg 170 extends within the channel 134. The channel 134 is formed from two opposing sidewalls 172, 174 and a bottom track 176 offset from the outer surface 120 of the body 106. The long leg 168 of the cover 130 opposes the track 176 of the channel 134 and the short leg 170 of the cover 130 is adjacent to one of the sidewalls 172. The seat 156 and the cam 164 may protrude from the sidewall 172 of the channel 134 and the corresponding notch 158 and cutout 166 may be defined in the short leg 170 of the cover 130. When the weight 128 is secured within the channel 134 and in the locked configuration 136, the weight 128 is compressed between cover 130 and one or more walls (e.g., the sidewall 174 and/or the track 176) of the channel 134. As such, the weight 128 is frictionally secured to one or more portions of the club head 100 by the weight assembly 104.

Additionally, the weight 128 may be slidably coupled to the cover 130. The long leg 168 of the cover 130 may include a flange 178 extending therefrom. The flange 178 is sized and shaped to be received at least partially within a corresponding groove 180 defined in the weight 128. In the locked configuration 136, a portion of the weight 128 is not covered by the cover 130 and exposed within the channel 134 such that the portion forms part of the outer surface 120 of the body 106. This enables for the location of the weight 128 within the channel 134 to be easily determined by visual inspection.

Figure 4:
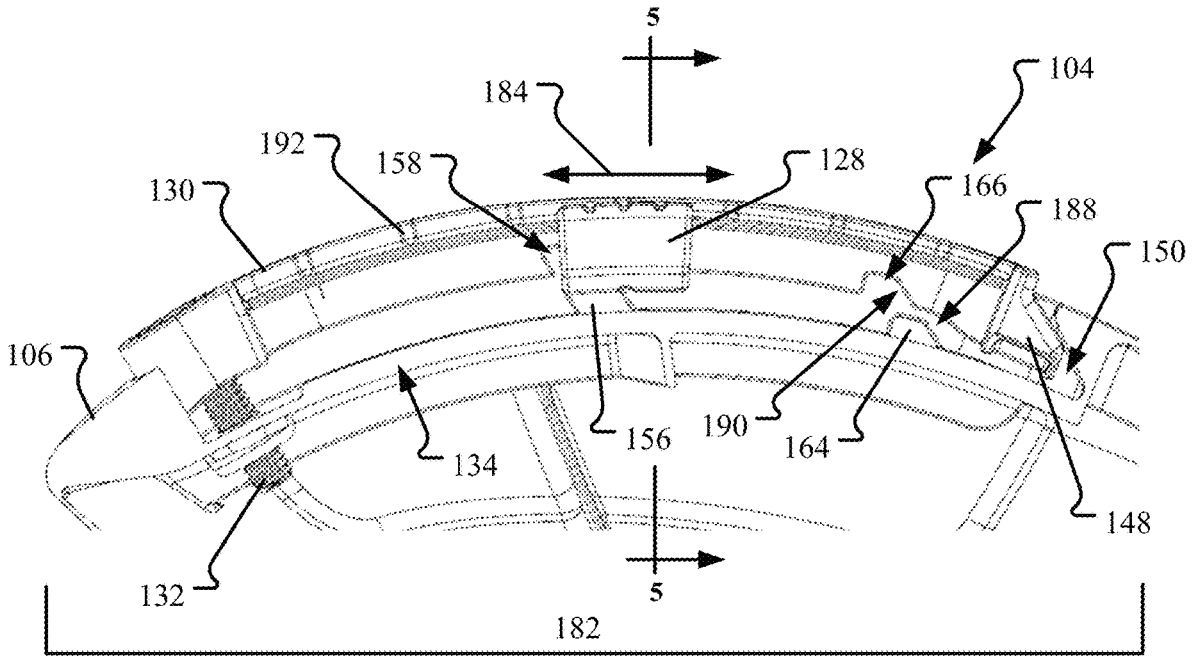
FIG. 4 is a cross-sectional view of the golf club head taken along line 2-2 in FIG. 1 where the weight assembly is in an unlocked configuration.
Figure 5:
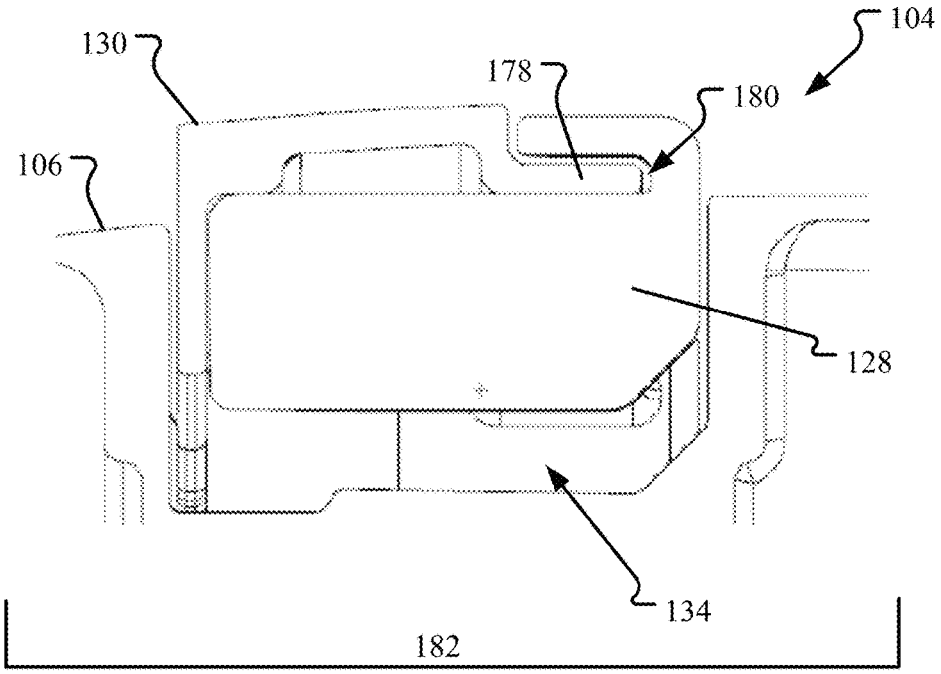
FIG. 5 is a cross-sectional view of the weight assembly taken along line 5-5 in FIG. 4.

FIG. 4 is a cross-sectional view of the club head 100 taken along line 2-2 in FIG. 1 and showing the weight assembly 104 in an unlocked configuration 182. FIG. 5 is a cross-sectional view of the weight assembly 104 taken along line 5-5 in FIG. 4. Referring concurrently to FIGS. 4 and 5, when the weight assembly 104 is in the unlocked configuration 182, at least a portion of the cover 130 is lifted and raised out of the channel 134 such that the weight 128 is selectively slidable (e.g., along a toe-heel direction 184) within the channel 134. In the example, the fastener 132 may be coupled to the cover 130 (e.g., with a lock washer 186 (shown in FIG. 16)), so that the cover 130 moves along the fastener axis 142 (shown in FIG. 2) upon rotation of the fastener 132. The cover 130 and the fastener 132 may be completely removed from the body 106 as required or desired so as to completely remove the weight 128 from the channel 134. However, in examples, moving the weight assembly 104 between the locked configuration 136 (shown in FIGS. 2 and 3) and the unlocked configuration 182 does not require that the weight assembly 104 be uncoupled from the body 106. As such, in the unlocked configuration 182, the cover 130 may remain coupled to the body 106 so that it is less likely that the components become lost or misplaced. In some examples, the fastener 132 and/or the nut 138 may include a hard stop (not shown) that prevents the fastener 132 from being completely de-threaded from the club head 100 as required or desired.

Since only a single fastener 132 is used to couple the cover 130 to the body 106 and the fastener 132 is positioned at the heel end of the weight assembly 104, the cam 164 may be used to assist the toe end of the cover 130 with lifting from the channel 134 in the unlocked configuration 182. This enables the weight 128 to more easily slide to positions away from the fastener 132. In the example, the cam 164 extends in the toe-heel direction of the channel 134 and includes at least one camming surface 188 that slidingly engages with a corresponding camming surface 190 of the cutout 166. As the cover 130 moves from the locked configuration 136, where the cam 164 is received within the cutout 166, toward the unlocked configuration 182, the camming surfaces 188, 190 slide against one another to lift the toe end of the cover 130. In some examples, when the weight assembly 104 is in the unlocked configuration 182, a portion of the cover 130 may be supported on the cam 164. The camming surfaces 188, 190 may be substantially parallel to the fastener axis 142.

Additionally, in the unlocked configuration 182, the notch 158 may lift away from the seat 156 to disengage the oblique surfaces 160, 162 (shown in FIG. 2). In the unlocked configuration 182, the notch 158 may lift partially or completely for the seat 156. The projection 148 may also lift away from the chamber 150. However, the projection 148 may remain at least partially engaged with the chamber 150 so that the weight 128 cannot slide out of the toe end of the cover 130 and remain within the channel 134 in the unlocked configuration 182. Furthermore, because the weight 128 is engaged with the cover 130 (e.g., the flange 178 and the groove 180), the weight 128 moves with the cover 130 between the locked configuration 136 and the unlocked configuration 182. This enables the weight 128 to be more easily slidable in the unlocked configuration 182.

In some examples, one or more of the weight 128, the cover 130, and the channel 134 may include complementary features (e.g., corresponding detents 192 on the cover 130 and recesses (not shown) on the weight 128) that index the location of the weight 128 to the channel 134 and/or the cover 130. These complementary indexing features may provide tactile and/or audible feedback when the weight 128 is moved. Additionally, the complementary indexing features may also provide increased resistance to the relative movement between the weight 128 and the channel 134 and/or cover 130 when the weight assembly 104 is in the locked configuration 136.

Figure 6:
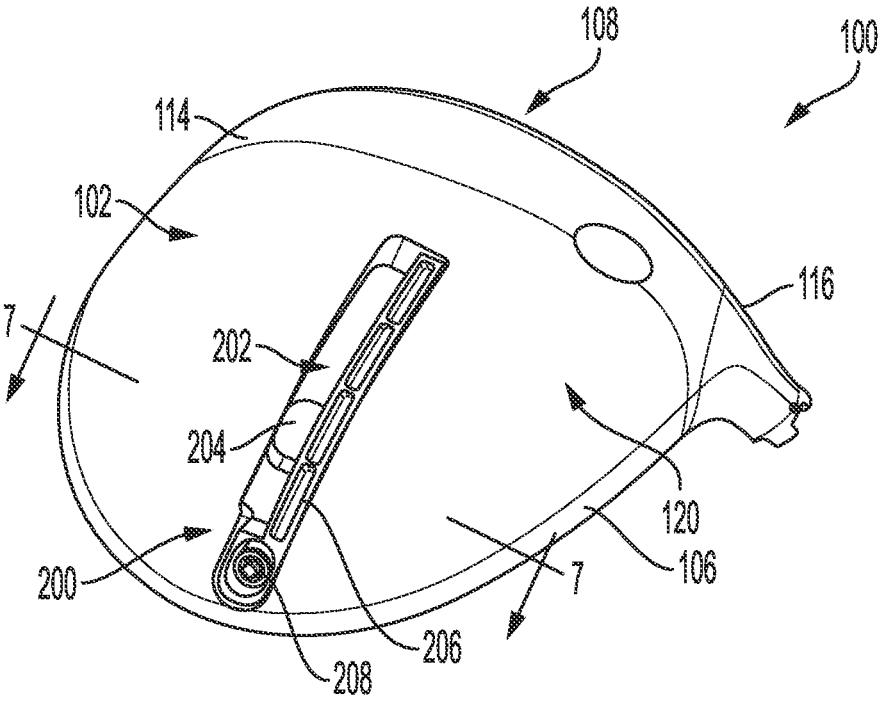
FIG. 6 is a perspective view of the sole of the golf club head with another weight assembly.
Figure 7:
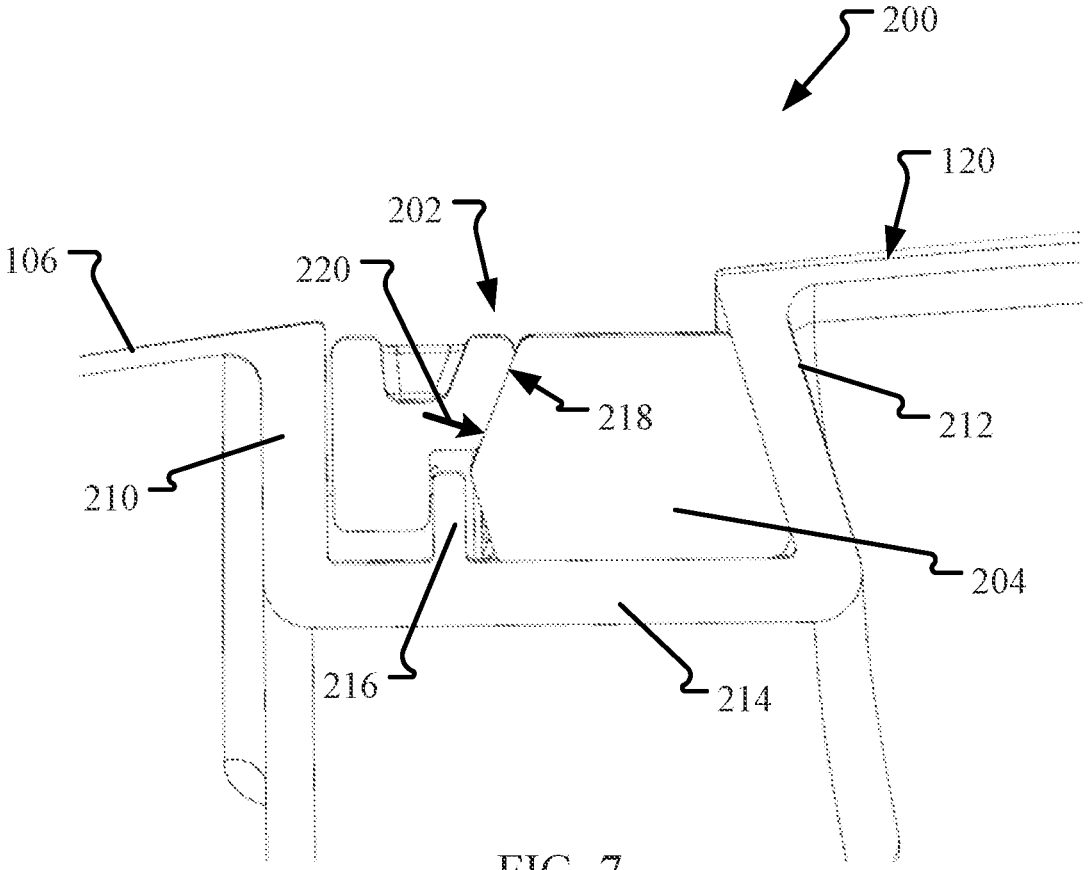
FIG. 7 is a cross-sectional view of the weight assembly taken along line 7-7 in FIG. 6.

FIG. 6 is a perspective view of the sole 102 of the golf club head 100 with another weight assembly 200. FIG. 7 is a cross-sectional view of the weight assembly 200 taken along line 7-7 in FIG. 6. Certain components are described above, and thus, are not necessarily described further. Referring concurrently to FIGS. 6 and 7, the weight assembly 200 includes a recessed channel 202 defined within the sole 102 of the body 106 of the club head 100, however, the channel 202 extends substantially linearly in a front-rear direction so that the CG and the MOI of the club head 100 can be adjusted for launch angle bias. The channel 202 can be substantially orthogonal to the striking face 108 as illustrated in FIG. 6. In other examples, the channel 202 may extend at either an acute or obtuse angle relative to the striking face 108. The weight assembly 200 also includes a slidable weight 204, a cover 206, and a fastener 208. In this example, the fastener 208 is positioned proximate to the rear of channel 202 and opposite of the striking face 108. In other examples, the fastener 208 may be positioned at any other location relative to the channel 202 to enable the weight assembly 200 to function as described herein. For example, at approximately a midpoint of the channel 202 or proximate the striking face 108 side of the channel 202.

In this example, the channel 202 is formed by two opposing sidewalls, a cover sidewall 210 and an undercut sidewall 212, and a bottom track 214 offset from the outer surface 120 of the body 106. A partial wall 216 also extends from the bottom track 214. Here, the cover 206 is located adjacent to the cover sidewall 210 and includes an angled surface 218. As such, when the weight assembly 200 is in a locked configuration (e.g., FIG. 7), the cover 206 generates a compressive force 220 along the angled surface 218 that acts in both a downward direction and a transverse direction to secure the weight 204 between the cover 206 and the undercut sidewall 212. Accordingly, the weight 204 is frictionally secured to one or more portions of the club head 100 by the weight assembly 200 and at least partially underneath the angled surface 218 and the undercut sidewall 212. The weight 204 is at least partially trapezoidal in cross-sectional shape so that the undercuts of the sidewall 212 and the cover 206 assist in retaining the weight 204 within the channel 202. Additionally, the cover 206 engages with the partial wall 216 so that the portion of the cover 206 away from the fastener 208 is restricted from moving within the channel 202 (e.g., bending or flexing) towards the undercut sidewall 212. Furthermore, the partial wall 216 is substantially parallel to the fastener axis (not shown) of the fastener 208 so that the cover 206 is guided between the locked and unlocked configuration. In some example, the weight assembly 200 may include the seat/notch interface as described above to further engage the cover 206 within the channel 202 and increase the securement of the weight 204 to one or more portions of the club head 100.

Figure 8:
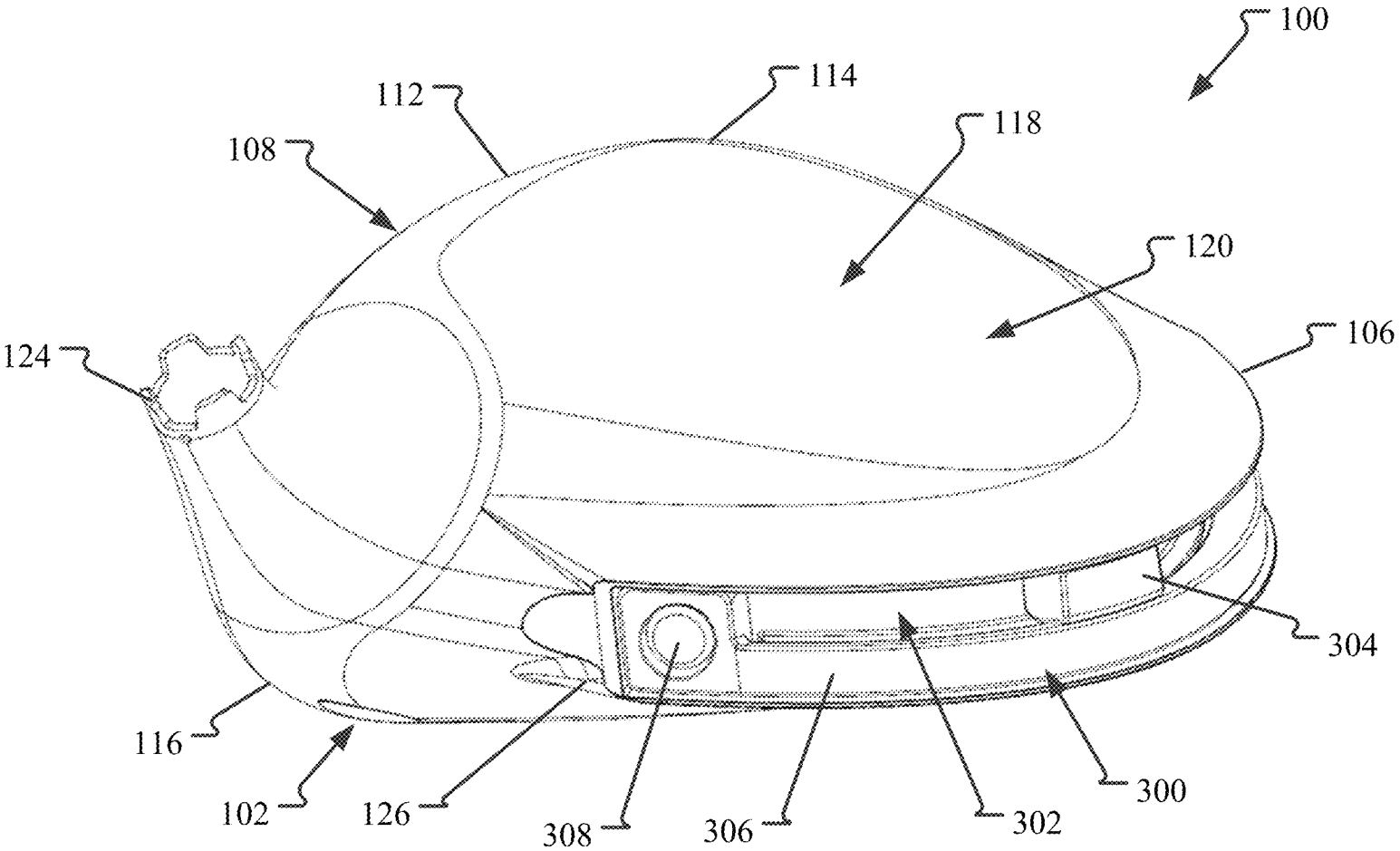
FIG. 8 is a perspective view of the golf club head with another weight assembly.

FIG. 8 is a perspective view of the golf club head 100 with another weight assembly 300. Certain components are described above, and thus, are not necessarily described further. In this example, the club head 100 includes the skirt 126 positioned between the crown 118 and the sole 102, opposite of the striking face 108. The weight assembly 300 includes a recessed channel 302 defined within the skirt 126 of the body 106 of the club head 100 and extends along the rear perimeter of the club head 100 such that the channel 302 has a curved shape. The weight assembly 300 also includes a slidable weight 304, a cover 306, and a fastener 308. In this example, the fastener 308 is coupled to the heel 116 side of the body 106. In other examples, the fastener 308 may be coupled to the toe 114 side of the body 106 as required or desired. The weight assembly 300 may include one or more of the weight assembly features described herein to enable the CG and the MOI of the club head 100 to be adjustable for fade-draw bias, while securing the weight 304 in a locked configuration (as shown in FIG. 8).

Figure 9:
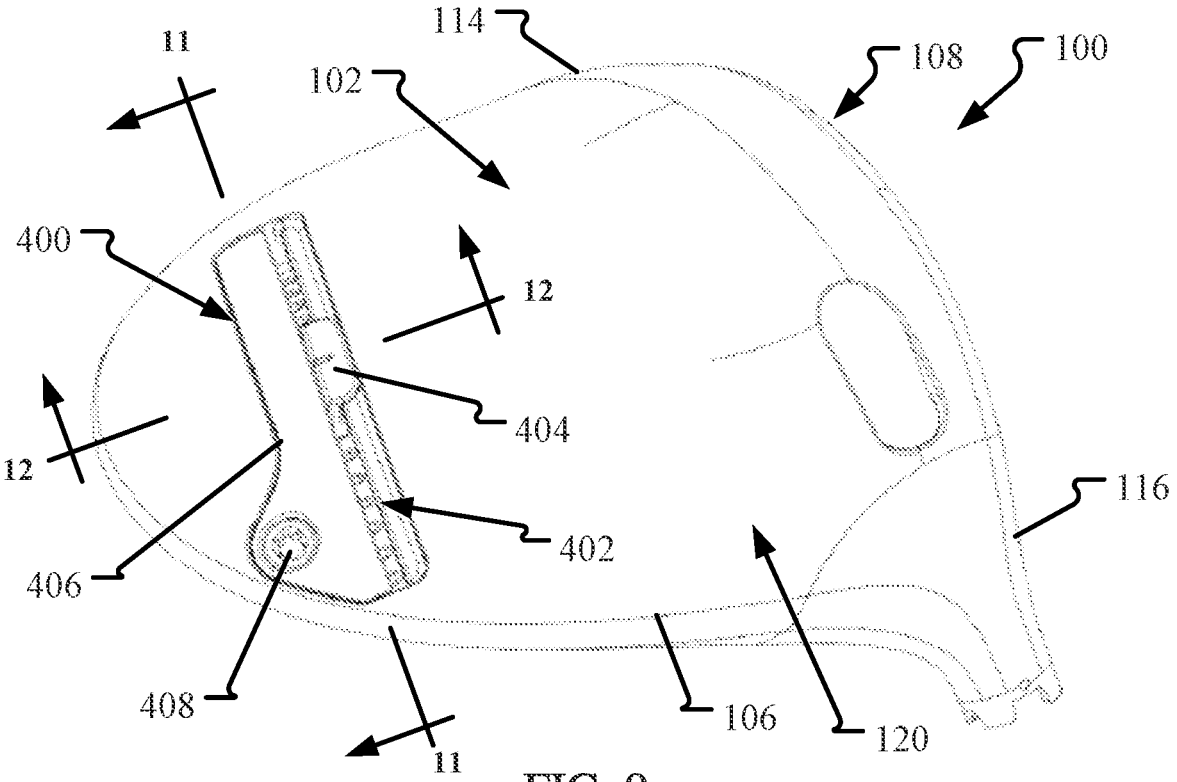
FIG. 9 is a perspective view of the sole of the golf club head with another weight assembly.
Figure 10:
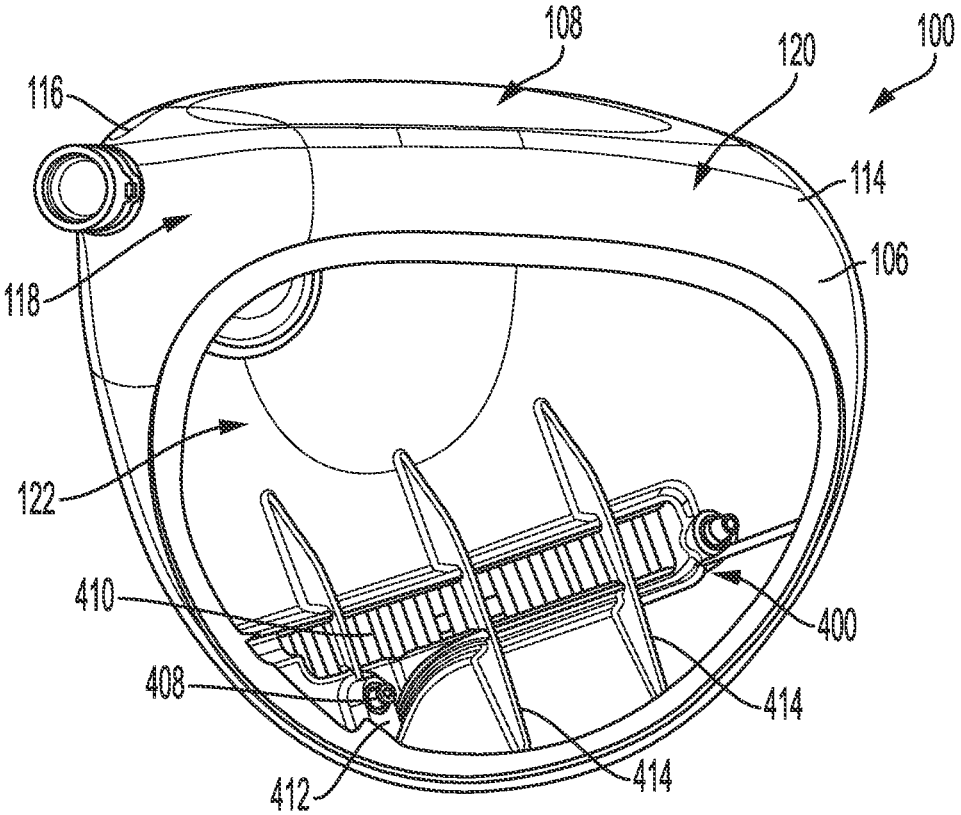
FIG. 10 is a top view of the golf club head shown in FIG. 9 with a portion of a crown removed.

FIG. 9 is a perspective view of the sole 102 of the golf club head 100 with another weight assembly 400. FIG. 10 is a top view of the golf club head 100 shown in FIG. 9 with a portion of the crown 118 removed. Certain components are described above, and thus, are not necessarily described further. Referring concurrently to FIGS. 9 and 10, the weight assembly 400 includes a recessed channel 402 defined within the sole 102 of the body 106 of the club head 100 that extends substantially linearly in the toe 114—heel 116 direction. The weight assembly 400 also includes a slidable weight 404, a cover 406, and a fastener 408. The channel 402 includes a bottom track 410 that the weight 404 is slidable on. In this example, the fastener 408, and also a nut 412 that the fastener 408 couples to, are offset from the track 410 and positioned towards the rear of the body 106. By offsetting the fastener 408 from the track 410, the length of the track 410 can be extended in the toe-heel direction so that the weight 404 can be positioned at a greater number of locations on the sole 102. In other examples, the fastener 408 may be offset from the track 410 and positioned towards the front and the striking face 108 of the body 106 as required or desired.

In this example, one or more support ribs 414 may extend from the channel 402 and within the interior cavity 122 of the body 106. The support ribs 414 are substantially orthogonal to the length of the channel 402. The support ribs 414 provide structural strength to the channel 402 so that the channel 402 is resistant to deformation when the cover 406 compresses the weight 404 therein. In some examples, the support ribs 414 may extend the entire distance between the sole 102 and the crown 118 within the interior cavity 122.

Figure 11:
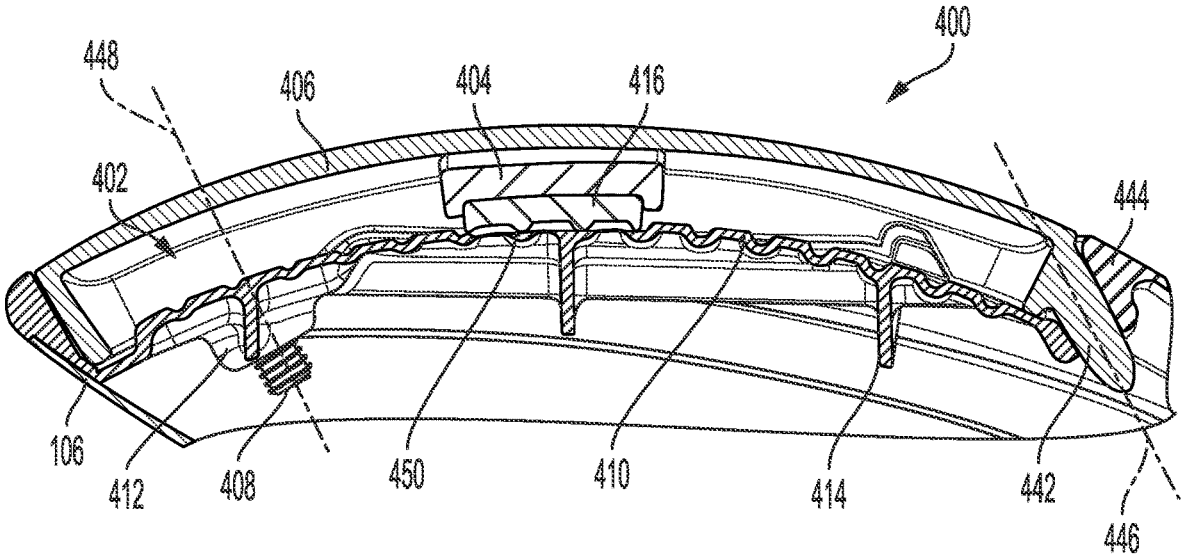
FIG. 11 is a cross-sectional view of the weight assembly taken along line 11-11 in FIG. 9.
Figure 12:
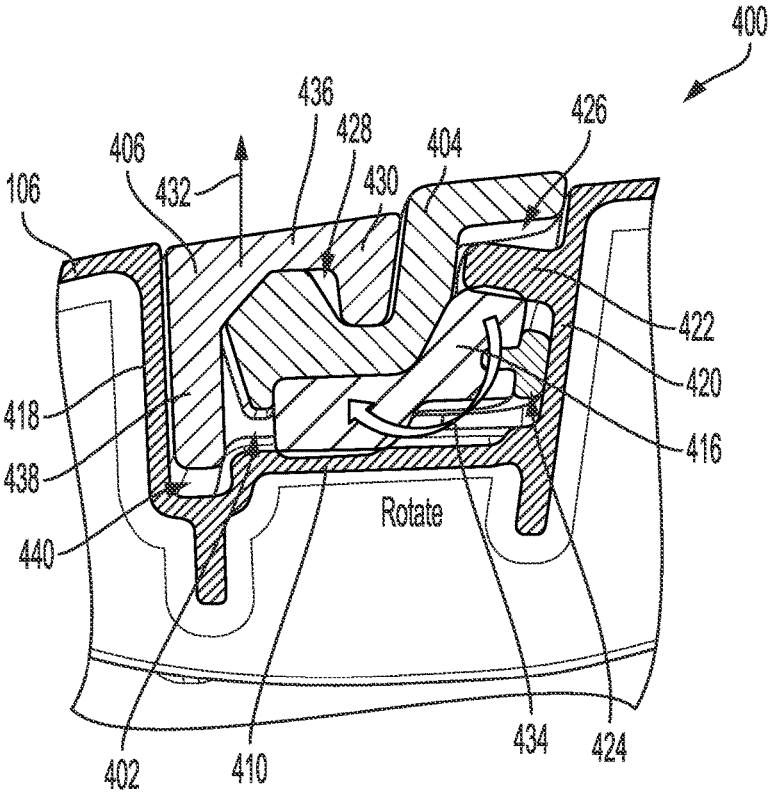
FIG. 12 is a cross-sectional view of the weight assembly taken along line 12-12 in FIG. 9.

FIG. 11 is a cross-sectional view of the weight assembly 400 taken along line 11-11 in FIG. 9. FIG. 12 is a cross-sectional view of the weight assembly 400 taken along line 12-12 in FIG. 9. Certain components are described above, and thus, are not necessarily described further. Referring concurrently to FIGS. 11 and 12, the weight assembly 400 is illustrated in a locked configuration so that the weight 404 is secured within the channel 402. In this example, the weight 404 includes an elastomeric material 416 (e.g., a rubber-based material) that engages with the channel 402 and/or the cover 406 and further increase securement of the weight 404 in the locked configuration. Additionally, the elastomeric material 416 decreases rattling of the weight 404 within the channel 402 during the swing of the club head.

In this example, the channel 402 is formed from two opposing sidewalls 418, 420 and the track 410. One sidewall 420 may include an elongate fin 422 extending into the channel 402. The weight 404 is sized and shaped to be received at least partially within the channel 402 and includes a bottom surface 424 that is positioned adjacent to the track 410 and a slot 426 that engages with the fin 422. Additionally, opposite of the slot 426, the weight 404 includes a groove 428 that engages with a flange 430 of the cover 406. The elastomeric material 416 may be coupled to the weight 404 so that the material 416 extends from the bottom surface 424 and also into the slot 426. In one example, the elastomeric material 416 may be a unitary piece that extends through one or more holes within the weight 404. In other examples, the elastomeric material 416 may be adhered to one or more external surfaces of the weight 404. In still other examples, at least a portion of the elastomeric material 416 may form the weight 404 itself.

In operation, when the cover 406 is in the locked configuration, the flange 430 engages with the groove 428 of the weight 404 and compresses the weight 404 into the channel 402. As such, the elastomeric material 416 may engage with the track 410 and the fin 422 of the channel 402. By engaging the elastomeric material 416 in more than one location, securement of the weight 404 within the channel 402 increases. This reduces undesirable movement and rattling of the weight 404 within the channel 402. In some examples, the elastomeric material 416 may deform when compressed within the channel 402. Since the cover 406 engages with only a portion of the weight 404, when the cover 406 is lifted 432 for the unlocked configuration (not shown), the weight 404 can rotate 434 within the channel 402 so that the elastomeric material 416 may disengage from the track 410 and the fin 422. This rotational movement 434 enables the weight 404 to be more easily slidable within the channel 402 while in the unlocked configuration because the elastomeric material 416 is at least partially positioned away from the channel surfaces. In some examples, the elastomeric material 416 extending from the bottom surface 424 may be only proximate the groove 428 so as to increase rotational movement 434 of the weight 404.

The cover 406 is substantially L-shaped in cross-section (see FIG. 12) and receives at least a portion of the weight 404 therein. The cover includes a first leg 436 that has the flange 430 and a second leg 438 that is adjacent to the sidewall 418 of the channel 402. The flange 430 may be substantially parallel to the second leg 438 so as to increase the structural rigidity of the cover 406 in the lengthwise direction. The second leg 438 may extend at least partially within a depression 440 of the track 410 so as to decrease bending of the cover 406 while in the locked configuration. Additionally, in the example, a projection 442 of the cover 406 may be substantially cylindrical in shape. The projection 442 is received within a corresponding cylindrical chamber 444. This projection 442 and chamber 444 structure increases the engagement of the cover 406 with the body 106 in the locked configuration (as illustrated in FIG. 11). In some examples, a projection axis 446 of the projection 442 may be substantially parallel to a fastener axis 448. This orientation guides the movement of the cover 406 between the locked configuration and the unlocked configuration. In some examples, the projection 442 may include a tapered nose. In this example, the weight 404 and the channel 402 may include complementary features 450 that index the location of the weight 404 to the channel 402.

Figure 13:
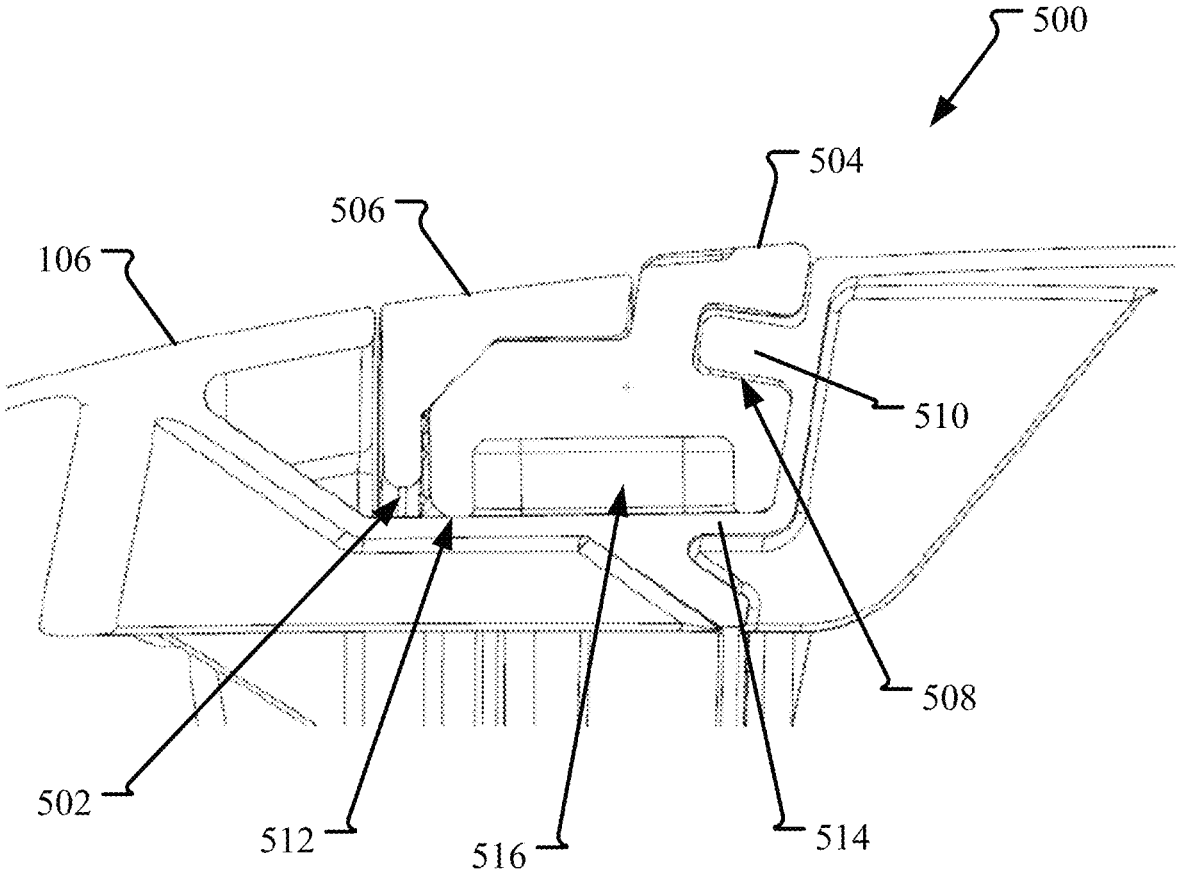
FIG. 13 is a cross-sectional view of another weight assembly.

FIG. 13 is a cross-sectional view of another weight assembly 500. Certain components are described above, and thus, are not necessarily described further. Similar to the example described in FIGS. 9-12, in this example, the weight assembly 500 includes a recessed channel 502 defined within the body 106 of the club head. The weight assembly 500 also includes a slidable weight 504 and a cover 506. The cover 506 is shown in a locked configuration and a slot 508 of the weight 504 is engaged with a fin 510 of the channel 502. However, in this example, a bottom surface 512 of the weight 504 is positioned directly against a track 514 of the channel 502. Additionally, in this example, the bottom surface 512 of the weight 504 includes a hollow 516. The hollow 516 reduces fictional sliding forces on the weight 504, when the weight assembly 500 is in the unlocked configuration (not shown). The hollow 516 also enables for the size and shape of the weight 504 to be formed while maintaining the required or desired mass and/or density of the weight 504. In some examples, an elastomeric material (not shown) may be disposed at least partially within the hollow 516.

Figure 14:
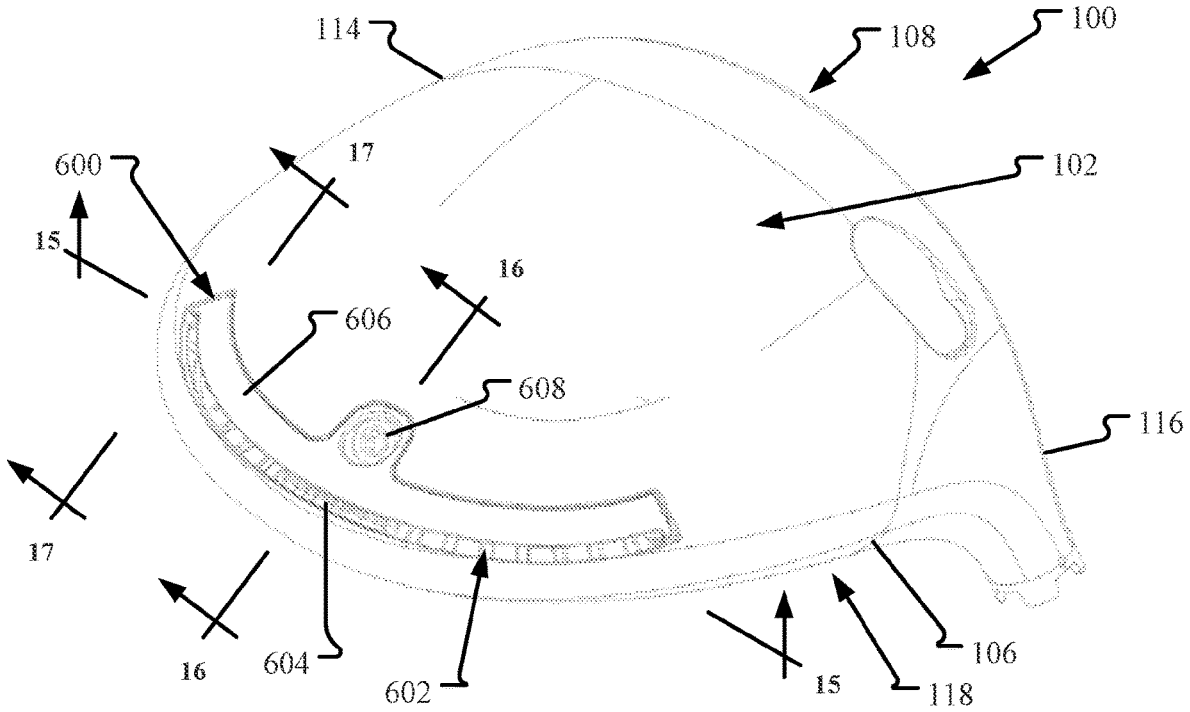
FIG. 14 is a perspective view of the sole of the golf club head with another weight assembly.

FIG. 14 is a perspective view of the sole 102 of the golf club head 100 with another weight assembly 600. Certain components are described above, and thus, are not necessarily described further. The weight assembly 600 includes a recessed channel 602 defined within the sole 102 of the body 106 of the club head 100. The channel 602 has a substantially curved shape in the toe 114—heel 116 direction so that the CG and the MOI of the club head 100 can be adjustable for fade-drawn bias. In some examples, the curve of the channel 602 matches the rear perimeter of the body 106, where the sole 102 and the crown 118 are coupled together. The weight assembly 600 also includes a slidable weight 604, a cover 606, and a fastener 608.

In this example, the fastener 608 is positioned in the concave area of the curved channel 602 and towards the striking face 108 of the body 106. This position enables the weight 604 to be positioned adjacent to the rear perimeter of the body 106 and increase the adjustability of the CG and MOI of the club head 100, when compared to having the fastener 608 positioned in the convex area of the curved channel 602 and the weight 604 being closer to the striking face 108. Additionally, the weight 604 may slide completely from the toe 114 side to the heel 116 side and be located at any position of the channel 602 even adjacent to the fastener 608. In other examples, the fastener 608 may be positioned in the convex area of the curved channel 602 as required or desired. The fastener 608 is also positioned at approximately the midpoint of the channel 602. In other examples, the fastener 608 may be offset from the midpoint of the channel 602, or two or more fastener 608 may be used to couple the cover 606 to the body 106 (e.g., at each end of the channel 602).

Figure 15:
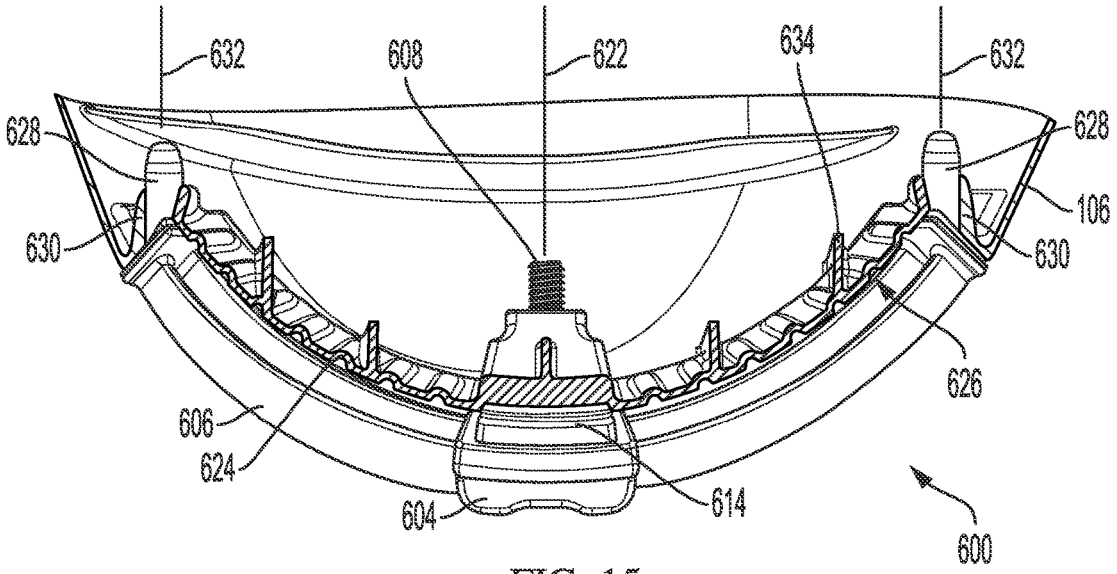
FIG. 15 is a cross-sectional view of the golf club head taken along line 15-15 in FIG. 14 and showing the weight assembly.
Figure 16:
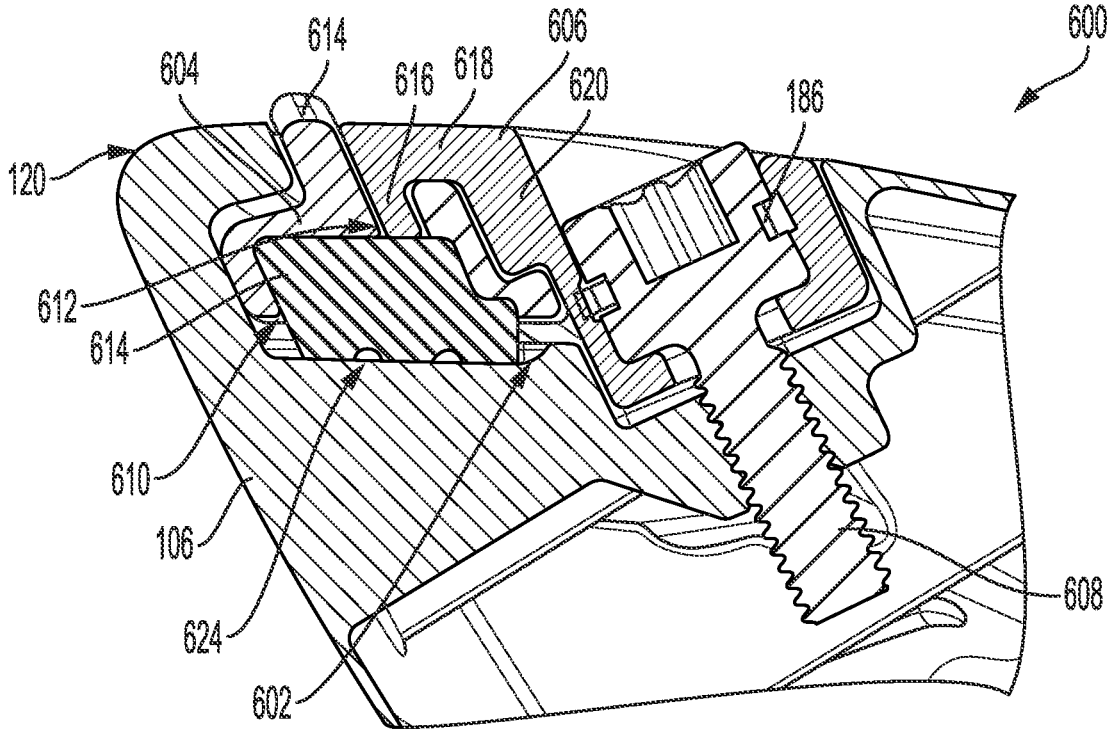
FIG. 16 is a cross-sectional view of the weight assembly taken along line 16-16 in FIG. 14.
Figure 17:
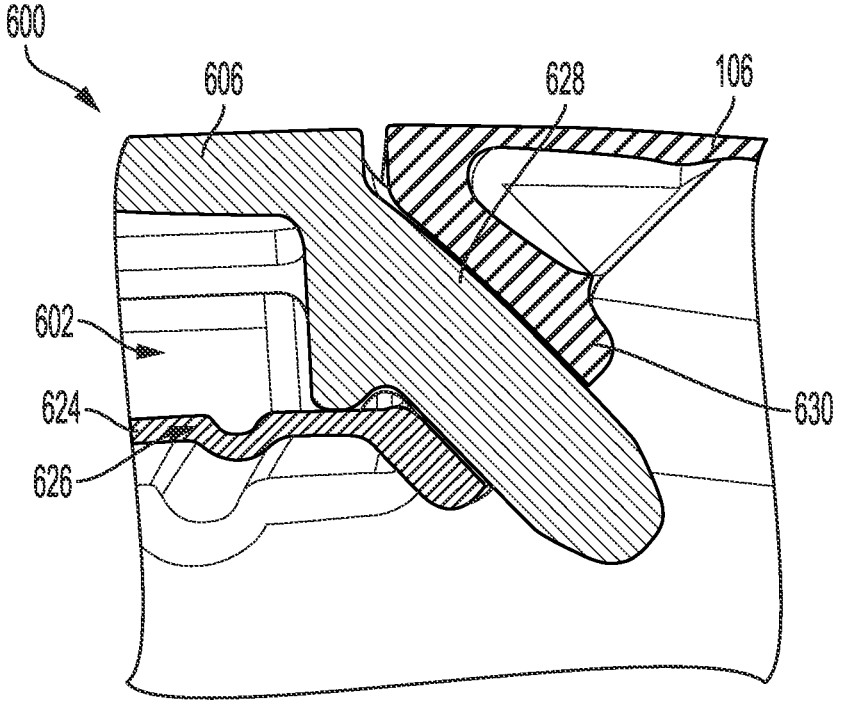
FIG. 17 is a cross-sectional view of the weight assembly taken along line 17-17 in FIG. 14.

FIG. 15 is a cross-sectional view of the club head 100 taken along line 15-15 in FIG. 14 and showing the weight assembly 600. FIG. 16 is a cross-sectional view of the weight assembly 600 taken along line 16-16 in FIG. 14. FIG. 17 is a cross-sectional view of the weight assembly 600 taken along line 17-17 in FIG. 14. Certain components are described above, and thus, are not necessarily described further. Referring concurrently to FIGS. 15-17, the weight assembly 600 is illustrated in a locked configuration and the weight 604 includes a bottom surface 610 and a groove 612. A tab 614 is disposed adjacent to the groove 612. Additionally, the weight 604 includes an elastomeric material 614. In this example, the elastomeric material 614 is coupled to the weight 604 and extends from the bottom surface 610 and also into the groove 612. The elastomeric material 614 is oversized relative to the channel 602 (e.g., between a 0.1 millimeter and 1.0 millimeter overlap) so that the material 614 may deform while being compressed within the channel 602. In other examples, the elastomeric material 614 may be adhered to the exterior surface of the weight 604. In yet other examples, the elastomeric material 614 may at least partially form the weight 604 itself.

The cover 606 is substantially C-shaped with a flange 616 that engages with the groove 612 of the weight 604. Additionally, the cover 606 includes a top leg 618 and a side leg 620 that is opposite of the flange 616. The top leg 618 has a thickness that is greater than the flange 616 and the side leg 620 so as to increase the structural rigidity of the cover 606 in a lengthwise direction. The fastener 608 is coupled to the cover 606 by a lock washer 186 that enables the fastener 608 to rotate relative to the cover 606 while allowing the cover 606 to move along a fastener axis 622 to raise and lower the cover 606 relative to the channel 602.

In operation, when the cover 606 is in the locked configuration, the flange 616 of the cover 606 is engaged within the groove 612 of the weight 604. This compresses the weight 604 between the cover 606 and a bottom track 624 of the channel 602. In the locked configuration, the elastomeric material 614 engages with both the cover 606 and the channel 602 to increase the securement of the weight 604 to one or more portion of the club head 100. In some examples, a plurality of grooves 626 are defined within the track 624 that the elastomeric material 614 deforms into the grooves 626 to facilitate securement of the weight 604 within the channel 602. Additionally, the tab 614 of the weight 604 may be positioned proximate the outer surface 120 of the body 106 so that the position of the weight 604 may be visible. When the weight assembly 600 is in the unlocked configuration (not shown), the cover 606 is lifted at least partially out of the channel 602 so that the weight 604 may be selectively slidable therein, for example, via the tab 614.

Each end of the cover 606 may include a substantially cylindrical projection 628 that is received within a corresponding cylindrical chamber 630 of the channel 602. The projections 628 extend along a projection axis 632 that is substantially parallel to the fastener axis 622. This orientation guides the movement of the cover 606 between the locked configuration and the unlocked configuration. In some examples, the projections 628 may include a tapered nose. Additionally, the chamber 630 may be open into the interior cavity 122 of the body 106 as illustrated in FIGS. 15 and 16. In other examples, the chamber 630 may be closed off from the interior cavity 122. One or more support ribs 634 may also extend from the track 624 and within the interior cavity 122 as required or desired.

Figure 18:
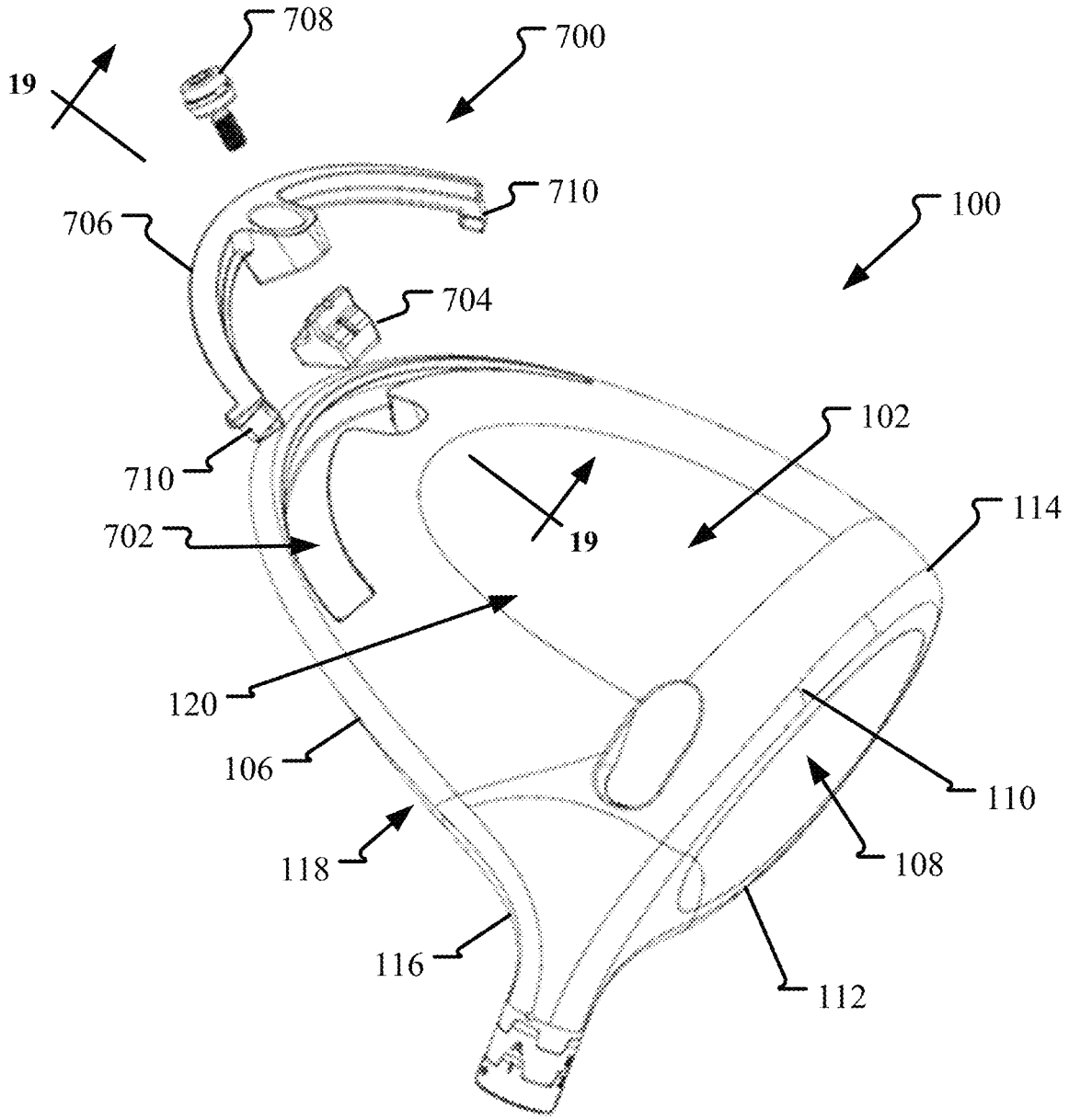
FIG. 18 is an exploded perspective view the golf club head with another weight assembly.

FIG. 18 is an exploded perspective view of the golf club head 100 with another weight assembly 700. Certain components are described above, and thus, are not necessarily described further. Similar to the example described in FIGS. 14-17, in this example, the weight assembly 700 includes a recessed channel 702 defined within the body 106 of the club head 100 and the channel 702 has a substantially curved shape in the toe 114—heel 116 direction. In some examples, the curve of the channel 702 matches the rear perimeter of the body 106, where the sole 102 and the crown 118 are coupled together. The weight assembly 700 also includes a slidable weight 704, a cover 706, and a fastener 708. At each end of the cover 706, projections 710 may extend for engagement within the channel 702.

Figure 19:
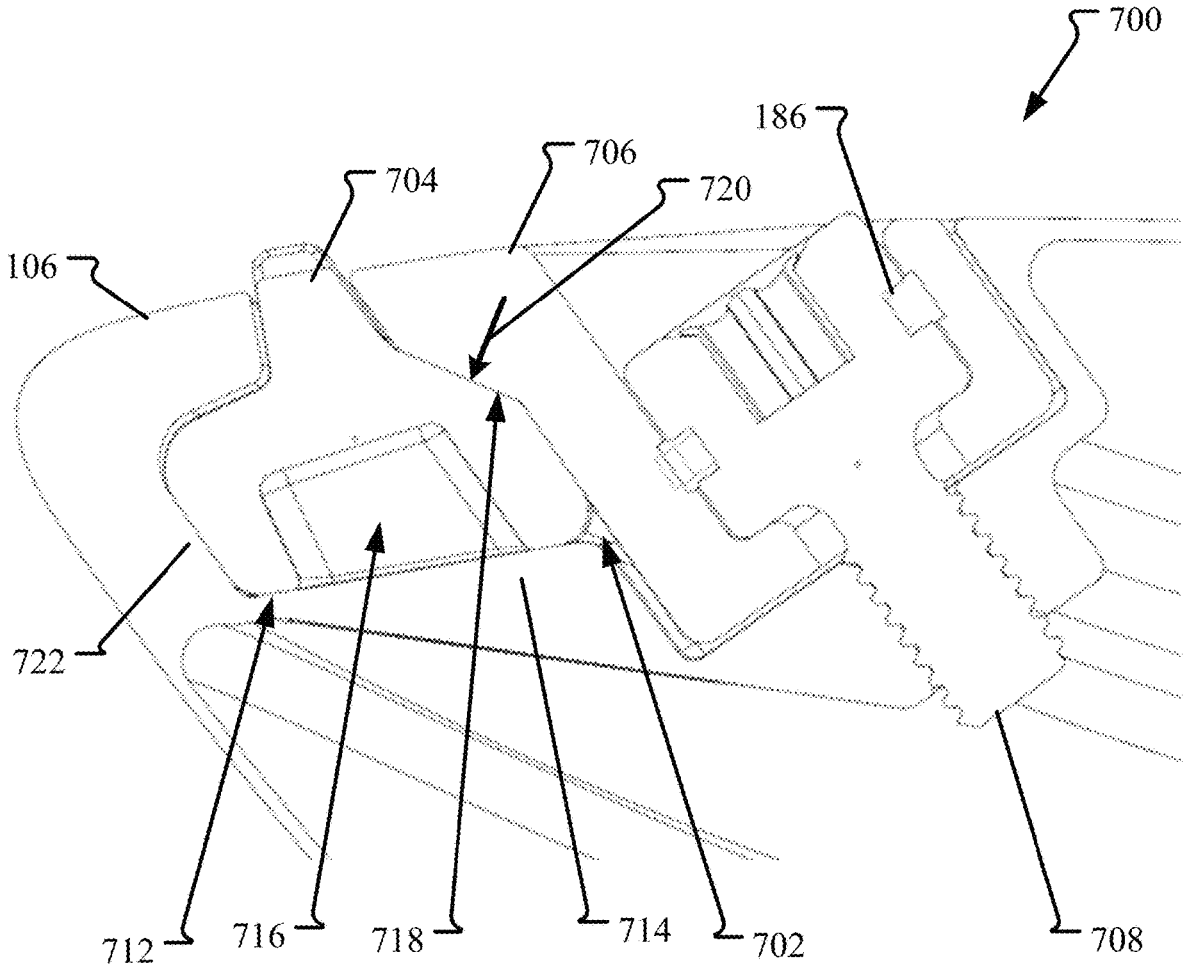
FIG. 19 is a cross-sectional view of the weight assembly taken along line 19-19 in FIG. 18.

FIG. 19 is a cross-sectional view of the weight assembly 700 taken along line 19-19 in FIG. 18. Certain components are described above, and thus, are not necessarily described further. The weight assembly 700 is illustrated in the locked configuration in FIG. 19 and a bottom surface 712 of the weight 704 is positioned directly against a track 714 of the channel 702. Additionally, in this example, the bottom surface 712 of the weight 704 includes a hollow 716. The hollow 716 reduces frictional sliding forces on the weight 704, when the weight assembly 700 is in the unlocked configuration (not shown). The hollow 716 also enables for the size and shape of the weight 704 to be formed while maintaining the required or desired mass and/or density of the weight 704. In some examples, an elastomeric material (not shown) may be disposed at least partially within the hollow 716.

Additionally, the cover 706 includes an angled surface 718 that abuts the weight 704. As such, when the weight assembly 700 is in a locked configuration (e.g., FIG. 19), the cover 706 generates a compressive force 720 along the angled surface 718 that acts in both a downward direction and a transverse direction to secure the weight 704 between the cover 706 and an undercut sidewall 722 of the channel 702. As such, the weight 704 is frictionally secured by the weight assembly 700 to one or more portions of the club head 100.

Figure 20:
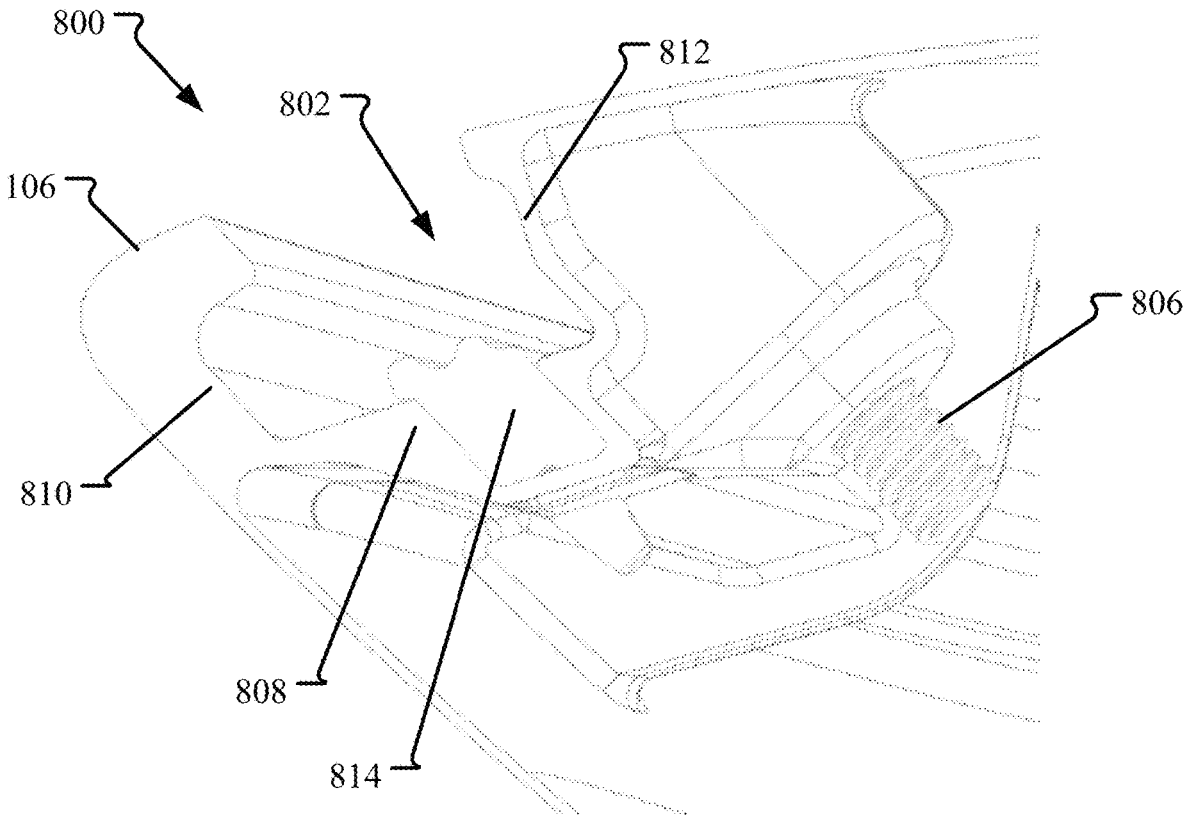
FIG. 20 is a partial cross-sectional perspective view of another weight assembly.
Figure 21:
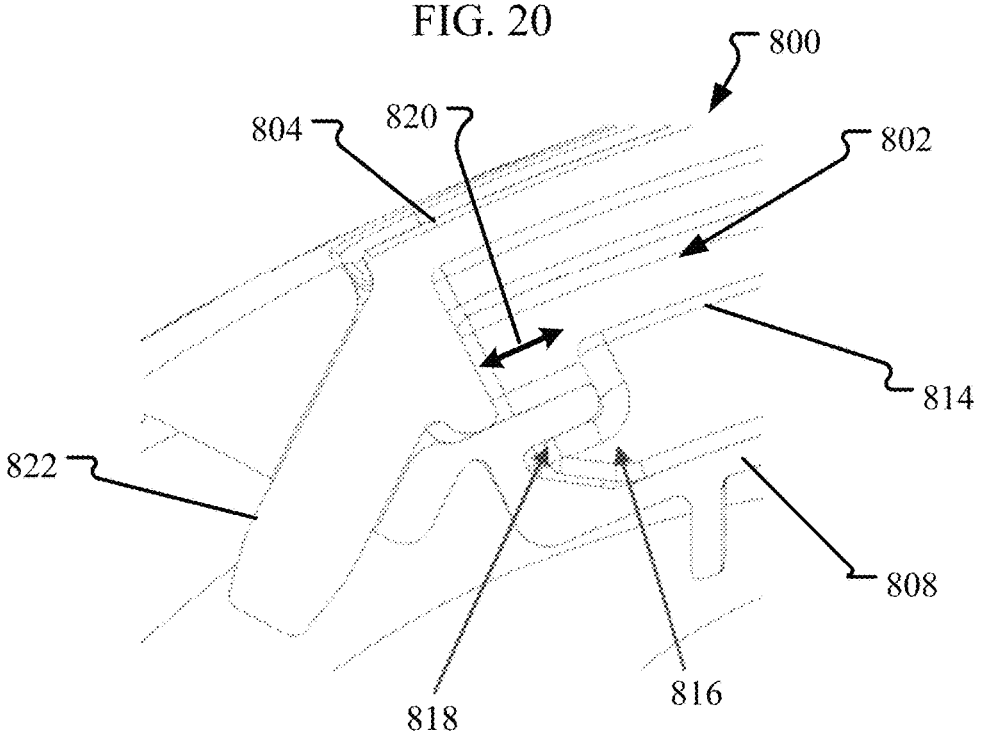
FIG. 21 is another cross-sectional view of the weight assembly shown in FIG. 20.

FIG. 20 is a partial cross-sectional perspective view of another weight assembly 800. FIG. 21 is another cross-sectional view of the weight assembly 800. Certain components are described above, and thus, are not necessarily described further. Referring concurrently to FIGS. 20 and 21, the cross-sectional views are substantially along a front-rear direction of the golf club head and, for example, similar to the examples described above in reference to FIGS. 16 and 17. The weight assembly 800 includes a recessed channel 802 defined within the body 106. The weight assembly 800 also includes a slidable weight (not shown), a cover 804, and a fastener 806. In this example, the channel 802 is defined by a bottom track 808 and two opposing sidewalls 810, 812. The bottom track 808 includes an elastomeric material 814 coupled thereto and that extends at least partially into the channel 802. The elastomeric material 814 engages with the weight and further increases securement of the weight within the channel 802 in the locked configuration. Additionally, the elastomeric material 814 decreases rattling of the weight during the swing of the club head. Additionally or alternatively, the elastomeric material 814 may be coupled to one or more of the sidewalls 810, 812 as required or desired. In still other examples, the elastomeric material 814 can be coupled to the cover 804.

In this example, the elastomeric material 814 extends along the longitudinal length of the channel 802. At each end 816 of the elastomeric material 814, a portion of the material may extend into an undercut area 818 within the channel 802 so as to secure the elastomeric material 814 within the channel 802. In other examples, the elastomeric material 814 may be adhered within the channel 802 or the cover 804 as required or desired. The end 816 of the elastomeric material 814 may be offset 820 from a projection 822 of the cover 804 so that the elastomeric material 814 does not interfere with the movement of the cover 804 between the locked and unlocked configurations as described herein.

Figure 22:
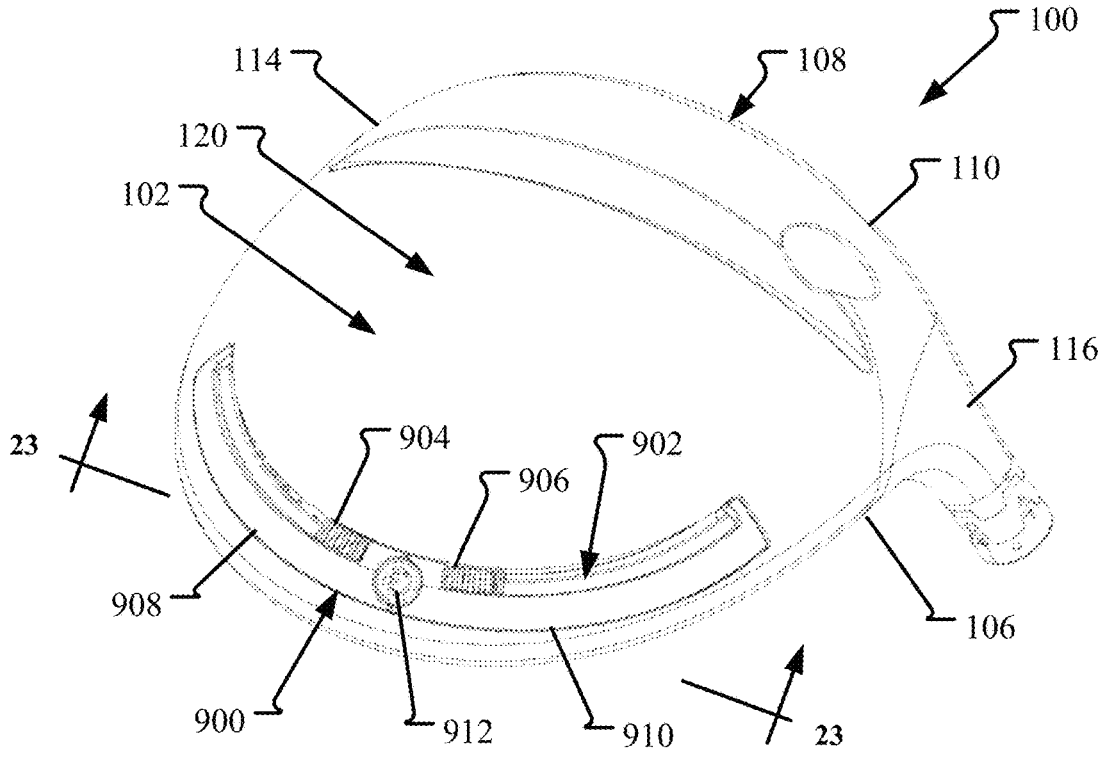
FIG. 22 is a perspective view of the sole of the golf club head with another weight assembly in a locked configuration.
Figure 23:
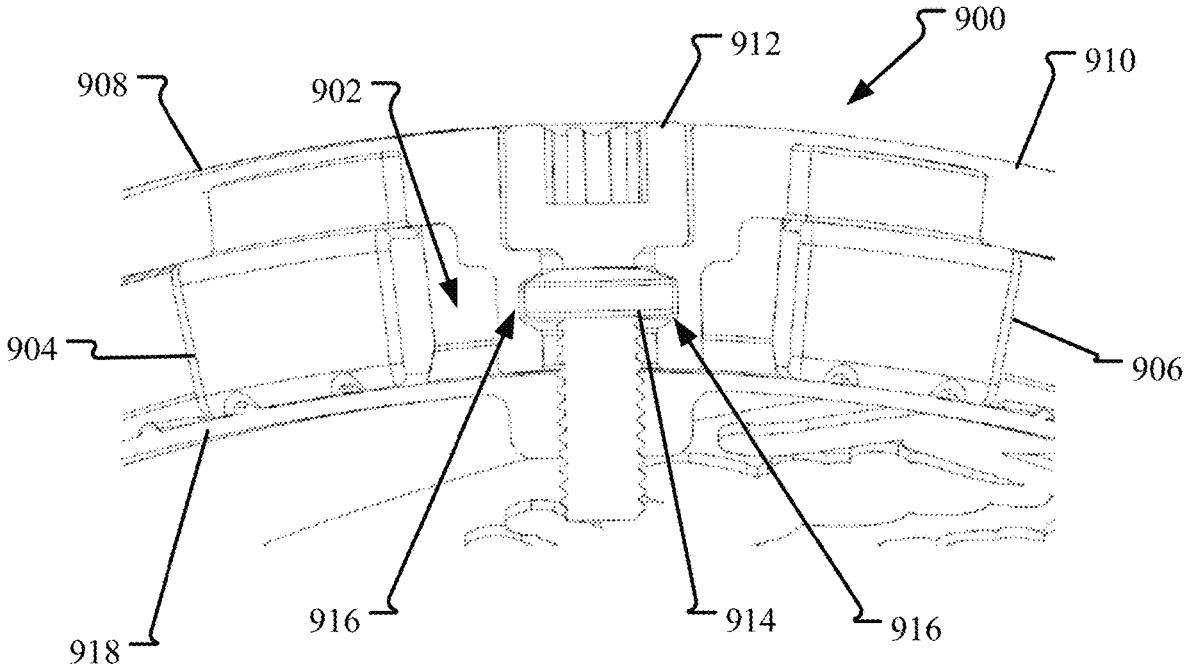
FIG. 23 is a cross-sectional view of the weight assembly taken along line 23-23 in FIG. 22.

FIG. 22 is a perspective view of the sole 102 of the golf club head 100 with another weight assembly 900 in a locked configuration. FIG. 23 is a cross-sectional view of the weight assembly 900 taken along line 23-23 in FIG. 22. Certain components are described above, and thus, are not necessarily described further. Referring concurrently to FIGS. 22 and 23, the weight assembly 900 is illustrated in a locked configuration and includes a recessed channel 902 defined within the sole 102 of the body 106 of the club head 100. The channel 902 has a substantially curved shape in the toe 114—heel 116 direction so that the CG and the MOI of the club head 100 can be adjustable for fade-drawn bias. In some examples, the curve of the channel 902 matches the rear perimeter of the body 106, where the sole 102 and the crown 118 are coupled together. The weight assembly 900 also includes a toe-side slidable weight 904, a heel-side slidable weight 906, a toe side cover 908, a heel side cover 910, and a fastener 912.

In this example, the fastener 912 is disposed within the channel 902 and divides the weight assembly 900 approximately in half. By positioning the fastener 912 within the channel 902 the size of the weight assembly 900 on the club head 100 is reduced. Additionally, the mass of the fastener 912 is moved further rearward from the striking face 108 than those examples described above. The weights 904, 906 extend from the inner convex side of the covers 908, 910 as illustrated in FIG. 22. In other examples, the weights 904, 906 may extend from the outer concave side of the covers 908, 910 as required or desired. In this example, two slidable weights 904, 906 are described since the fastener 912 prevents a weight from sliding completely from the toe side to the head side of the channel 902 and back. In some examples, the weight assembly 900 may include only one slidable weight and the fastener 912 and the covers 908, 910 are configured to allow the weight to pass between the toe 114 side and the heel 116 side. In other examples, the weight assembly 900 may include only one slidable weight that requires the assembly to be completely disassembled so as to move the weight from the toe side to the head side and back. In still other examples, the weights 904, 906 may be completely removable from the channel 902 as required or desired.

One end of each cover 908, 910 is engaged with the channel 902, for example, with the projection/channel interface as described herein, while the other opposite end of each cover 908, 910 is engaged with the fastener 912. In the example, the fastener 912 includes a washer 914 that is disposed below the head. The washer 914 is a substantially cylindrical flange extending from the threaded shaft that engages with both corresponding groove 916 within the covers 908, 910. When the weight assembly 900 is in the locked configuration the covers 908, 910 are disposed within the channel 902 and secured in place with the fastener 912, via the grooves 916, so that the weights 904, 906 cannot slide within the channel 902 and are locked in place. Additionally, the covers 908, 910 are flush with the outer surface 120 of the body 106. In some examples, the portion of the covers 908, 910 that define the grooves 916 may extend all the way to a bottom track 918 of the channel 902 so that overtightening of the fastener 912 is reduced or prevented.

Figure 24:
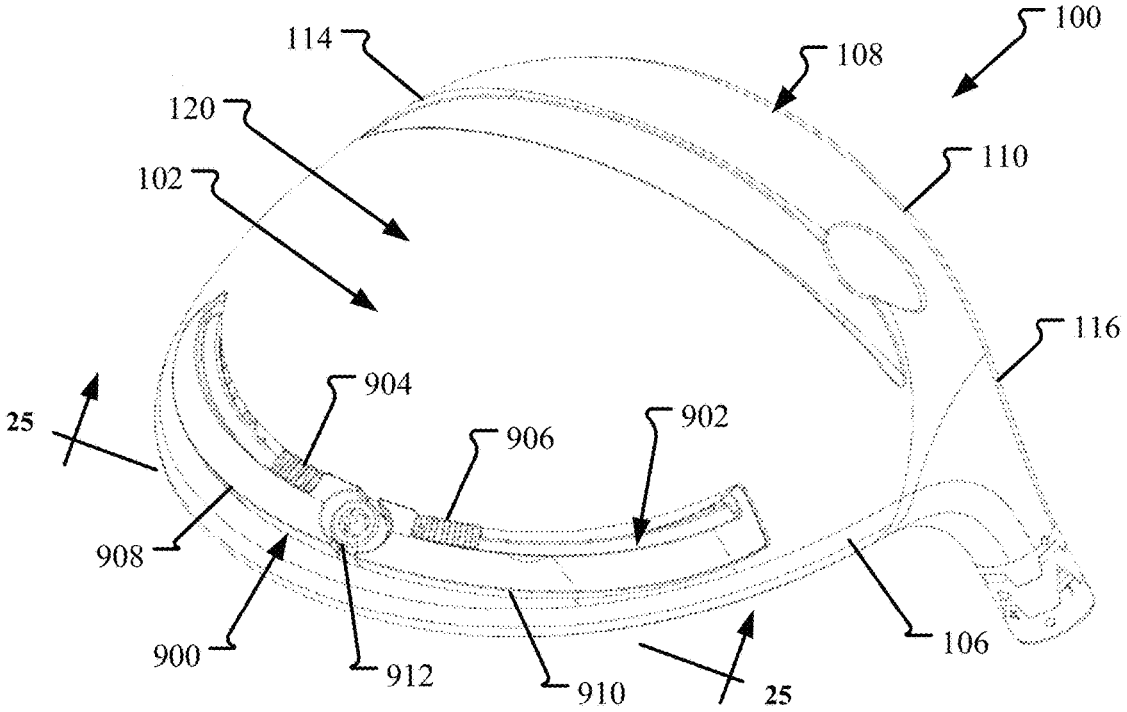
FIG. 24 is a perspective view of the sole of the golf club head with the weight assembly shown in FIG. 22 in an unlocked configuration.
Figure 25:
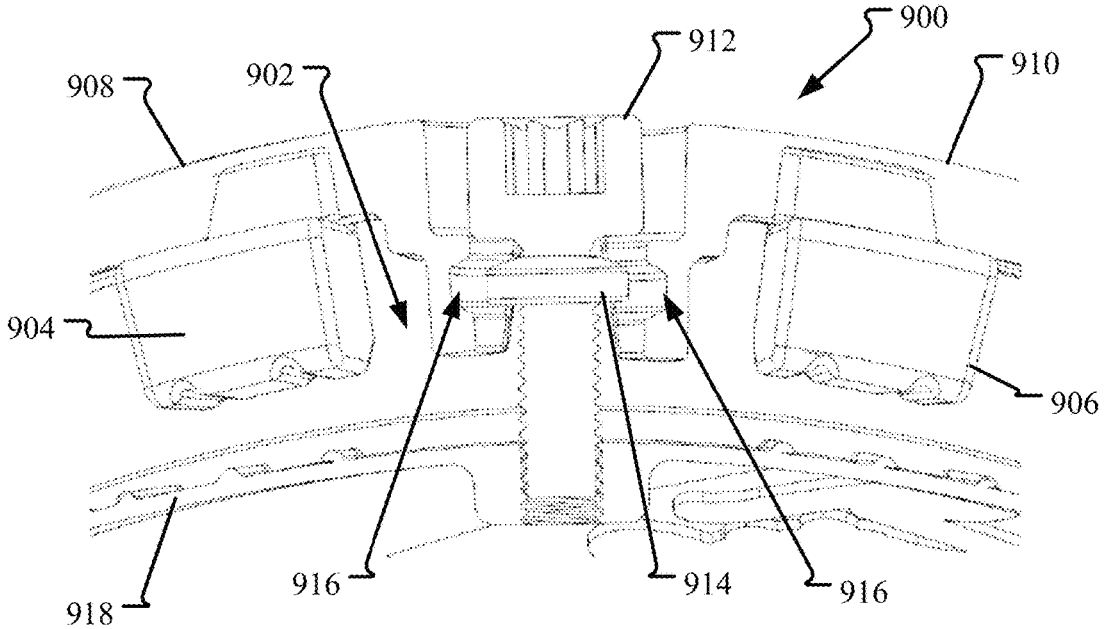
FIG. 25 is a cross-sectional view of the weight assembly taken along line 25-25 in FIG. 24.

FIG. 24 is a perspective view of the sole 102 of the golf club head 100 with the weight assembly shown 900 in an unlocked configuration. FIG. 25 is a cross-sectional view of the weight assembly 900 taken along line 25-25 in FIG. 24.

Certain components are described above, and thus, are not necessarily described further. Referring concurrently to FIGS. 24 and 25, the weight assembly 900 is illustrated in an unlocked configuration. When the weight assembly 900 moves from the locked configuration (shown in FIGS. 22 and 23), the fastener 912 is rotated so as to lift at least partially out of the channel 902. This movement of the fastener 912 also lifts the ends of the covers 908, 910 that are engaged with the washer 914 at least partially out of the channel 902 so as to enable the weights 904, 906 to slide within the channel 902. In some examples, the weights 904, 906 may be engaged with the respective cover 908, 910 so as to lift away from the track 918 for ease of movement.

In some examples, the covers 908, 910 and the fastener 912 may be completely removed from the body 106 as required or desired so as to completely remove the weights 904, 906 from the channel 902. However, moving the weight assembly 900 between the locked configuration) and the unlocked configuration does not require that the weight assembly 900 be uncoupled from the body 106. As such, in the unlocked configuration, the covers 908, 910 remain coupled to the body 106 so that it is less likely that the components become lost or misplaced.

In this example, when the covers 908, 910 are in the unlocked configuration, the ends of the covers 908, 910 that are opposite of the fastener 912 and engaged with the channel 902 (e.g., with the projection/channel interface) remain engaged with the channel 902 and may form a pivot point that the covers 908, 910 rotate about. In other examples, the ends of the covers 908, 910 that are opposite of the fastener 912 may lift at least partially out of the channel 902 as described herein. For example, through a cam and cutout interface as described above.

Figure 26:
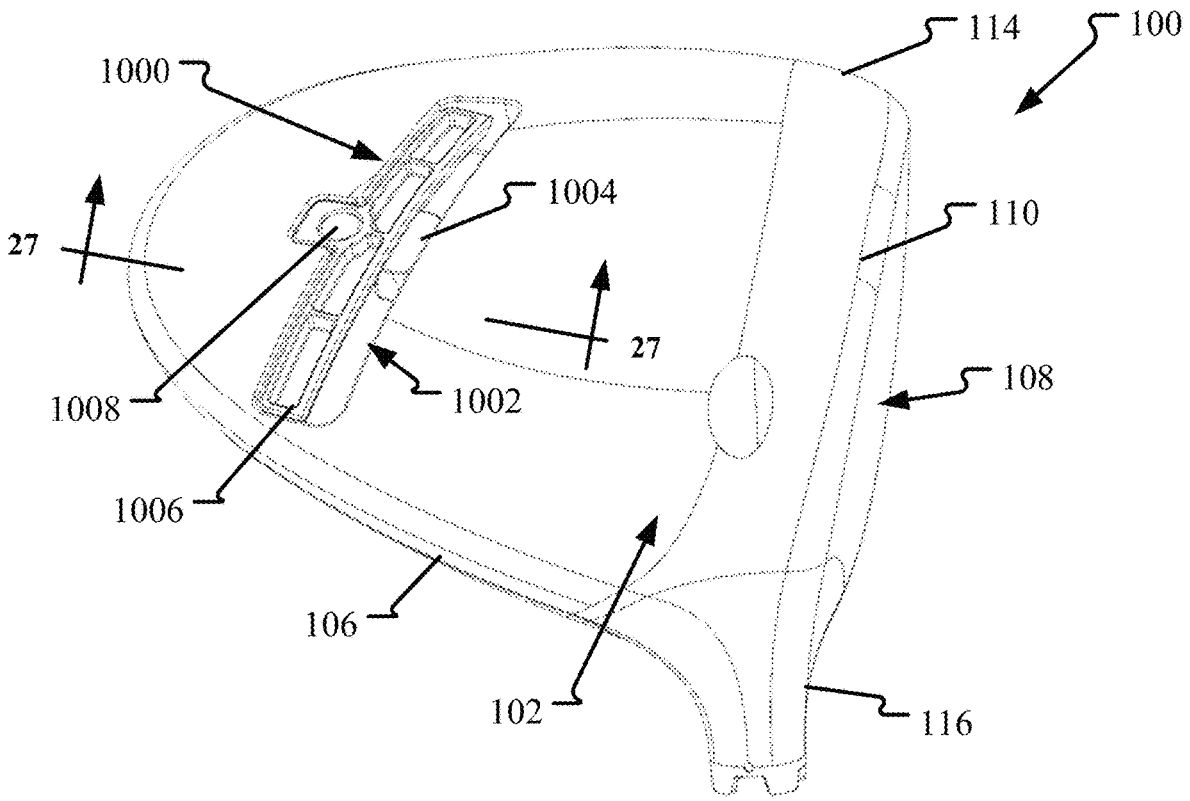
FIG. 26 is a perspective view of the sole of the golf club head with another weight assembly.
Figure 27:
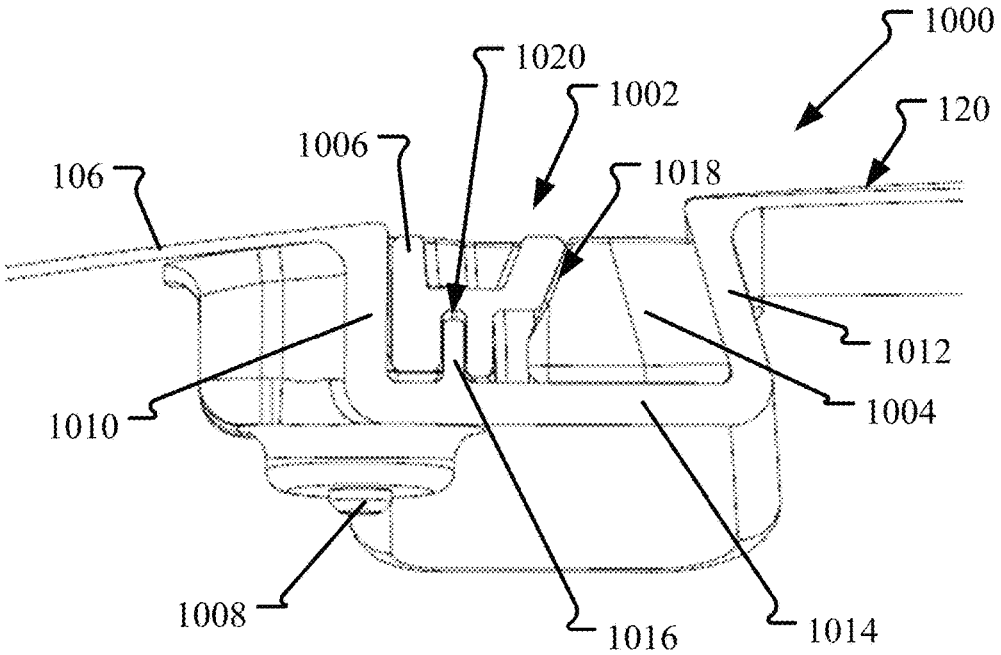
FIG. 27 is a cross-sectional view of the weight assembly taken along line 27-27 in FIG. 26.

FIG. 26 is a perspective view of the sole 102 of the golf club head 100 with another weight assembly 1000. FIG. 27 is a cross-sectional view of the weight assembly 1000 taken along line 27-27 in FIG. 26. Certain components are described above, and thus, are not necessarily described further. Referring concurrently to FIGS. 26 and 27, the weight assembly 1000 includes a substantially linear recessed channel 1002 defined within the sole 102. The weight assembly 1000 also includes a slidable weight 1004, a cover 1006, and a fastener 1008. In this example, the fastener 1008 may be positioned at approximately the midpoint of the channel 1002 and offset towards the rear of the club head 100. By positioning the fastener 1008 at a midpoint location, the distance between the fastener 1008 and the far end(s) of the cover 1006 is reduced so that the engagement between the cover 1006 and the channel 1002 is increased for securement of the weight 1004.

Similar to the example described above in reference to FIGS. 6 and 7, the channel 1002 is formed by two opposing sidewalls, a cover sidewall 1010 and an undercut sidewall 1012, and a bottom track 1014 offset from the outer surface 120 of the body 106. A partial wall 1016 also extends from the bottom track 1014. The cover 1006 is located adjacent to the cover sidewall 1010 and includes an angled surface 1018. As such, when the weight assembly 1000 is in a locked configuration (e.g., FIG. 27), the cover 1006 generates a compressive force along the angled surface 1018 that acts in both a downward direction and a transverse direction to secure the weight 1004 between the cover 1006 and the undercut sidewall 1012. Accordingly, the weight 1004 is frictionally secured by the weight assembly 1000 and at least partially underneath the angled surface 1018 and the undercut sidewall 1012. Additionally, the cover 1006 completely engages with the partial wall 1016 via a groove 1020 so that the portion of the cover 1006 away from the fastener 1008 is restricted from moving within the channel 1002 (e.g., bending or flexing) towards the undercut sidewall 1012. Furthermore, the partial wall 1016 is substantially parallel to the fastener axis (not shown) of the fastener 1008 so that the cover 1006 guides the movement between the locked and unlocked configuration.

Figure 28:
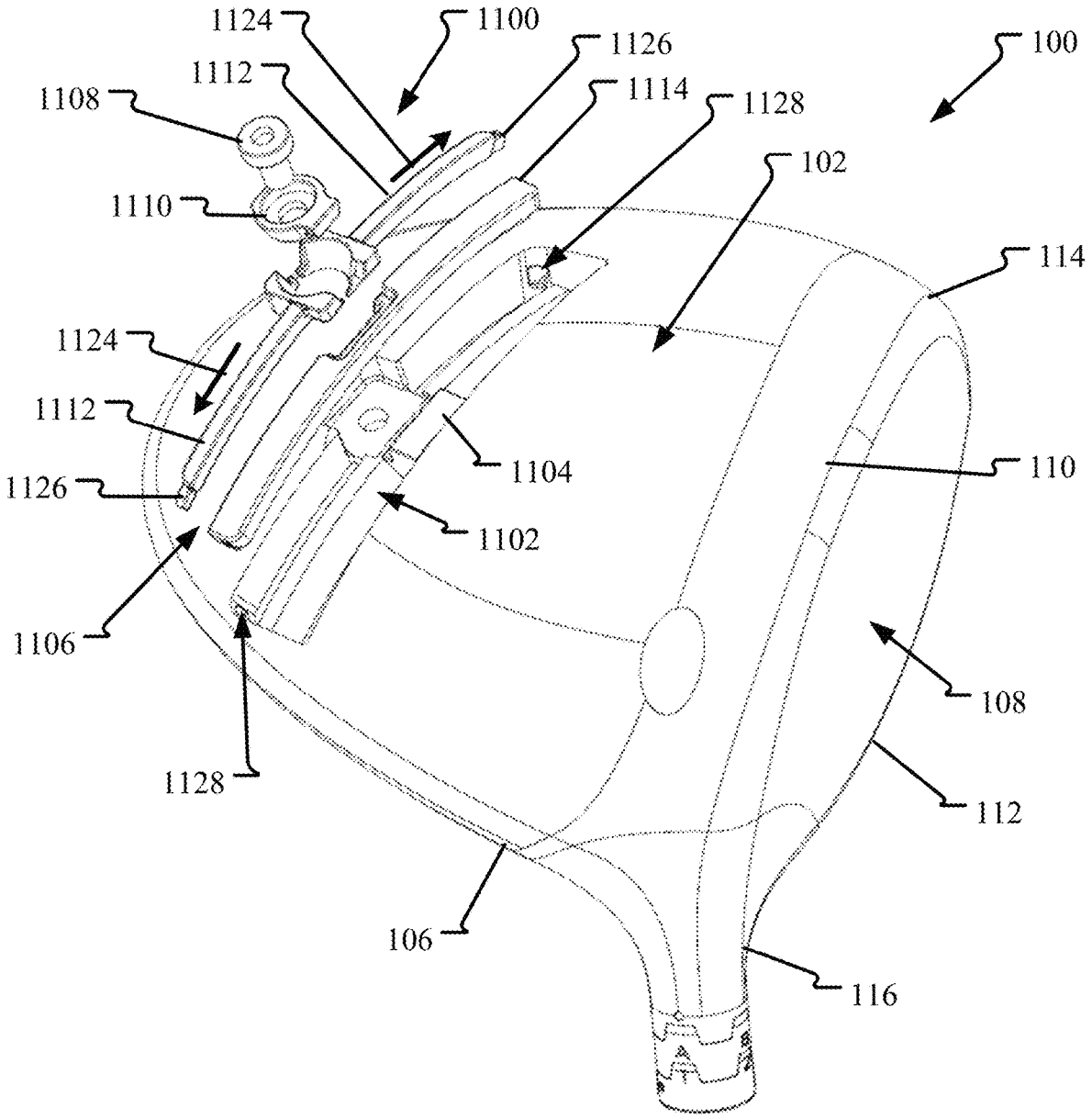
FIG. 28 is an exploded perspective view of the sole of the golf club head with another weight assembly.
Figure 29:
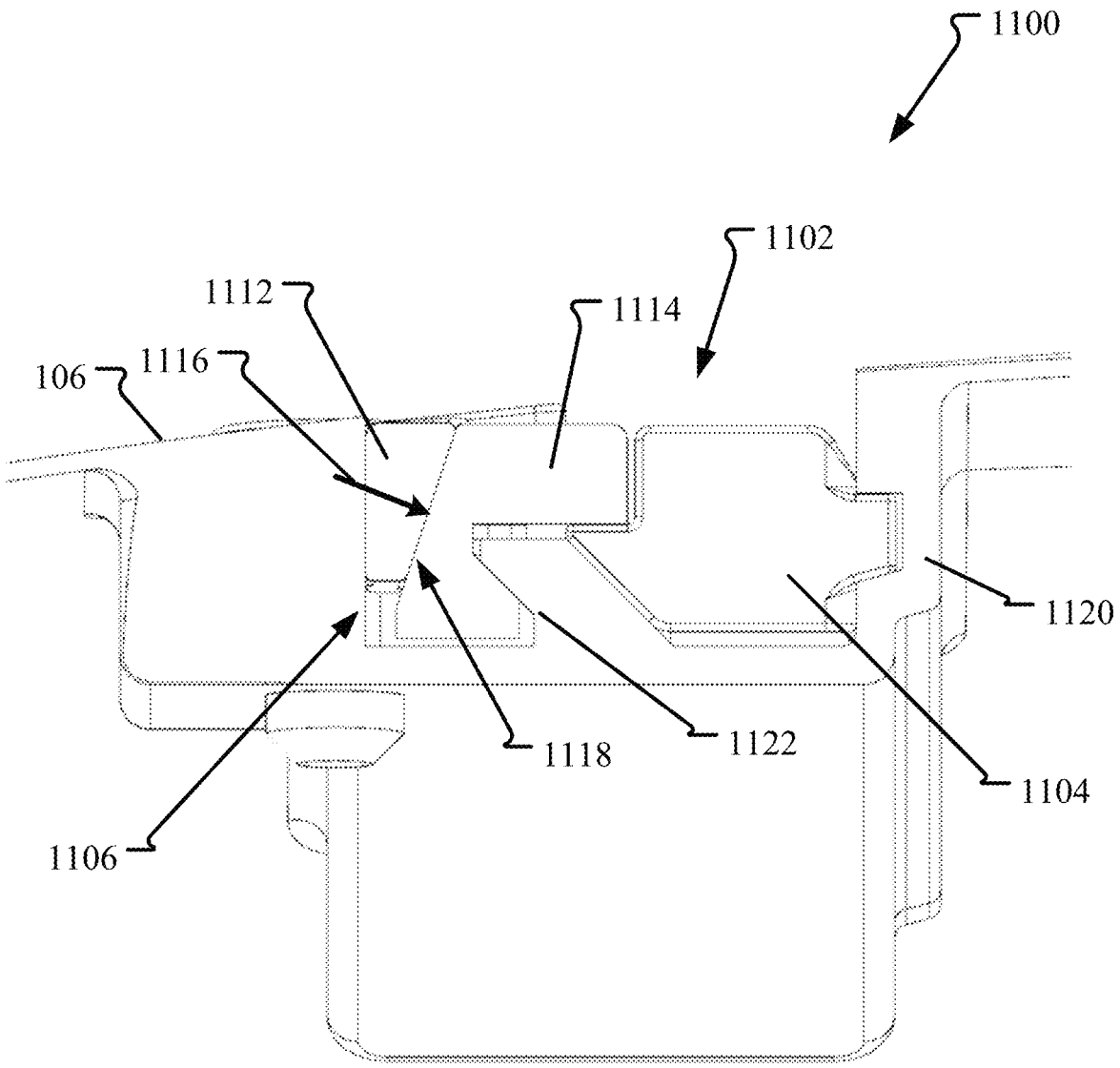
FIG. 29 is a cross-sectional view of the weight assembly shown in FIG. 28.

FIG. 28 is an exploded perspective view of the sole 102 of the golf club head 100 with another weight assembly 1100. FIG. 29 is a cross-sectional view of the weight assembly 1100. Certain components are described above, and thus, are not necessarily described further. Referring concurrently to FIGS. 28 and 29, the weight assembly 1100 includes a substantially linear recessed channel 1102 defined within the sole 102. The weight assembly 1100 also includes a slidable weight 1104, a cover assembly 1106, and a fastener 1108. In this example, the fastener 1108 may be positioned at approximately the midpoint of the channel 1102 and offset towards the rear of the club head 100. As described above, when the cover assembly 1106 is in the locked configuration, the cover assembly 1106 is coupled to the body 106 so that the weight 1104 is be secured within the weight assembly 1100 without movement or rattling. In this example, the cover assembly 1106 is a four piece assembly including a fastener member 1110, two opposing longitudinal members 1112, and a transverse member 1114.

When the cover assembly 1106 is moved towards the locked configuration (e.g., FIG. 29), the fastener 1108 is tightened to the body 106. The fastener 1108 engages with the fastener member 1110 and moves the fastener member 1110 along the fastener axis (not shown) and into the channel 1102. The fastener member 1110 has a tapered surface that engages with both of the longitudinal members 1112 so that as the fastener member 1110 is pulled down within the channel 1102, the longitudinal members 1112 are also pulled down within the channel 1102 and generate a compressive force 1116 along an angled surface 1118. The compressive force 1116 acts in both a downward direction and a transverse direction on the transverse member 1114 to position the transverse member 1114 within the channel 1102 and compress the weight 1104 between the transverse member 1114 and a sidewall 1120 of the channel.

Additionally, to reduce or prevent pull-out of the weight assembly 1100 from the body 106, the transverse member 1114 may engage with an undercut 1122 of the channel 1102. The compressive force 1116 from the longitudinal members 1112 lock the transverse member against the undercut 1122 so as to prevent movement. Additionally or alternatively, a portion of the weight 1104 may engage with the sidewall 1120 of the channel 1102 so as to reduce pull out of the weight assembly 1100 from the body 106. Additionally, the fastener member 1110 also pushes the longitudinal members 1112 away from the fastener 1108 (e.g., arrows 1124) so that ends 1126 of the members 1112 can engage with a corresponding chamber 1128 in the channel 1102 and also reduce pull out of the weight assembly 1100 from the body 106.

Figure 30:
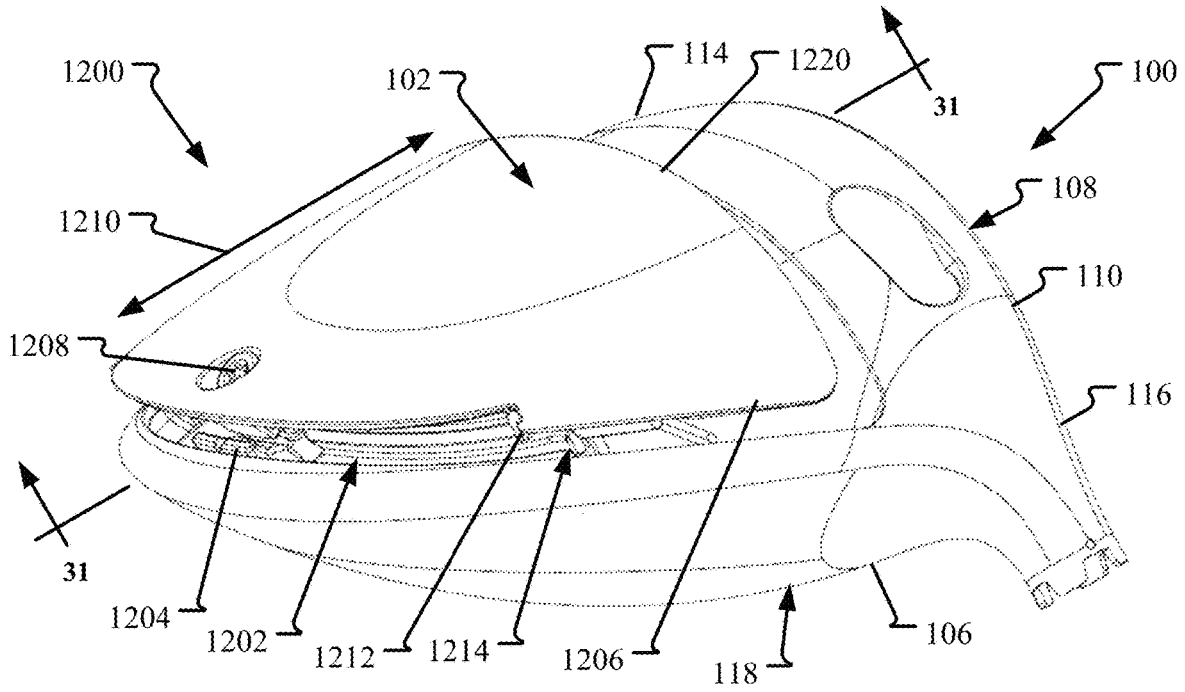
FIG. 30 is a perspective view of the sole of the golf club head with another weight assembly.
Figure 31:
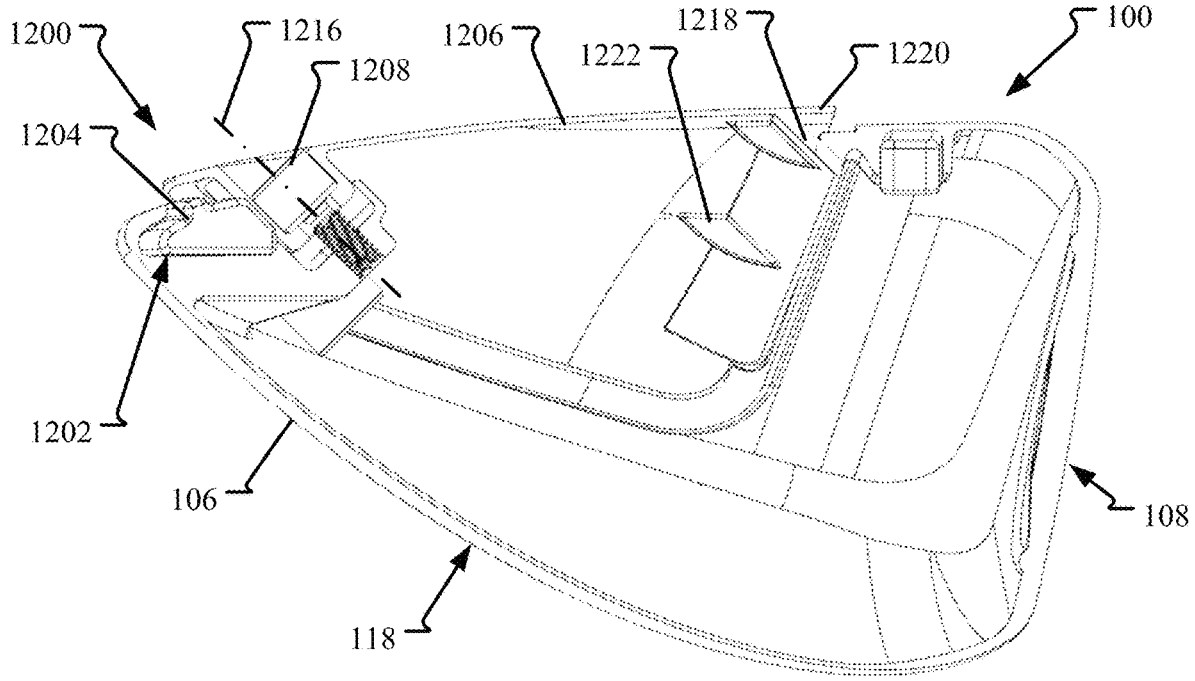
FIG. 31 is a cross-sectional view of the weight assembly taken along line 31-31 in FIG. 30.

FIG. 30 is a perspective view of the sole 102 of the golf club head 100 with another weight assembly 1200. FIG. 31 is a cross-sectional view of the weight assembly 1200 taken along line 31-31 in FIG. 30. Certain components are described above, and thus, are not necessarily described further. Referring concurrently to FIGS. 30 and 31, the weight assembly 1200 is illustrated in an unlocked configuration and includes a recessed channel 1202, a slidable weight 1204, a cover 1206, and a fastener 1208. The structure, size, shape, and orientation of the channel 1202, the weight 1204, and the fastener 1208 may be similar to any of the examples described above. In this example, however, a width 1210 of the cover 1206 is extended towards the striking face 108 so that the cover 1206 forms a greater portion of the sole 102 and does not only cover a portion of the channel 1202.

In some examples, the cover 1206 may form greater than or equal to 75% of the surface area of the sole 102. In other examples, the cover 1206 may form greater than to equal to 50% of the surface area of the sole 102. In still other examples, the cover 1206 may form greater than or equal to 25% of the surface area of the sole 102. In still further examples, the cover 1206 may be between about 10% and 90% of the surface area of the sole 102. In other examples, the cover 1206 may be between about 25% and 75% of the surface area of the sole 102.

By enlarging the cover 1206 of the weight assembly 1200, the golf club head structure that forms the sole 102 of the body 106 can be reduced. In some examples, the cover 1206 can be manufactured from a lighter weight material (e.g., composite materials, plastics, etc.) than the material that the body 106 is manufactured from. As such, the weight saved by the configuration of the sole construction can be used at other locations on the club head 100 as required or desired and further enable adjustment of the CG and MOI of the club head 100 for improving golf ball flight characteristics. In some examples, the weight saved by the sole construction can be included back into the slidable weight 1204. For example, the cover 1206 may reduce the weight of the sole construction by 11 grams or more, some or all of which mass that can then be included at least partially into the weight 1204.

The cover 1206 can include a projection 1212 extending therefrom that is configured to engage with a corresponding chamber 1214 within each end of the channel 1202 for increasing the structural rigidity of the cover 1206 connection as described in the examples above. In one example, the projection 1212 may be substantially cylindrical and parallel to a fastener axis 1216. At the opposite side of the cover 1206 from the fastener 1208, the cover 1206 includes a brace 1218 adjacent to an extended edge 1220 that frictionally engages with the remaining sole 102 of the club head 100 to secure the edge 1220 to the body 106. In some examples, the brace 1218 may extend at an angle that is substantially parallel to the fastener axis 1216 so as to guide the movement of the cover 1206 between the locked and unlocked configurations as described herein. The brace 1218 may include one or more brackets 1222 for increasing the structural rigidity of the brace 1218.

Figure 32:
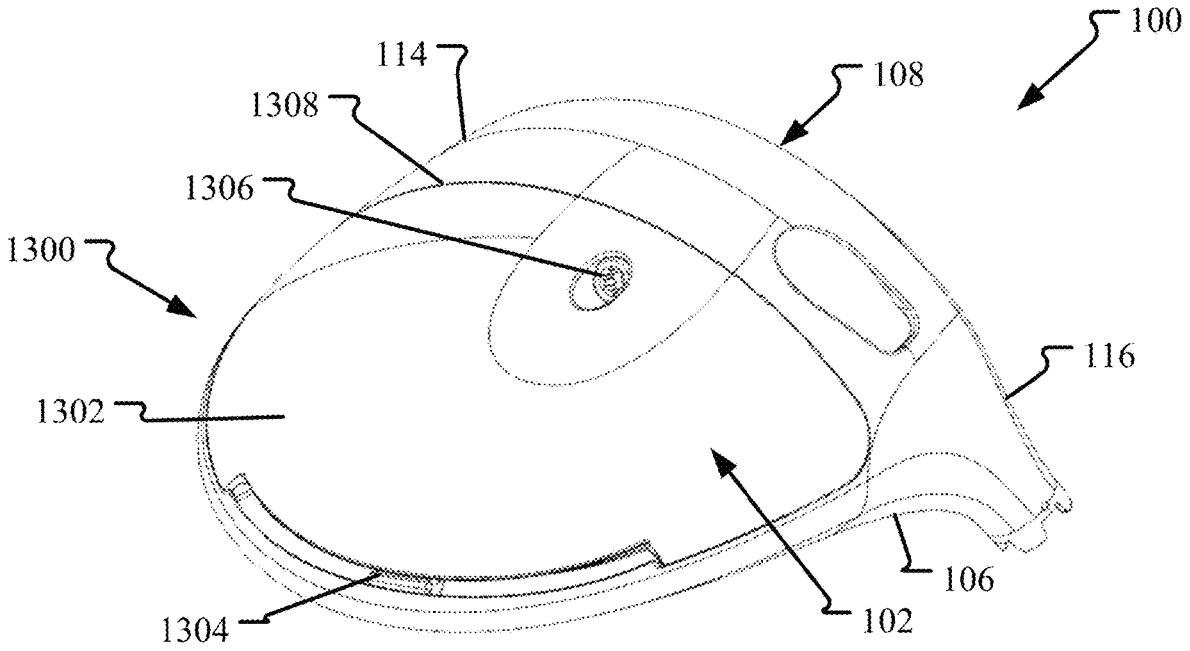
FIG. 32 is a perspective view of the sole of the golf club head with another weight assembly.

FIG. 32 is a perspective view of the sole 102 of the golf club head 100 with another weight assembly 1300. Certain components are described above, and thus, are not necessarily described further. Similar to the example described in FIGS. 30 and 31, the weight assembly 1300 includes an enlarged cover 1302 that selectively secures a slidable weight 1304 to one or more portions of the club head 100. In this example, however, a fastener 1306 is positioned more towards the striking face 108 and adjacent to an extended edge 1308 of the cover 1302. This example increases the securement of the edge 1308 to the body 106 of the golf club head 100. In other examples, the fastener 1306 may be positioned at any other location on the cover 1302 as required or desired. For example, towards the toe side 114, towards the heal side 116, centered on the cover 1302, etc.

Figure 33:
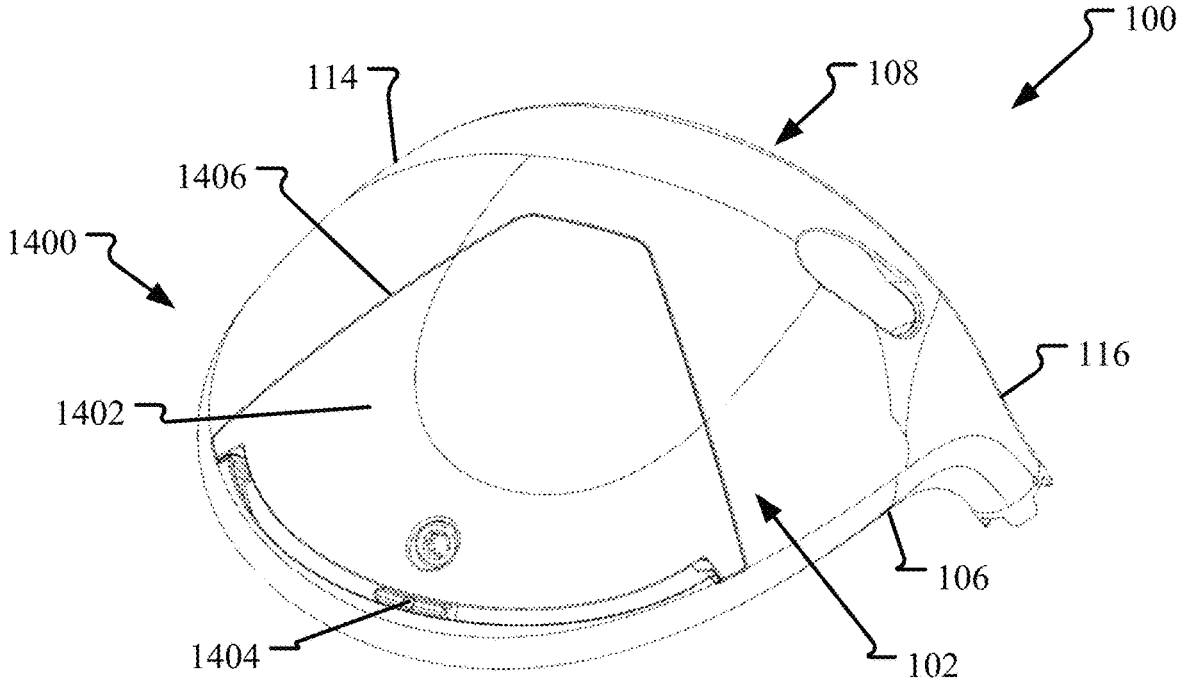
FIG. 33 is a perspective view of the sole of the golf club head with another weight assembly.

FIG. 33 is a perspective view of the sole 102 of the golf club head 100 with another weight assembly 1400. Certain components are described above, and thus, are not necessarily described further. Similar to the example described in FIGS. 30-32, the weight assembly 1400 includes an enlarged cover 1402 that selectively secures a slidable weight 1404 to one or more portions of the club head 100. In this example, however, the cover 1402 has an extended edge 1406 that is substantially V-shaped. Additionally, the cover 1402 is symmetrical in the toe 114—heel 116 direction. In other examples, the cover 1402 may be asymmetrical in the toe 114—heel 116 direction as required or desired.

Figure 34:
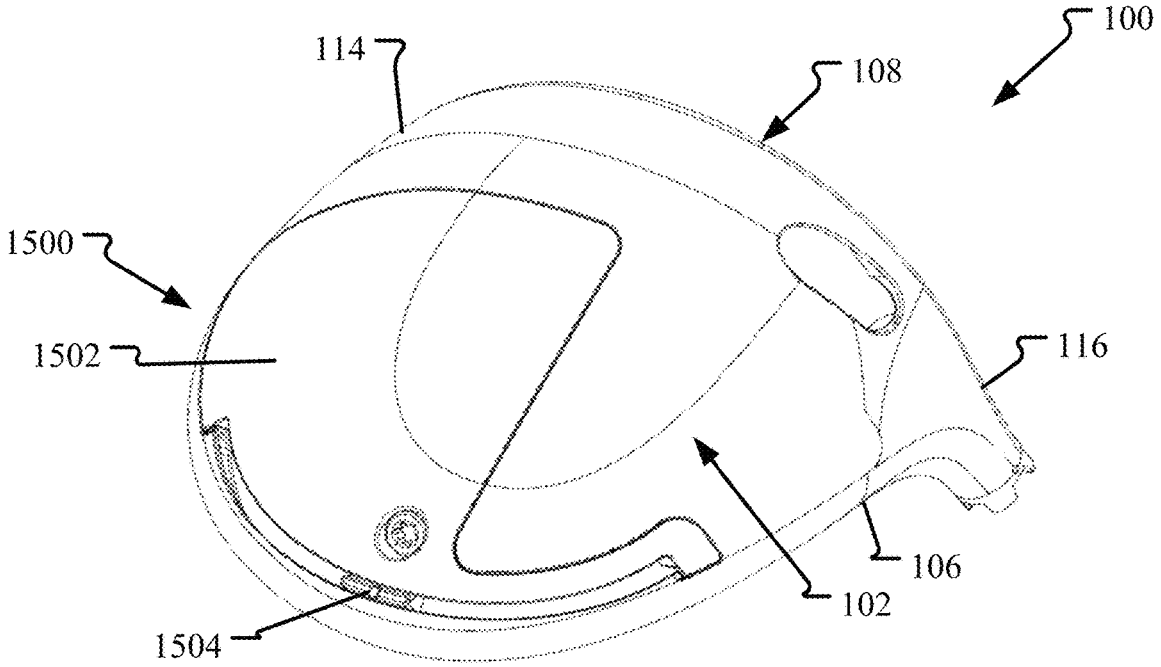
FIG. 34 is a perspective view of the sole of the golf club head with another weight assembly.

FIG. 34 is a perspective view of the sole 102 of the golf club head 100 with another weight assembly 1500. Certain components are described above, and thus, are not necessarily described further. Similar to the example described in FIGS. 30-33, the weight assembly 1500 includes an enlarged cover 1502 that selectively secures a slidable weight 1504 to one or more portions of the club head 100. In this example, however, the cover 1502 is asymmetrical in the toe side 114 direction. In other examples, the cover 1502 may be asymmetrical in the heel side 116 direction as required or desired.

Figure 35:
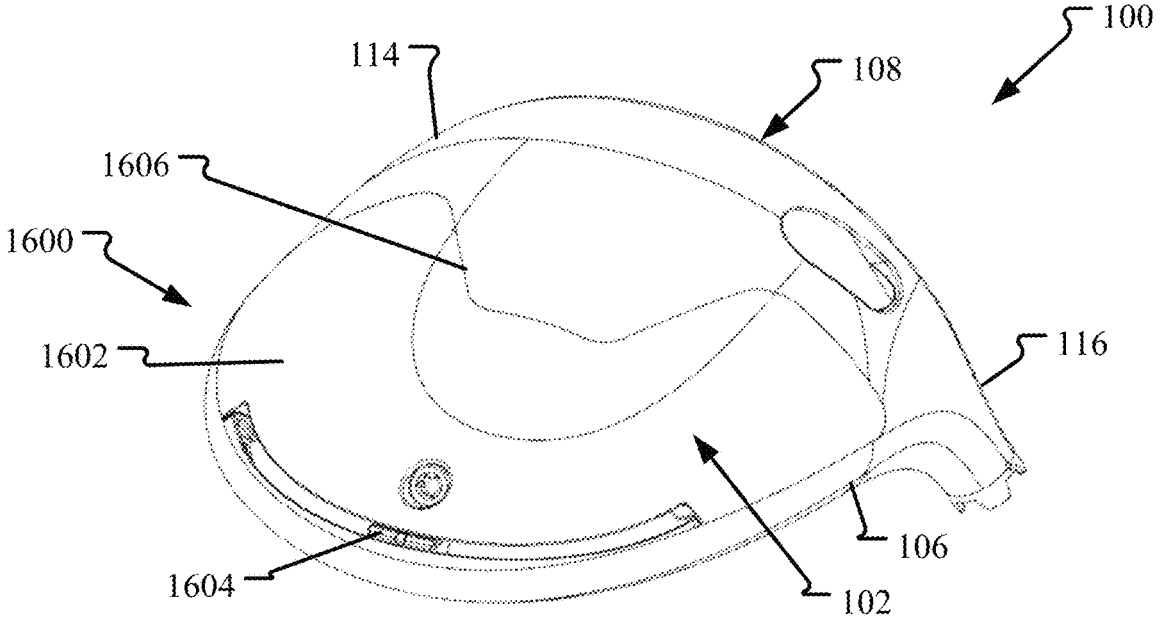
FIG. 35 is a perspective view of the sole of the golf club head with another weight assembly.

FIG. 35 is a perspective view of the sole 102 of the golf club head 100 with another weight assembly 1600. Certain components are described above, and thus are not necessarily described further. Similar to the example described in FIGS. 30-34, the weight assembly 1600 includes an enlarged cover 1602 that selectively secures a slidable weight 1604 to one or more portions of the club head 100. In this example, however, the cover 1602 has an extended edge 1606 that is substantially C-shaped. Additionally, the cover 1602 is symmetrical in the toe 114—heel 116 direction. In other examples, the cover 1602 may be asymmetrical in the toe 114—heel 116 direction as required or desired.

Figure 36:
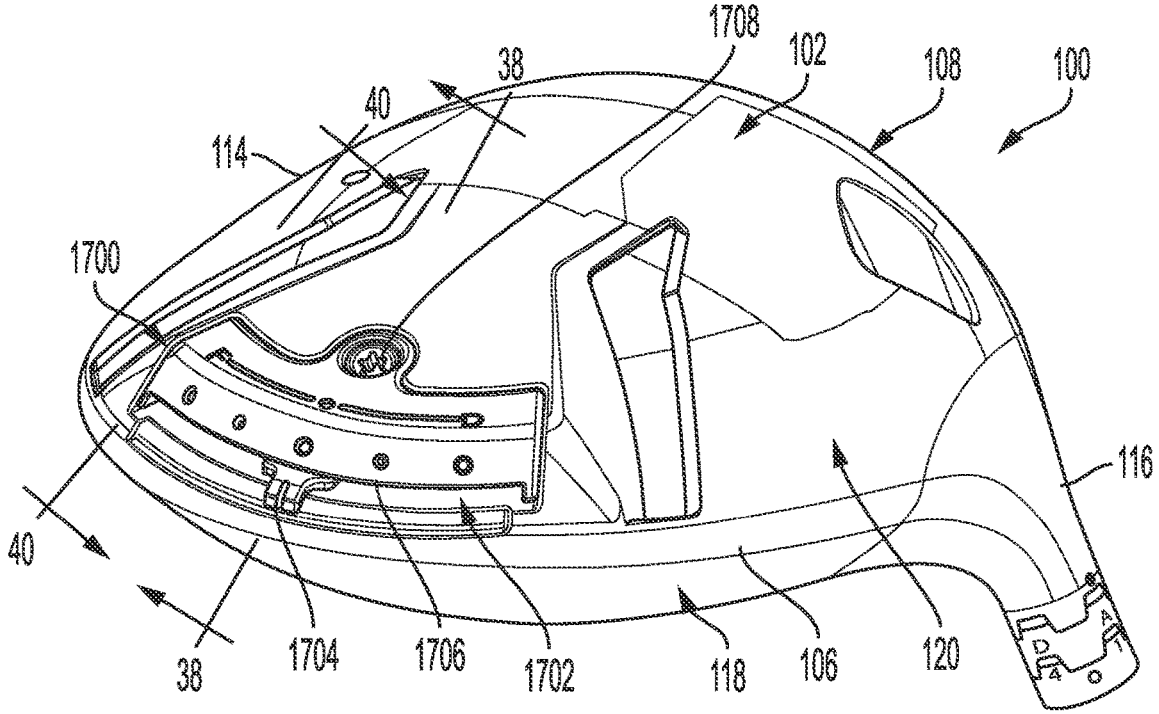
FIG. 36 is a perspective view of the sole of the golf club head with another weight assembly.
Figure 37:
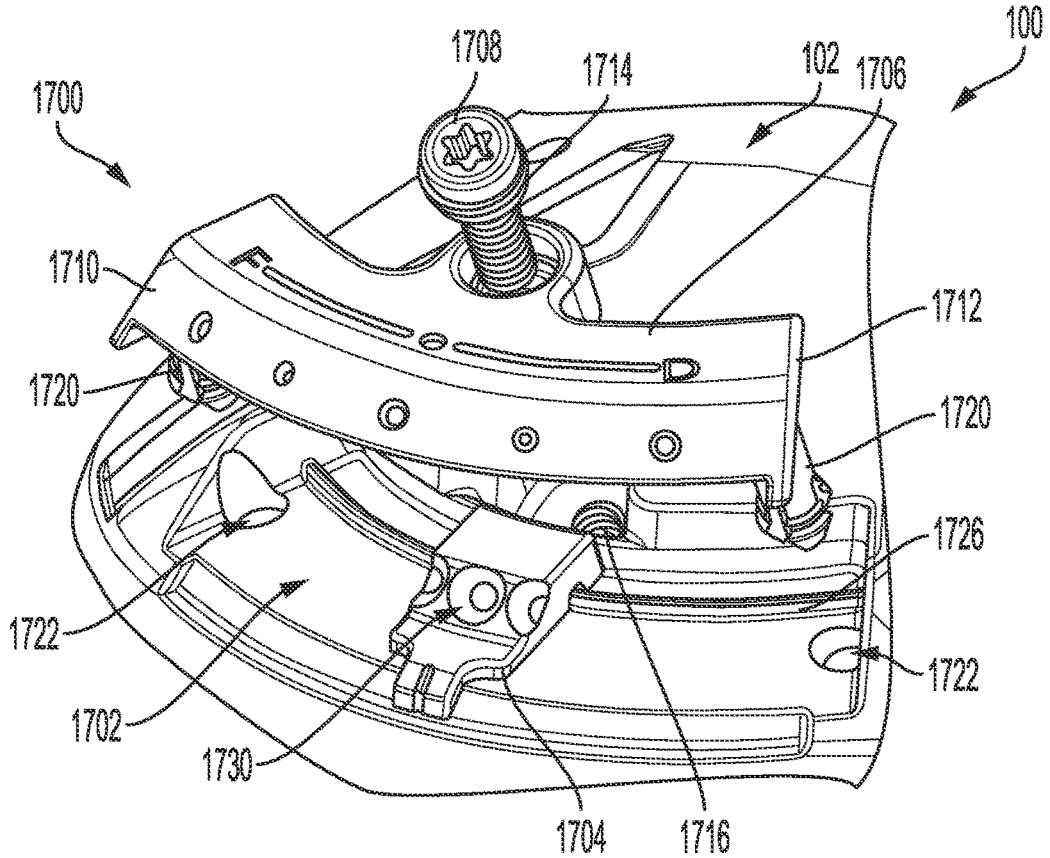
FIG. 37 is an exploded perspective view of the weight assembly shown in FIG. 36.

FIG. 36 is a perspective view of the sole 102 of the golf club head 100 with another weight assembly 1700. FIG. 37 is an exploded perspective view of the weight assembly 1700. Certain components are described above, and thus, are not necessarily described further. Referring concurrently to FIGS. 36 and 37, a recessed channel 1702 is defined within the sole 102 of the body 106 of the club head 100. The channel 1702 has a substantially curved shape in the toe 114—heel 116 direction so that the CG and the MOI of the club head 100 can be adjusted for fade-draw bias (e.g., the "F" and "D" indicia on a cover 1706 of the weight assembly 1700). In the example, the curve of the channel 1702 substantially corresponds to the rear outer perimeter of the body 106, where the sole 102 and the crown 118 are coupled together, and opposite of the striking face 108. The weight assembly 1700 includes a slidable weight 1704, a cover 1706, and a fastener 1708.

In this example, the cover 1706 is substantially U-shaped with a toe end 1710 and an opposite heel end 1712. The fastener 1708 is coupled to the cover 1706 by a lock washer 1714 (e.g., a retainer clip) and it is positioned on the inner concave side of the cover 1706 at approximately a midpoint between the ends 1710, 1712. The fastener 1708 is a threaded bolt that threadingly engages with a nut 1716 formed within the sole 102 of the body 106. The lock washer 1714 enables the cover 1706 to linearly move M (e.g., raise and lower) along a fastener axis 1718 (shown in FIG. 38) with respect to the recessed channel 1702 upon rotation of the fastener 1708. The fastener 1708 is offset from the recessed channel 1702 towards the front and the striking face 108 of the body 106. By offsetting the fastener 1708 from the recessed channel 1702, the length of the recessed channel 1702 can be extended in the toe-heel direction so that the weight 1704 can be positioned at a greater number of locations on the sole 102. Additionally, by positioning the fastener adjacent the inner concave side of the cover 1706, the weight 1704 is disposed closer to the outer perimeter of the body 106 so that the weight 1704 increases the adjustability of the CG and MOI of the club head 100.

Each end 1710, 1712 of the cover 1706 includes a projection 1720 extending therefrom. The projections 1720 are sized and shaped to be received within a corresponding chamber 1722 defined at the ends of the recessed channel 1702 and within the sole 102 of the body 106. The projection 1720 may be substantially cylindrical in shape and increases the engagement of the cover 1706 with the body 106 so that the weight 1704 is restricted from moving or rattling when secured within the recessed channel 1702 by the cover 1706. A projection axis 1724 of the projection 1720 (shown in FIG. 38) is substantially parallel to the fastener axis 1718 so as to facilitate guiding the movement of the cover 1706 relative to the recessed channel 1702.

In operation, the weight assembly 1700 is selectively moveable between at least three configurations to enable the CG and the MOI of the club head 100 to be adjustable. More specifically, in a first or locked configuration, the cover 1706 is at least partially disposed within the recessed channel 1702 so that the weight 1704 is secured within the channel 1702 and movement is restricted. This locked configuration is illustrated in FIG. 36. When the weight assembly 1700 is in the locked configuration, the projection 1720 is received at least partially within the chamber 1722 and engaged therewith. By engaging the cover 1706 to the body 106 at its ends 1710, 1712, when the weight 1704 is positioned away from the fastener 1708, the cover 1706 still enables securement of the weight 1704 within the channel 1702 and reduces or prevents movement of the weight 1704 in the locked configuration. The locked configuration is used when swinging the golf club head 100.

Figure 40:
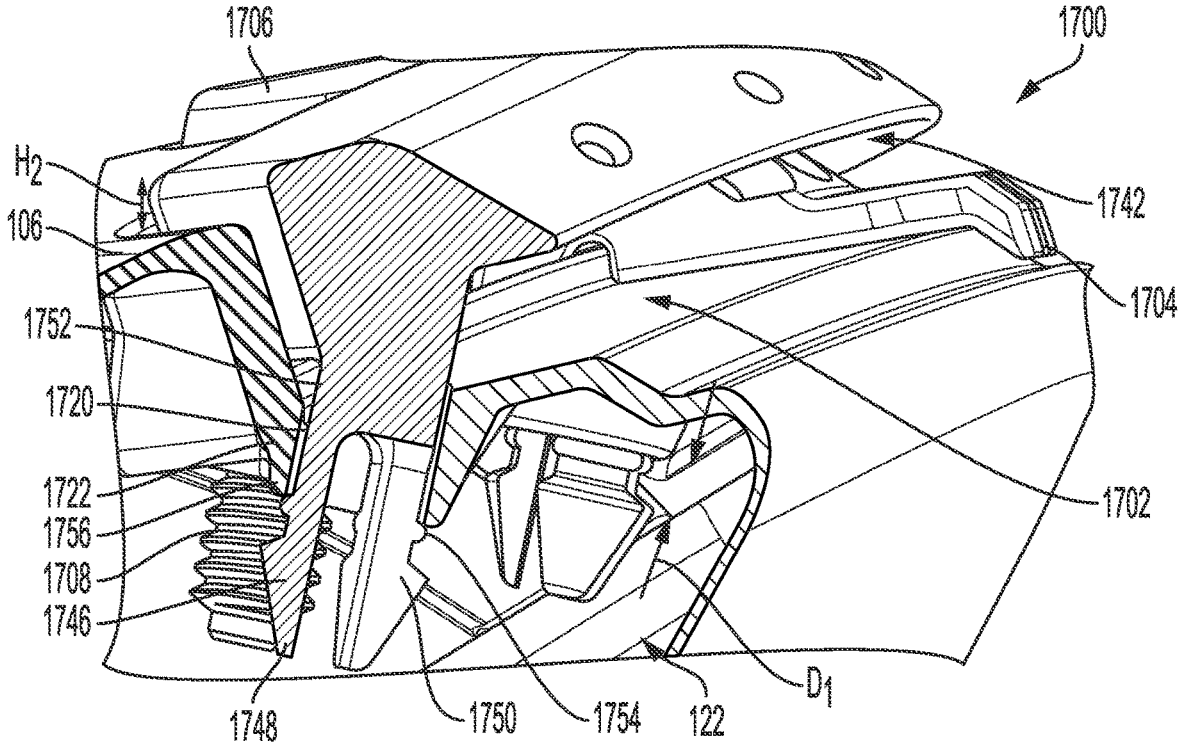
FIG. 40 is a cross-sectional view of the weight assembly taken along line 40-40 in FIG. 36 and in a weight sliding configuration.
Figure 41:
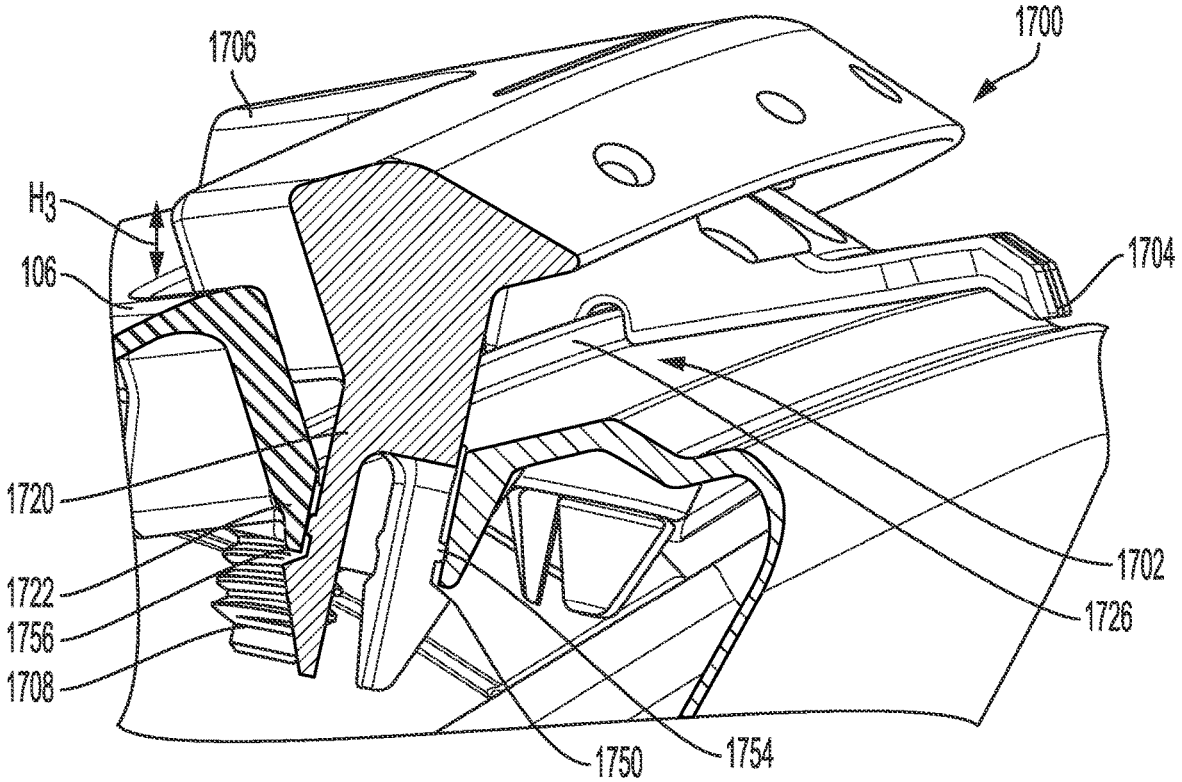
FIG. 41 is a cross-sectional view of the weight assembly taken along line 40-40 in FIG. 36 and in a weight removal configuration.

Additionally, the weight assembly 1700 can be positionable into at least two other configurations that enable the weight 1704 to be selectively slidable with the recessed channel 1702 and that enable the weight 1704 to be completely removable from the weight assembly 1700 and the club head 100. In a second or weight moving configuration, the cover 1706 is partially raised out of the recessed channel 1702 so that the position of the weight 1704 can be adjusted. However, the weight 1704 is still retained within the weight assembly 1700 and cannot be completely removed from the club head 100. This configuration is illustrated in FIG. 40 and described further below. In a third or weight removal configuration, the cover 1706 is positioned so that the weight 1704 can be completely removed, for example, so that a different weight (e.g., having a different mass) can be used with the club head 100 so as to adjust the swing weight. This configuration is illustrated in FIG. 41 and described further below. In each of the three configurations, however, the cover 1706 remains coupled to the body 106 so that the cover 1706 does not have to be completely removed. In some examples, however, the weight assembly 1700 may include a fourth configuration (not illustrated), whereby the cover 1706 is completely removable from the body 106 as required or desired.

A partial wall 1726 is disposed within the recessed channel 1702. The weight 1704 has a corresponding recess 1728 (shown in FIG. 38) so that the weight 1704 can slide along the partial wall 1726. The partial wall 1726 at least partially prevents the weight 1704 from being completely removed when the weight assembly 1700 is in the weight moving configuration. In some examples, the weight 1704 may include at least one locating feature 1730 (FIG. 37). The feature 1730 is sized and shaped to engage with one or more of a plurality of locating lugs 1732 (shown in FIG. 39) that extend from the cover 1706 when the weight assembly 1700 is in the locked configuration. The locating lugs 1732 and feature 1730 facilitate locating the weight 1704 at specific locations within the recessed channel 1702. In the example, the locating lugs 1732 are substantially frustoconical in shape and the locating features 1730 have a corresponding recessed shape. In other examples, the lugs 1732 and features 1730 can have any other shape and/or size that enable the cover 1706 and the weight 1704 to function as described herein.

Figure 38:
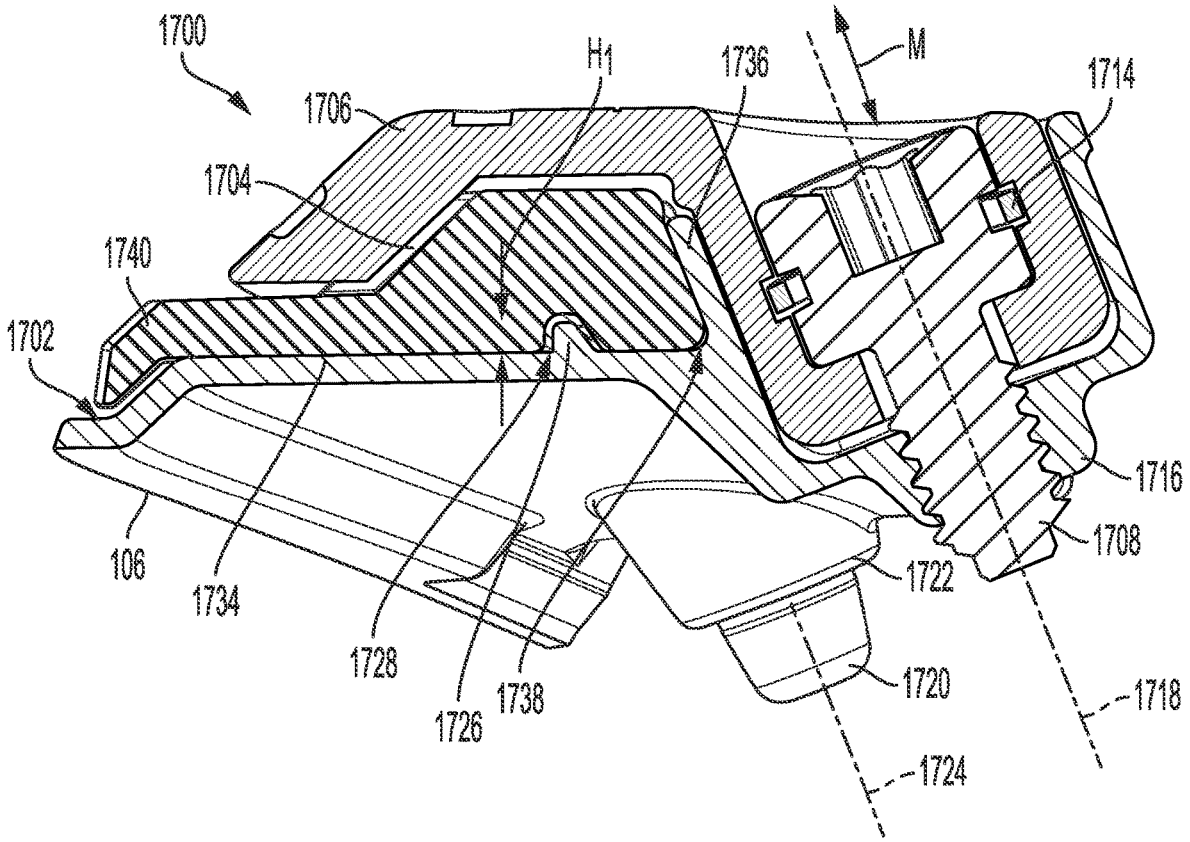
FIG. 38 is a cross-sectional view of the weight assembly taken along line 38-38 in FIG. 36.

FIG. 38 is a cross-sectional view of the weight assembly 1700 taken along line 38-38 in FIG. 36. Certain components are described above, and thus, are not necessarily described further. As described above, the weight 1704 is secured within the recessed channel 1702 by the cover 1706. The fastener 1708 positions and secures the cover 1706 to the body 106 of the golf club head, and thus, the fastener 1708 only retains the weight 1704 indirectly. In some examples, a washer (not shown) may be positioned on the fastener 1708 and between the body 106 and the cover 1706. The recessed channel 1702 is formed in cross-section by a bottom track wall 1734 and a side wall 1736 arranged in a substantially L-shape configuration with a corner 1738. In the example, the corner 1738 has an angle that is equal to or less than 90°. In another aspect, the corner 1738 has an angle that less than 90° so that the side wall 1736 is undercut. As such, when the weight assembly 1700 is in the locked configuration, the cover 1706 wedges the weight 1704 into the corner 1738 and against the side wall 1736 to frictionally secure the weight 1704 within the recessed channel 1702 and at least partially underneath the side wall 1736.

Adjacent to the corner 1738 and on the bottom track wall 1734, the partial wall 1726 extends in an upward direction and has a height $H_1$. The weight 1704 has a corresponding recess 1728 that receives at least a portion of the partial wall 1726. The partial wall 1726 at least partially contains the weight 1704 within the weight assembly 1700 when in the locked and weight sliding configurations. The weight 1704 also includes a tail 1740 that projects from the recessed channel 1702 and out from underneath the cover 1706. The tail 1740 of the weight 1704 provides structure for a user to grasp and slide the weight 1704 as required or desired. The tail 1740 is also visible on the outer surface of the club head so that its position is easily determined by visual inspection. In this example, the tail 1740 is at least partially corresponds to the shape of the bottom track wall 1734 of the recessed channel 1702. In other examples, the tail 1740 can have any other size and/or shape as required or desired.

Figure 39:
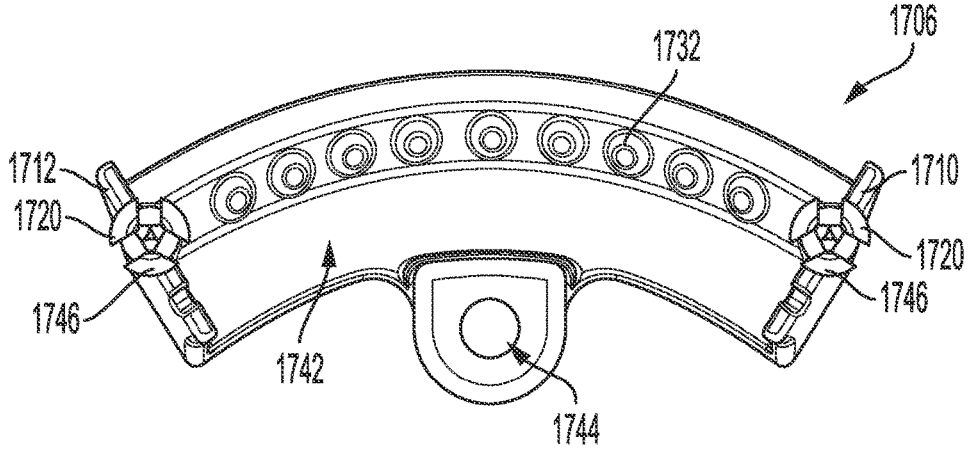
FIG. 39 is an inside surface view of a cover of the weight assembly shown in FIG. 36.

FIG. 39 is an inside surface 1742 view of the cover 1706 of the weight assembly 1700 (shown in FIGS. 36-38). The cover 1706 is substantially U-shaped with a concave side that receives the fastener at an aperture 1744. Proximate the convex side, the inside surface 1742 has the plurality of locating lugs 1732 that are configured to engage with the locating feature 1730 within the weight 1704 (shown in FIG. 37). When engaged (e.g., in the first, locked configuration), the cover 1706 wedges the weight in the corner of the recessed channel and against the side wall. However, when the cover 1706 raised out of the recessed channel, the locating lugs 1732 disengage from the weight so that the weight can be moved (e.g., in the weight sliding configuration) or so that the weight can be completely removed (e.g., in the weight removal configuration).

Each end 1710, 1712 of the cover 1706 includes the projection 1720 that, in addition to the fastener, secures the cover 1706 to the body of the club head. In the example, the projection 1720 engages with the chamber 1722 (shown in FIG. 37) in all three configurations (e.g., locked, weight moving, and weight removal) of the weight assembly. Furthermore, the projection 1720 also at least partially defines each of the three configurations. The projection 1720 is substantially cylindrical in shape and is configured to extend through the sole of the body and into the interior cavity of the club head via the chamber 1722. In the example, the projection 1720 includes a plurality of flexible arms 1746 circumferentially spaced to form the substantially cylindrical projection 1720. As illustrated, the projection 1720 includes three discrete flexible arms 1746. In other examples, the projection 1720 may include any other number of flexible arms 1746 (e.g., 2, 4, 5, etc.) as required or desired.

FIG. 40 is a cross-sectional view of the weight assembly 1700 taken along line 40-40 in FIG. 36 and in a weight sliding configuration. The projection 1720 has a distal end 1748 (relative to the inside surface 1742 of the cover 1706) that is formed as a tapered nose so that the cover 1706 can be press fit into the body 106 of the golf club head and extend all the way into the interior cavity 122 and through the chamber 1722. For example, the flexible arms 1746 can radially deflect so as to extend through the chamber 1722 and snap into place. This connection allows the cover 1706 to be secured to the body 106 and completely removed as required or desired. The cover 1706, however, does not need to be removed to adjust the weight 1704. The distal end 1748 includes at least one stop 1750 that extends radially outward on the projection 1720. In the example, the stop 1750 is formed as part of the tapered nose. The projection 1720 also has a proximal end 1752 (relative to the inside surface 1742 of the cover 1706) that is formed as a substantially cylindrical post. The proximal end 1752 frictionally engages with the chamber 1722 when the cover 1706 is in the locked configuration. This engagement facilitates the cover 1706 securing the weight 1704 within the recessed channel 1702 (in addition to the fastener). Additionally, at least one rib 1754 extends radially on the projection 1720. The rib 1754 is positioned between the distal end 1748 and the proximal end 1752, and offset a distance $D_1$ from the stop 1750.

To move the weight assembly 1700 from the locked configuration (shown in FIG. 36), when the cover 1706 secures the weight 1704 within the recessed channel 1702, to the weight moving configuration (shown in FIG. 40) that enables the weight 1704 to slide within the recessed channel 1702, the threaded fastener 1708 is rotated so that the cover 1706 raises out of the recessed channel 1702. When the rib 1754 engages with an end wall 1756 of the chamber 1722, further movement of the cover 1706 is restricted and the cover 1706 is raised to a height $H_2$ relative to the body 106 of the club head. As such, the cover 1706 indicates that the weight assembly 1700 is in the weight moving configuration. To move the weight assembly 1700 past the weight moving configuration to the weight removal position, additional force can be induced into the weight assembly 1700 (e.g., via rotation of the fastener 1708) to overcome the engagement between the rib 1754 and the chamber 1722 until the flexible arm 1746 flexes and the cover 1706 can further raise out of the recessed channel 1702.

FIG. 41 is a cross-sectional view of the weight assembly 1700 taken along line 40-40 in FIG. 36 and in a weight removal configuration. Once the engagement of the rib 1754 and the end wall 1756 is forcefully overcome (e.g., via rotation of the fastener 1708 driving movement of the cover 1706), the weight assembly 1700 can move from the weight moving configuration (shown in FIG. 40) to the weight removal configuration. In the weight removal configuration, the weight 1704 can be completely removed from the recessed channel 1702 because the cover 1706 is raised even further out of the recessed channel 1702. When the stop 1750 engages with the end wall 1756 of the chamber 1722, further movement of the cover 1706 is restricted and the cover 1706 is raised to a height $H_3$. The height $H_3$ is greater than the height $H_2$ of the prior weight sliding configuration (shown in FIG. 40). As such, the cover 1706 indicates that the weight assembly 1700 is in the weight removal configuration and the weight 1704 can be completely removed. In some examples, the weight assembly 1700 can be moved past the weight removal configuration and allow the cover 1706 to be completely removed. If this is the case, additional force is induced into the weight assembly 1700 to overcome the engagement between the stop 1750 and the chamber 1722 until the flexible arm 1746 flexes and the cover 1706 can be completely removed. In the example, the stop 1750 is radially larger than the rib 1754, so that the force required to completely remove the cover 1706 is greater than the force required to move between the weight moving configuration and the weight removal configuration.

Because the rib 1754 at least partially defines the weight moving configuration and the stop 1750 at least partially defines the weight removal configuration, the distance $D_1$ (shown in FIG. 40) between the rib 1754 and the stop 1750 defines the height that the cover 1706 rises between the two different configurations $H_2$ and $H_3$. In an aspect, the distance $D_1$ may be about five millimeters. Additionally, in an example, the distance $D_1$ may be at least equal to the height $H_1$ of the partial wall 1726 (shown in FIGS. 37 and 38), so that in the weight removal configuration, the weight 1704 can be lifted off of the partial wall 1726 and removed from the weight assembly 1700. In other examples, either the rib 1754 or the stop 1750 may be completely removed from the cover 1706 so that the cover 1706 moves between only two configurations as required or desired.

Figure 42:
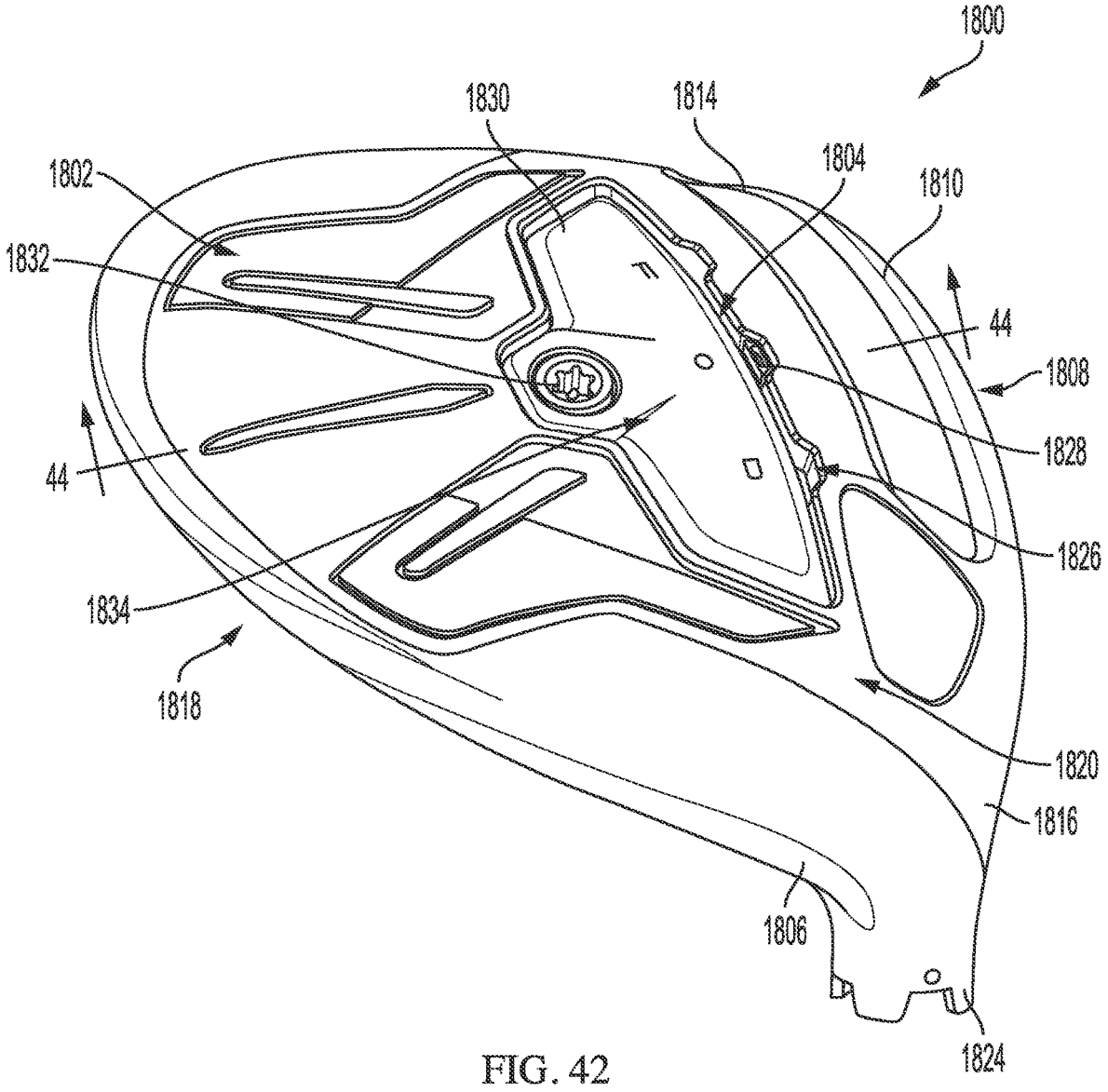
FIG. 42 is a perspective view of a sole of another golf club head with another weight assembly in a locked configuration.

FIG. 42 is a perspective view of a sole 1802 of another golf club head 1800 with another weight assembly 1804 in a locked configuration. The golf club head 1800 is a fairway-metal type golf club head having a body 1806 that includes a striking face 1808 with a lower edge 1810 and an upper edge 1812 (shown in FIG. 43), each extending between a toe 1814 and a heel 1816. The sole 1802 extends from the lower edge 1810 on the bottom side of the club head 1800 and a crown 1818 extends from the upper edge 1812 on the top of the club head 1800. The sole 1802, the striking face 1808, and the crown 1818 are coupled together so as to define an outer surface 1820 of the body 1806 with an interior cavity 1822 (shown in FIG. 44) formed within. A hosel 1824 is disposed at the heel 1816 and is configured to couple to a shaft (not shown). The functions of the components (e.g., sole, striking face, crown, hosel, etc.) of the fairway-metal type club head 1800 are similar to the component functions described above in the metalwood-type golf club head examples of FIGS. 1-41. However, fairway-metal type golf club heads 1800 may strike golf balls directly off the ground surface, thereby requiring or desiring a substantially smooth outer surface 1820 of the sole 1802 without any protruding portions. As illustrated in FIG. 42, the club head 1800 is a fairway-metal type club head, however, the body 1806 may form any type club head, such as an iron-type club head, hybrid-type club head, or metalwood-type club head (e.g., examples illustrated in FIGS. 1-41), as required or desired. Furthermore, the features of the weight assembly 1804 described below can additionally or alternatively be utilized in any type club head described herein as required or desired.

In this example, a recessed channel 1826 is defined within the sole 1802 of the body 1806 of the club head 1800. The channel 1826 extends in the toe 1814—heel 1816 direction so that the CG and the MOI of the club head 1800 can be adjusted for fade-draw bias (e.g., the "F" and "D" indicia on a cover 1830 of the weight assembly 1804). The weight assembly 1804 includes a slidable weight 1828 disposed at least partially within the channel 1826, a cover 1830 that extends at least partially over the channel 1826, and a fastener 1832 configured to couple the cover 1830 to the body 1806. The fastener 1832 retains the weight 1828 in the recessed channel 1826 indirectly via the cover 1830 so that the weight 1828 can be used to adjust the CG and the MOI of the club head 1800. In this example, the weight assembly 1804 and the recessed channel 1826 are located at a frontal section of the golf club head 1800. By "frontal section," it is meant that the weight 1828 is closer to the striking face 1808 than the rearmost outer perimeter of the body 1806, where the sole 1802 and the crown 1818 are coupled together farthest from the striking face 1808.

As illustrated in FIG. 42, the weight assembly 1804 is in a locked configuration with the cover 1830 at least partially disposed within the recessed channel 1826, and the weight 1828 secured within the channel 1826 and movement is restricted. When the cover 1830 and weight assembly 1804 are in the locked configuration, the weight 1828 is completely disposed within the channel 1826 and no portion of the weight 1828 extends above the outer surface 1820 of the body 1806. Additionally, the cover 1830 has an exterior surface 1834 that when the cover 1830 and weight assembly 1804 are in the locked configuration, the exterior surface 1834 of the cover 1830 aligns with the outer surface 1820 of the body 1806 and no portion of the cover 1830 extends above the outer surface 1820 of the body 1806. Because the weight assembly 1804 is completely disposed within the recessed channel 1826 and at least aligned with, or below, the outer surface 1820 of the body 1806, the smoothness of the outer surface 1820 of the club head 1800 is maintained so as to promote good ground interaction.

Figure 43:
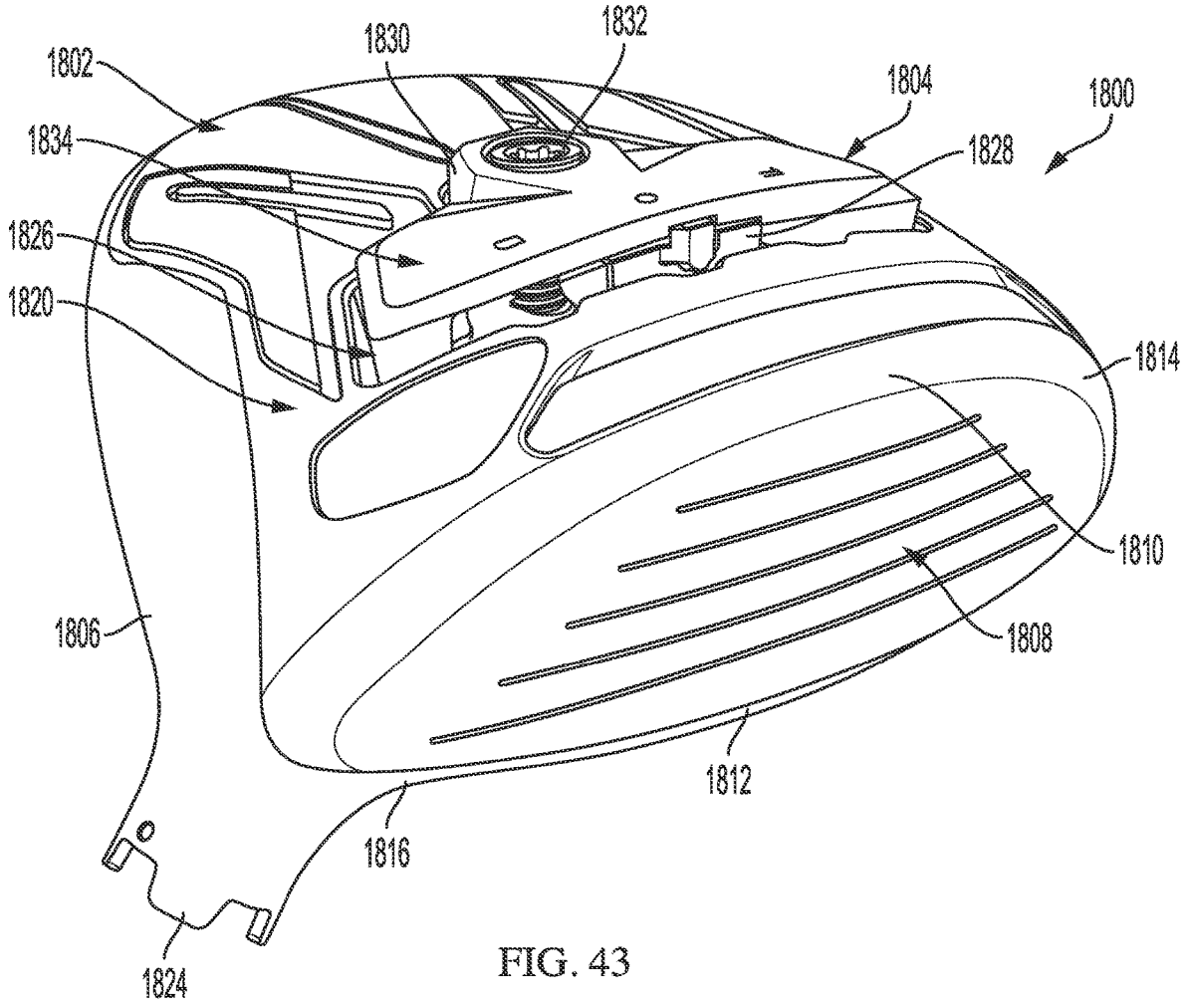
FIG. 43 is a perspective view of the sole of the golf club head with the weight assembly shown in FIG. 42 in an unlocked configuration.

FIG. 43 is a perspective view of the sole 1802 of the golf club head 1800 with the weight assembly 1804 in an unlocked configuration. Certain components are described above, and thus, are not necessarily described further. Via rotation of the fastener 1832, the cover 1830 can be raised at least partially out of the recessed channel 1826 and into the unlocked configuration. In the unlocked configuration, the weight 1828 is selectively slidable within the channel 1826 so as to adjust the CG and the MOI as required or desired. In this example, the weight 1828 is engaged with the cover 1830 so that the weight 1828 moves with the cover 1830 between the unlocked configuration and the locked configuration and raises at least partially out of the recessed channel 1826 when in the unlocked configuration. It should be appreciated, that while FIGS. 42 and 43 illustrate and describe the weight assembly 1804 in two different configurations, a locked configuration and an unlocked configuration, the weight assembly 1804 could be moveable between more than two configurations as required or desired. For example, the weight assembly 1804 can move between at least three configurations, a locked configuration, a weight moving configuration, and a weight removal configuration, as described above in reference to FIGS. 36-41.

Figure 44:
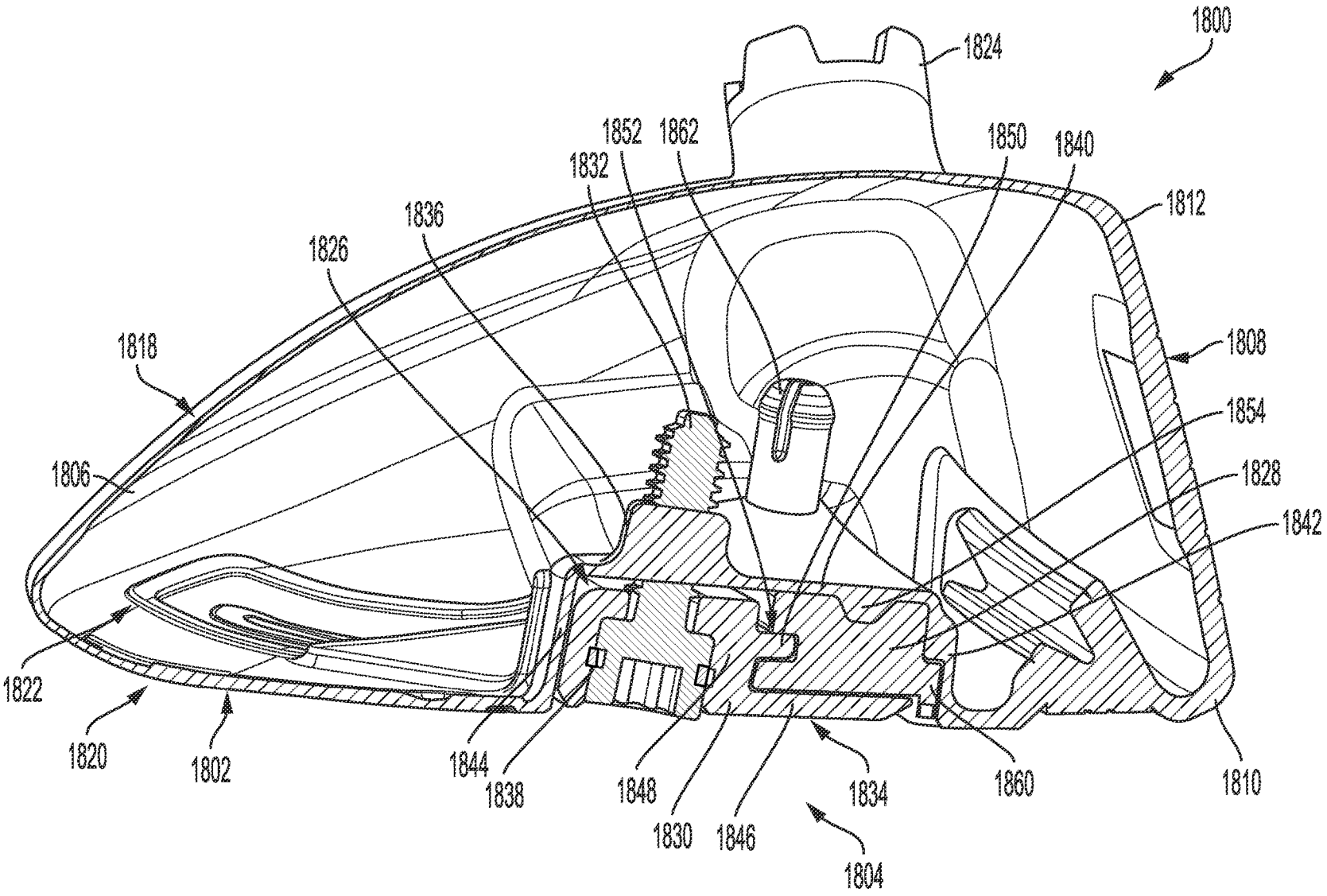
FIG. 44 is a cross-sectional view of the golf club head with the weight assembly taken along line 44-44 in FIG. 42.
Figure 45:
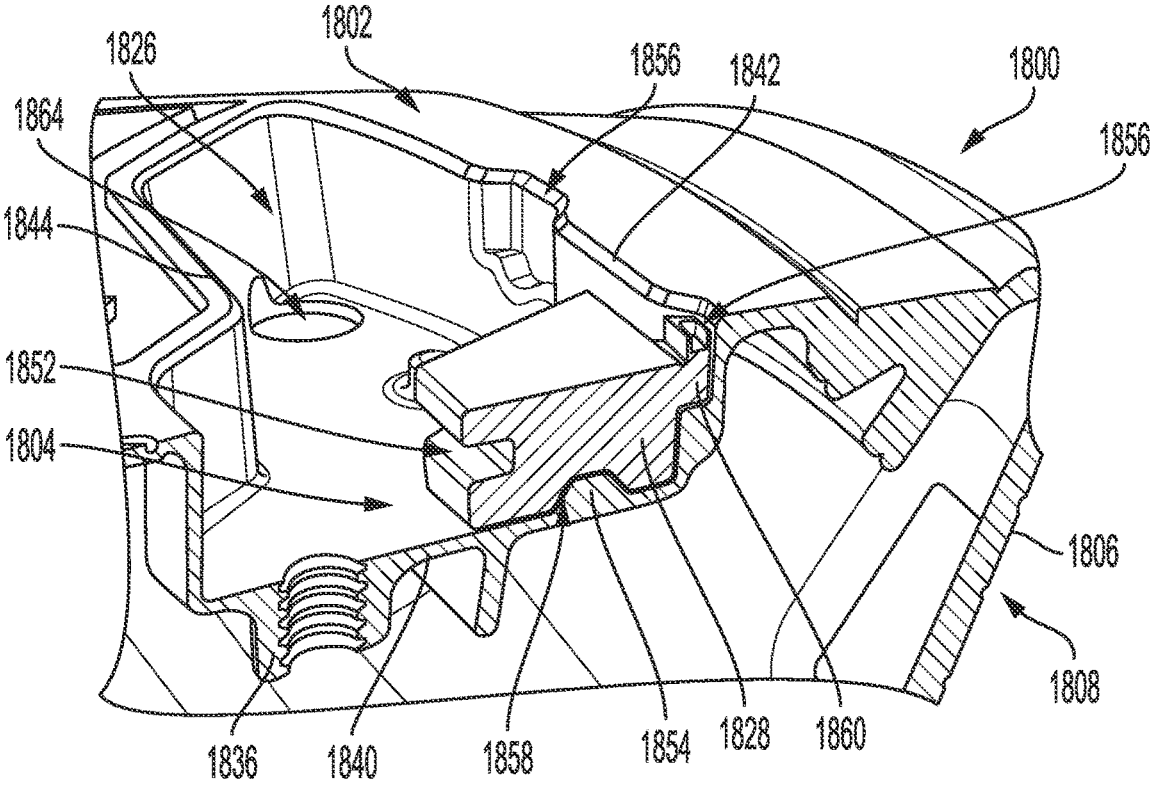
FIG. 45 is a partial perspective cross-sectional view of the weight assembly taken along line 44-44 in FIG. 42.

FIG. 44 is a cross-sectional view of the golf club head 1800 with the weight assembly 1804 taken along line 44-44 in FIG. 42. FIG. 45 is a partial perspective cross-sectional view of the weight assembly 1804 taken along line 44-44 in FIG. 42. Referring concurrently to FIGS. 44 and 45, certain components are described above, and thus, are not necessarily described further. The fastener 1832 is a threaded bolt that threadingly engages with a nut 1836 formed within the sole 1802 of the body 1806. The fastener 1832 is coupled to the cover 1830 by a lock washer 1838 so that linear movement (e.g., via rotation of the fastener 1832) is transferred to the cover 1830 and the cover 1830 can move in and out of the recessed channel 1826 as described herein.

In this example, the channel 1826 is defined by a bottom track 1840 and two opposing sidewalls 1842, 1844. A first sidewall 1842 is adjacent the striking face 1808 and a second sidewall 1844 is adjacent to the rear of the sole 1802. The cover 1830 is substantially L-shaped with a long leg 1846 and a short leg 1848. The short leg 1848 includes a portion that couples to the fastener 1832 and both the short leg 1848 and the fastener 1832 are positioned adjacent the second sidewall 1844. The short leg 1848 also includes a flange 1850. The weight 1828 includes a groove 1852 that is sized and shaped to receive the flange 1850. The weight 1828 is slidably engaged with the cover 1830 and with the flange 1850 received at least partially within the groove 1852. This engagement between the cover 1830 and the weight 1828 enables the weight 1828 to move (e.g., raise out and lower back into the channel 1826) with the cover 1830 between the locked configuration (shown in FIG. 42) and the unlocked configuration (shown in FIG. 43), while also enabling the weight 1828 to slide relative to the cover 1830 in the toe-heel direction when the weight assembly is in the unlocked configuration. When the cover 1830 is in the locked configuration, the long leg 1846 also substantially covers the weight 1828 so as to increase the smoothness of the outer surface 1820 of the club head 1800.

The bottom track 1840 includes a plurality of bosses 1854 extending into the channel 1826. In this example, there are three bosses 1854, each which corresponds respectively to a fade bias position of the weight 1828, a draw bias position of the weight 1828, and a center-neutral position of the weight 1828. Additionally, the first sidewall 1842 includes a plurality of dimples 1856 that correspond to the plurality of bosses 1854. The weight 1828 includes a hollow 1858 that is sized and shaped to receive the boss 1854 and a position indicator 1860 that is sized and shaped to be received within the dimple 1856. In operation, when the weight assembly 1804 is in the unlocked configuration (shown in FIG. 43), the weight 1828 is raised above the bosses 1854 so that it can be selectively moved between the bosses 1854 and the dimples 1856 of the channel 1826. Once the weight 1828 is positioned, the weight assembly 1804 can be moved to the locked configuration (shown in FIG. 42) and the selected boss 1854 is received at least partially within the hollow 1858 of the weight 1828, and the position indicator 1860 is received at least partially within the selected dimple 1856.

In this example, at least a portion of the position indicator 1860 of the weight 1828 is visible on the outer surface 1820 of the club head 1800, when the weight assembly 1804 is in the locked configuration. This allows the user to easily visually verify the position of the weight 1828 on the club head 1800. It should be appreciated that while three bosses 1854 and dimples 1856 are illustrated and described, any other number of bosses and dimples locating features may be provided to define the position of the weight 1828 within the recessed channel 1826. For example, five sets of bosses and dimples may be provided. Additionally, the position indicator 1860 has a cutout so that when the cover 1830 is raised to the unlocked configuration (shown in FIG. 43), the position indicator 1860 can slide completely out of the dimple 1856 and move above the first sidewall 1842 to adjust the position of the weight 1828.

The cover 1830 can also include one or more projections 1862 that are sized and shaped to be received within a corresponding chamber 1864 of the recessed channel 1826. The projections 1862 are configured to increase the engagement of the cover 1830 with the body 1806 so that the weight 1828 is restricted from moving or rattling when secured within the recessed channel 1826 by the cover 1830. In some examples, the projections 1862 may be similar to the projections described above in reference to FIGS. 36-41 and include one or more flexible arms, a tapered nose, a stop, and at least one rib.

Figure 46:
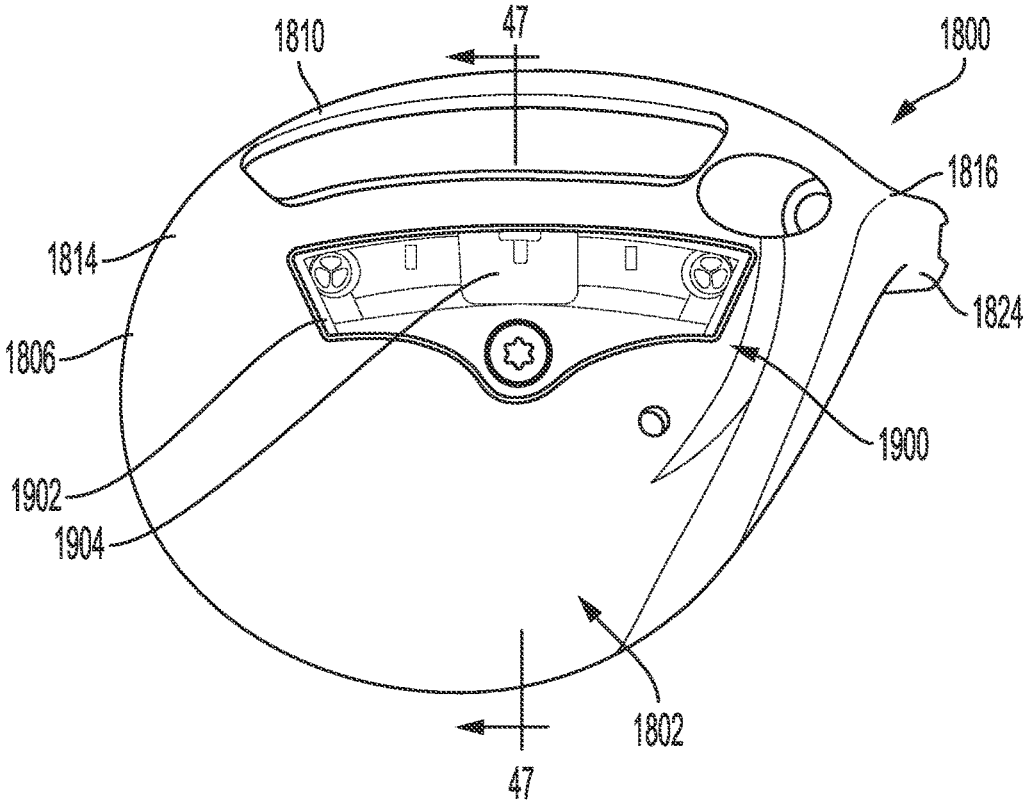
FIG. 46 is a bottom view of the golf club head with another weight assembly.
Figure 47:
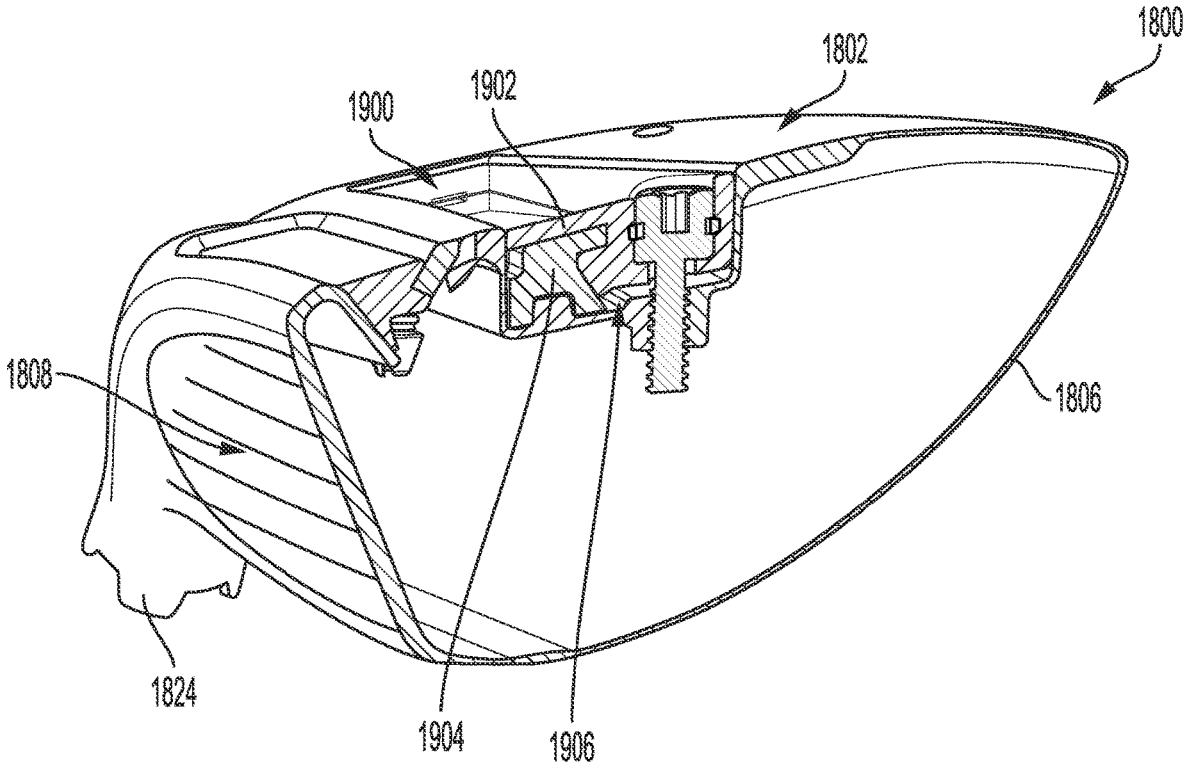
FIG. 47 is a perspective cross-section view of the golf club head with weight assembly taken along line 47-47 in FIG. 46.

FIG. 46 is a bottom view of the golf club head 1800 with another weight assembly 1900. FIG. 47 is a perspective cross-section view of the golf club head 1800 with the weight assembly 1900 taken along line 47-47 in FIG. 46. Referring concurrently to FIGS. 46 and 47, certain components are described above, and thus, are not necessarily described further. Similar to the example described in FIGS. 42-45, the weight assembly 1900 includes a cover 1902 that selectively secures a slidable weight 1904 within a recessed channel 1906. The weight 1904 is engaged with the cover 1902 so that the weight 1904 moves with the cover 1902 between two or more configurations. In this example, however, the cover 1902 completely covers the weight 1904 within the channel 1906, when the cover 1902 is in a locked configuration. The cover 1902 can be formed from an at least partially transparent material so that the position of the weight 1904 is visible to the user.

Figure 48:
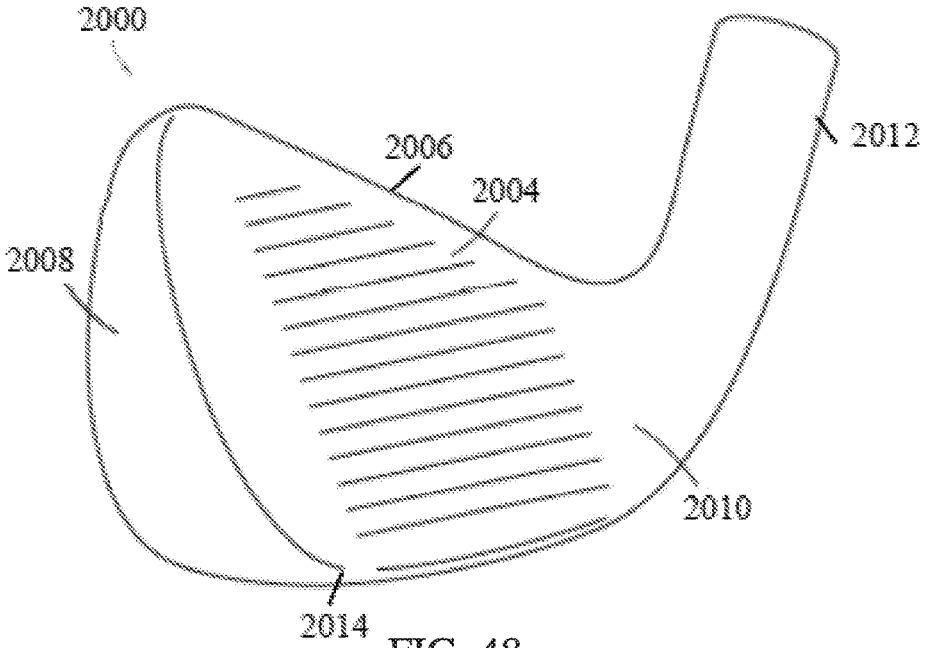
FIG. 48 is a perspective view of another golf club head.
Figure 49:
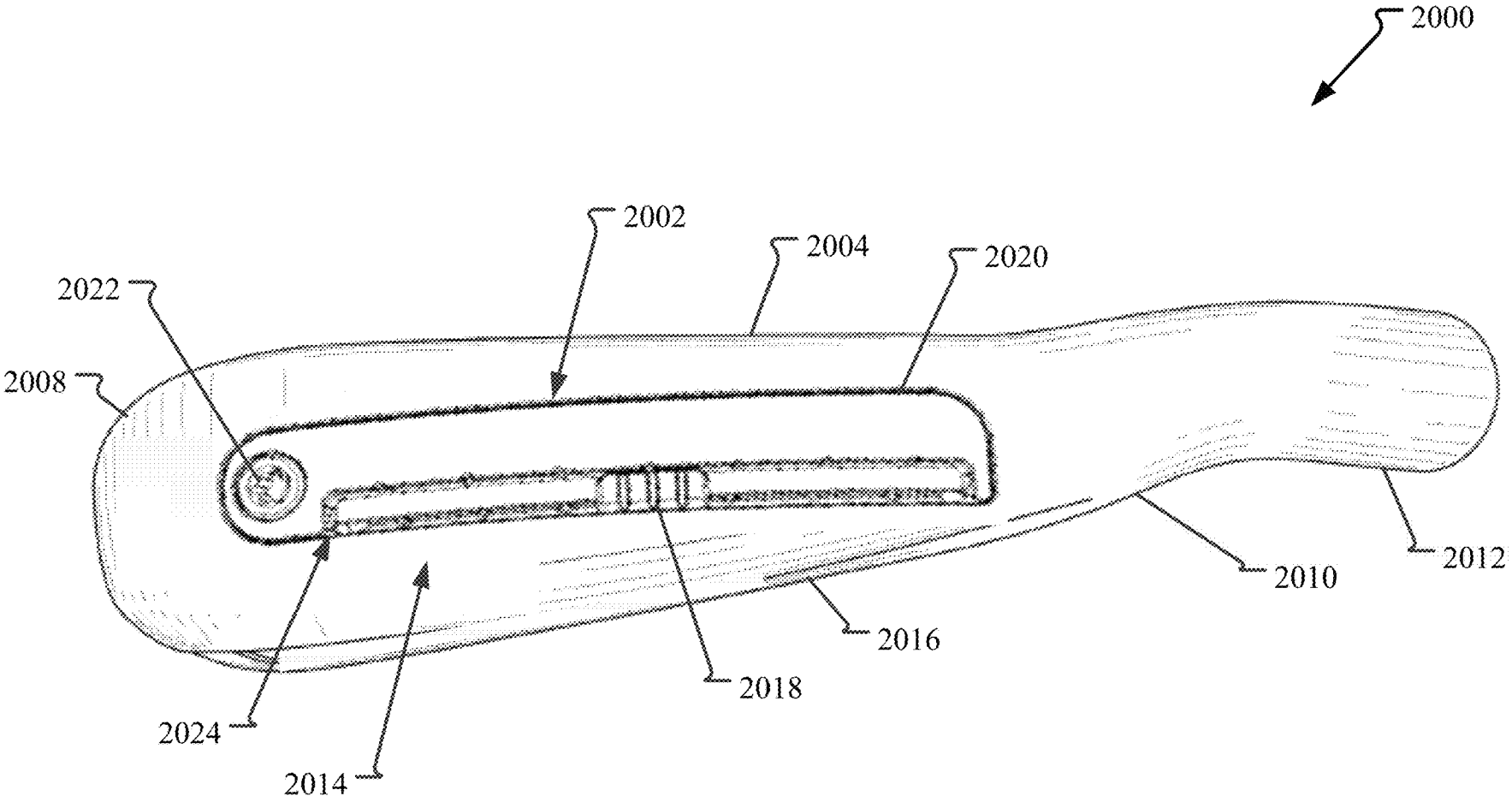
FIG. 49 is a bottom view of the club head shown in FIG. 48 with another weight assembly.

FIG. 48 is a perspective view of another golf club head 2000. FIG. 49 is a bottom view of the club head 2000 with another weight assembly 2002. Referring concurrently to FIGS. 48 and 49, the golf club head 2000 is an iron-type golf club head that includes a striking face 2004 configured to strike a golf ball. The striking face 2004 is connected to a top line portion 2006, a toe portion 2008, and a heel portion 2010. The toe portion 2008 and the heel portion 2010 are also at least in part connected to the top line portion 2006. The heel portion 2010 is connected to a hosel 2012 that is configured to couple to a shaft (not shown). The striking face 2004 is also connected to a sole 2014. The golf club head 2000 also includes a back portion 2016 that is attached at least partially to the sole 2014, the top line portion 2006, the toe portion 2008, and the heel portion 2010.

The components of the golf club head 2000, such as the striking face 2004, the top line portion 2006, the toe portion 2008, the heel portion 2010, and the back portion 2016 may be of a metallic material, such as a steel. The components of the golf club head 2000 may be formed through a casting process. Some of the components may be cast as a single piece and the remainder of the components may be attached subsequent to the casting process. For instance, the sole 2014, the top line portion 2006, the toe portion 2008, the heel portion 2010, and the back portion 2016 may be cast as a single piece. The striking face 2004 may then be attached to that single piece via welding or any other suitable process for attaching two club head components to one another. In such an example, the striking face 2004 may be an insert.

In operation, the sole 2014 generally provides the lower surface of the club head 2000 when the club head 2000 is placed in an address position. The club head 2000 defines a center of gravity (CG) and a moment of inertia (MOI) that impact flight characteristics of the golf ball when hit with the striking face 2004. The weight assembly 2002 is coupled to the club head 2000 such that the CG and/or the MOI of the club head 2000 can be selectively adjusted as required or desired. In this example, the weight assembly 2002 includes a movable weight 2018, a cover 2020 configured to secure the weight 2018 in place, and a fastener 2022 for coupling the weight assembly 2002 to one or more portions of the club head 2000. A recessed elongated channel 2024 is formed in the sole 2014 of the club head 2000 and is sized and shaped to receive at least a portion of the weight 2018. Similar to the examples described above, the fastener 2022 is adapted to retain the weight 2018 in the channel 2024 only indirectly by the cover 2020. Additionally, the cover 2020 can be loosened or completely removed, via the fastener 2022, to enable the weight 2018 to slide within the channel 2024 and selectively adjust the CG and the MOI as required or desired.

In this example, the fastener 2022 is positioned at the toe end of the weight assembly 2002 and aligned with the channel 2024. In other examples, the fastener 2022 may be positioned at the heel end of the weight assembly 2002 as required or desired.

Figure 50:
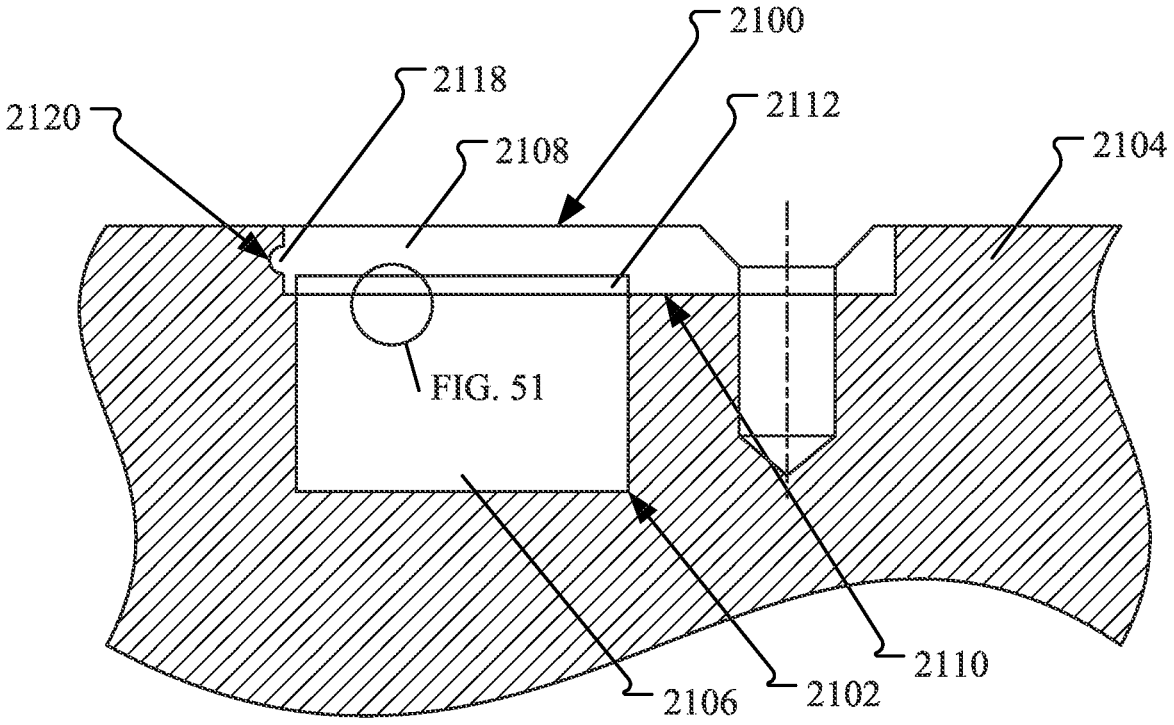
FIG. 50 is a cross-section view of another weight assembly.
Figure 51:
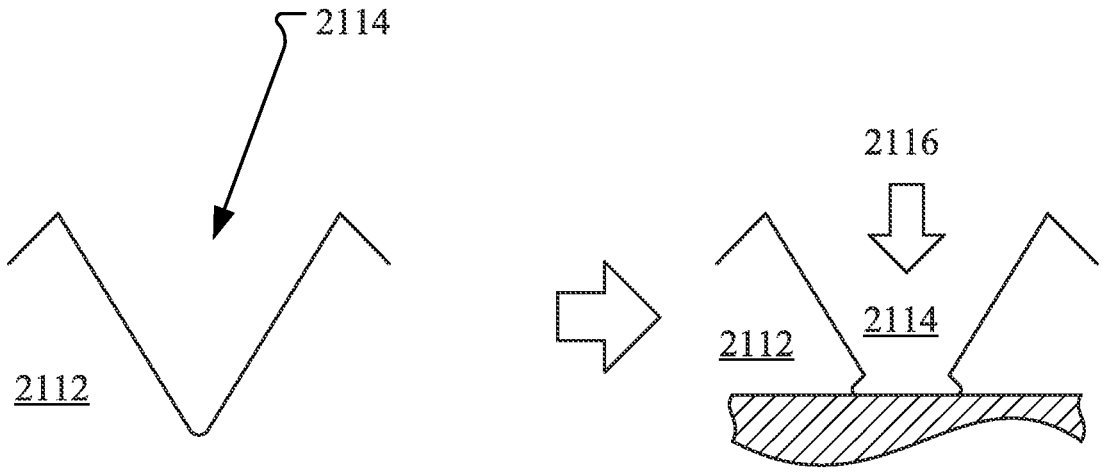
FIG. 51 is a schematic view of the weight assembly shown in FIG. 50.

FIG. 50 is a cross-section view of another weight assembly 2100. FIG. 51 is a schematic view of the weight assembly 2100. Referring concurrently to FIGS. 50 and 51, a recessed channel 2102 is defined within a body 2104 of a club head (e.g., club heads 100, 1800, and/or 2000 described above). The weight assembly 2100 includes a slidable weight 2106 and a cover 2108. A fastener (not shown) is used to retain the weight 2106 within the channel 2102. In this example, the cover 2108 includes an inside surface 2110 that engages with at least a portion of the weight 2106, when the weight 2106 is secured within the channel 2102. In this example, at least a portion of the inside surface 2110 of the cover 2108 includes a friction material liner 2112. The friction material 2112 is configured to frictionally engage with the weight 2106 when the cover 2108 is in a locked configuration. By frictionally engaging the weight 2106 with the cover 2108, the weight 2106 is secured within the channel 2102 while reducing or preventing the weight 2106 from rattling therein. In the example, the friction material can be a soft metal material, such as brass.

The friction material 2112 may include a plurality of grooves 2114 on the mating surface with the weight 2106. In this example, the grooves 2114 may be triangular in shape, although, other shapes are also contemplated herein. When a clamp load 2116 is applied to the friction material 2112, the material yields to hold the weight 2106 in place (as shown in FIG. 51) and match the particular surface combination of the channel 2102, weight 2106, and cover 2108. Once the deformation takes place and contact stress is established, the friction material 2112 will not deform further. By frictionally engaging the weight 2106 with the cover 2108, the weight 2106 can be positioned at any location within the channel 2102 and indexing features do not need to be included. Additionally, by removing the indexing features, the weight 2106 and channel 2102 have more substantially flat surfaces, which increases manufacturing efficiencies.

In this example, the cover 2108 may also include one or more protruding notches 2118 that engage with a corresponding cavities 2120 within the body 2104. The notches 2118 may be substantially circular in shape. The notches 2118 and cavities 2120 are described further below in reference to FIGS. 52 and 53. It should be appreciated that while the friction material 2112 is illustrated as being coupled to the cover 2108, the friction material 2112 can additionally or alternatively be coupled to the weight 2106.

Figure 52:
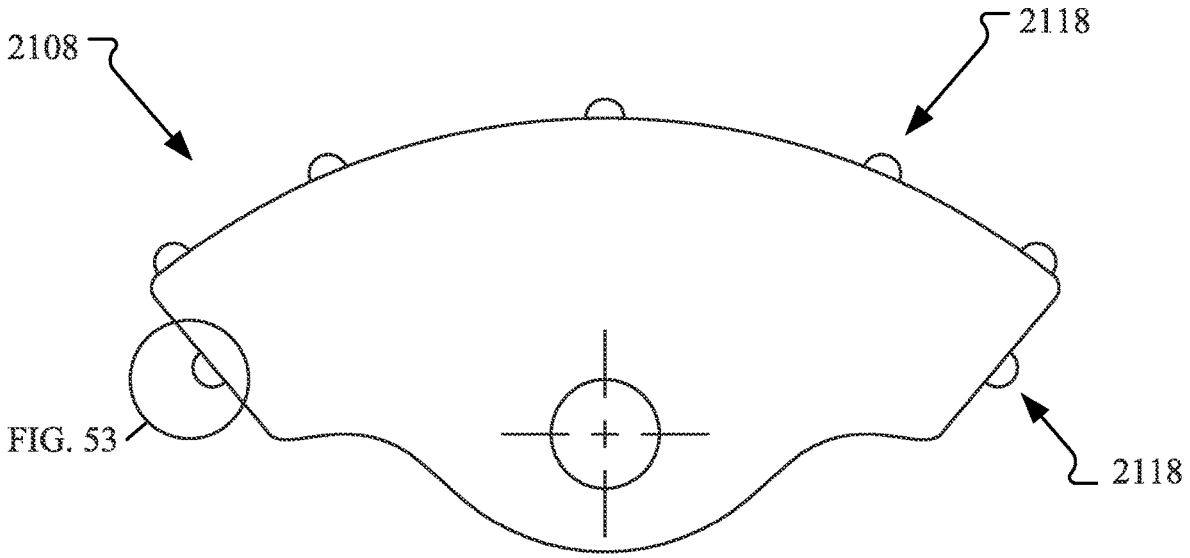
FIG. 52 is a top view of a cover of the weight assembly shown in FIG. 50.
Figure 53:
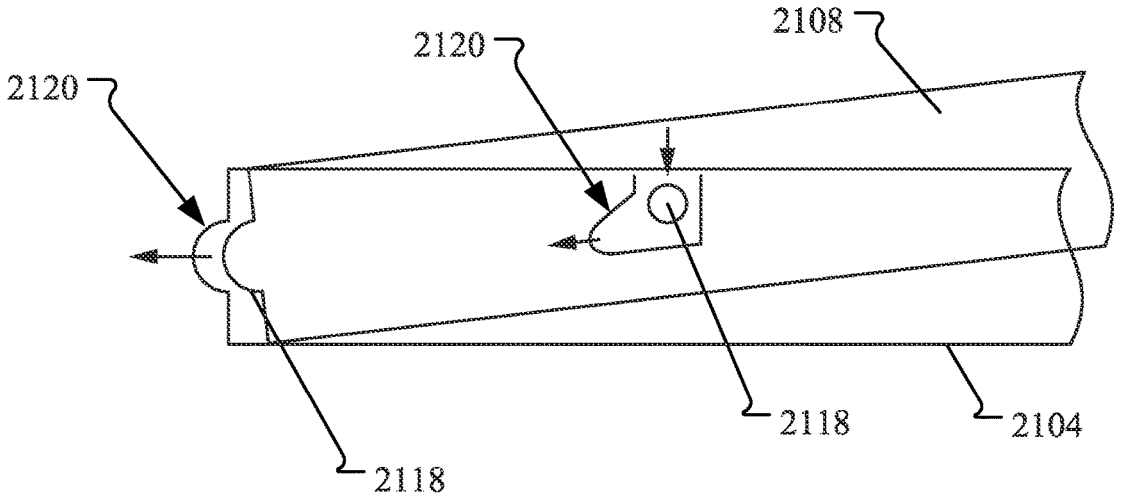
FIG. 53 is a side view of the cover of the weight assembly shown in FIG. 50.

FIG. 52 is a top view of the cover 2108 of the weight assembly 2100 (shown in FIG. 50). FIG. 53 is a side view of the cover 2108. Referring concurrently to FIGS. 52 and 53 certain components are described above, and thus, are not necessarily described further. The cover 2108 includes a plurality of protruding notches 2118 that engage with corresponding cavities 2120 within the body 2104. By engaging the cover 2108 at a plurality of locations, the cover 2108 is restricted or prevented from bowing out of alignment with the outer surface of the body 2104 when securing the weight. As illustrated in FIG. 53, the side cavities may be tapered so as to accept the cover 1206 sliding in at an angle.

Figure 54:
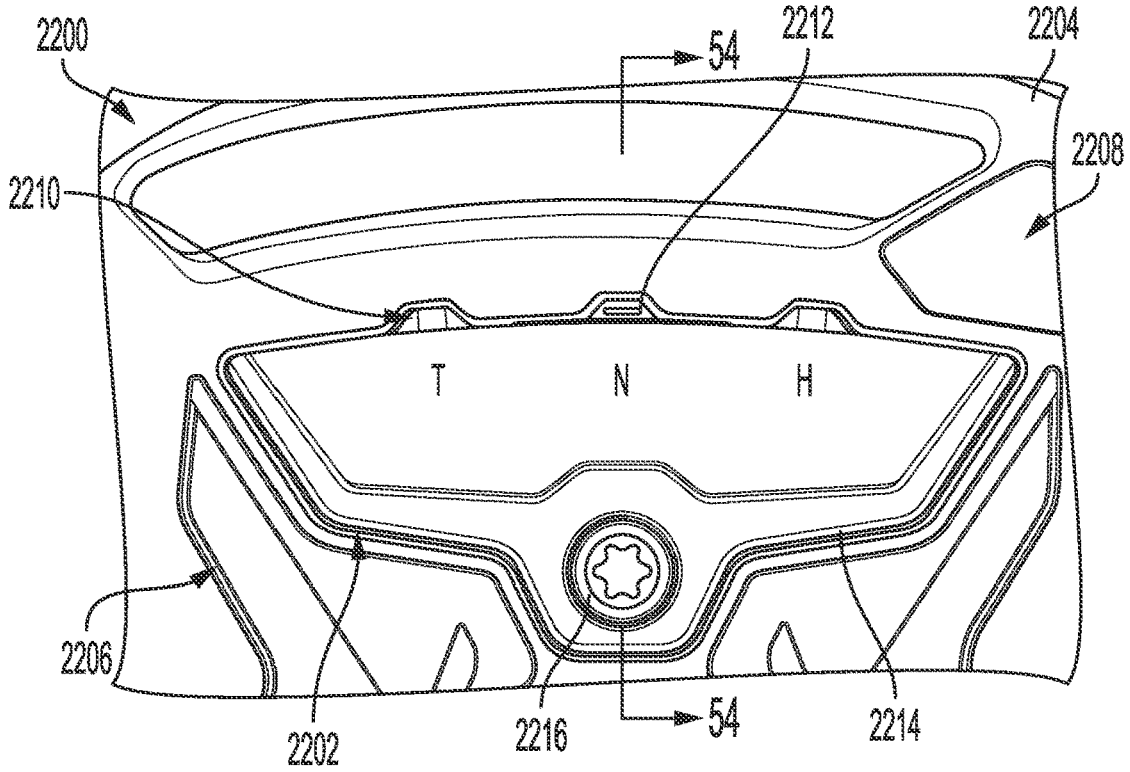
FIG. 54 is a bottom view of another golf club head with another weight assembly.

FIG. 54 is a bottom view of another golf club head 2200 with another weight assembly 2202 in a locked configuration. The golf club head 2200 includes a body 2204 having a sole 2206, and with the weight assembly 2202 disposed on the sole 2206. The body 2204 also includes a striking face and a crown (both not shown), such that the body 2204 has an outer surface 2208. In an aspect, the golf club head 2200 can be a fairway-metal type golf club head, however, the body 2204 can form any type club head, such as an iron-type club head, hybrid-type club head, or driver or other metal-wood type club head (e.g., one or more of the examples illustrated in FIGS. 1-53). Additionally, the functions of the components (e.g., sole, striking face, crown, hosel, etc.) of the club head 2200 are similar to the component functions described above in FIGS. 1-53. Furthermore, the features of the weight assembly 2202 described below can additionally or alternatively be utilized in any type club head described herein, and as required or desired.

In this example, a recessed channel 2210 is defined within the sole 2206 of the body 2204 of the club head 2200. The recessed channel 2210 extends in a toe-heel direction so that the CG and MOI of the club head 2200 can be adjusted (e.g., for fade-draw bias). The weight assembly 2202 includes a slidable weight 2212 disposed at least partially within the channel 2210, a cover 2214 that extends at least partially over the channel 2210, and a fastener 2216 configured to couple the cover 2214 to the body 2204. The fastener 2216 retains the weight 2212 in the recessed channel 2210 indirectly via the cover 2214 so that the weight 2212 can be used to adjust the CG and MOI of the club head 2200.

As illustrated in FIG. 54, the weight assembly 2202 is in a locked configuration with the cover 2214 at least partially disposed within the recessed channel 2210 and the weight 2212 secured within the channel 2210 so as to restrict movement. When the cover 2214 and the weight assembly 2202 are in the locked configuration, at least a portion of the weight 2212 is visible between the body 2204 and the cover 2214. This configuration enables the user to more easily determine the placement of the weight 2212 within the recessed channel 2210. The weight assembly 2202 can also be moved into an unlocked configuration as described herein. For example, via rotation of the fastener 2216, the cover 2214 can be raised at least partially out of the recessed channel 2210 and enable the weight 2212 to be repositioned.

In this example, the weight 2212 overlaps and engages with the cover 2214 so that both move together between the locked configuration and the unlocked configuration. Furthermore, this engagement is such that the weight 2212 is reduced or prevented from twisting and tilting relative to the cover 2214 when raising and lowering with respect to the recessed channel 2210. As such, the weight 2212 is prevented from binding within the recessed channel 2210 during weight adjustment, and thereby, increasing performance of the weight assembly 2202.

Figure 55:
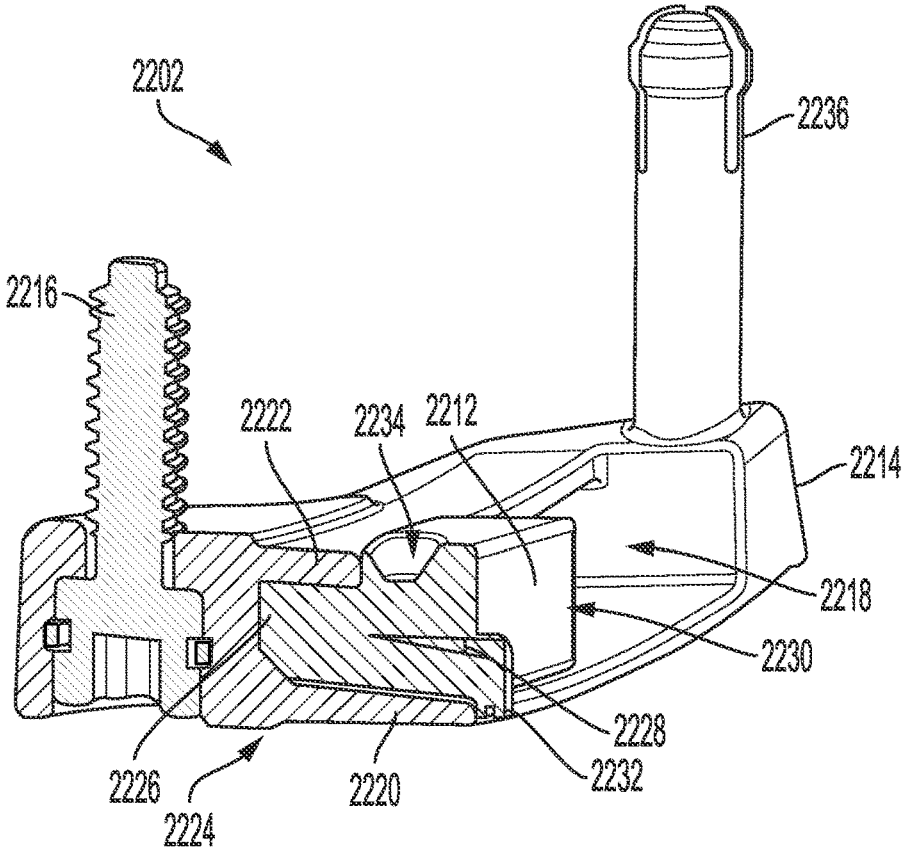
FIG. 55 is a perspective, cross-sectional, view of the weight assembly taken along line 54-54 in FIG. 54.
Figure 56:
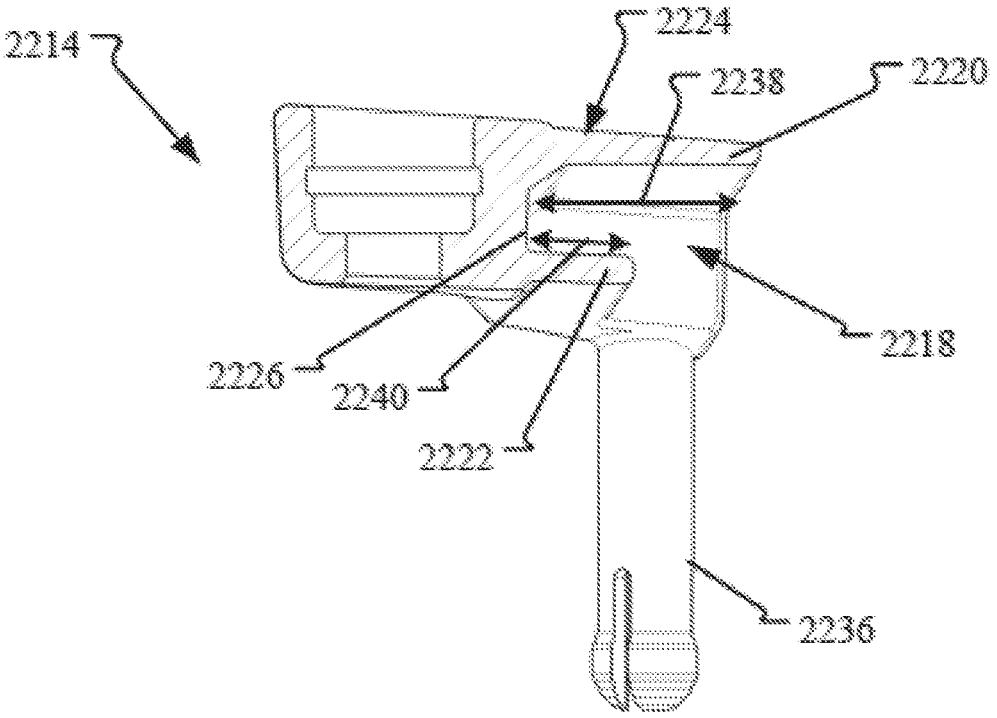
FIG. 56 is a cross-sectional view of a cover taken along line 54-54 in FIG. 54.

FIG. 55 is a perspective, cross-sectional, view of the weight assembly 2202 taken along line 54-54 in FIG. 54. FIG. 56 is a cross-sectional view of the cover 2214 taken along line 54-54 in FIG. 54. Referring concurrently to FIGS. 55 and 56, the cover 2214 has a shelf 2218 that is configured to slidably engage with the weight 2212. In the example, the shelf 2218 is open in a direction that faces towards the striking face of the club head and away from the fastener 2216. Additionally, the shelf 2218 extends within the cover 2214 in a toe-heel direction. It is appreciated, however, that the shelf 2218 can be defined within the cover 2214 in any other orientation and/or direction as required or desired to achieve the adjustable weight functionality as described herein. When the cover 2214 is in the unlocked position, the weight 2212 is raised relative to the club head such that the weight 2212 is selectively slidable within the shelf 2218 and the recessed channel 2210 (shown in FIG. 54). Conversely, when the cover 2214 is in the locked position, the weight 2212 is disposed at least partially within the recessed channel 2210 and the shelf 2218, and secured therein, so as to restrict or prevent movement of the weight 2212. In the example, the shelf 2218 provides an overlap for the cover 2214 with the weight 2212 so as to reduce the weight 2212 from binding within the recessed channel.

The shelf 2218 includes an outer wall 2220 and an opposite inner wall 2222. As described herein, the outer wall and inner wall of the shelf 2218 are in reference to the interior cavity of the body 2204 of the club head (shown in FIG. 54). As such, the outer wall 2220 is disposed proximate an exterior surface 2224 of the cover 2214. The weight 2212 is configured to be slidably received at least partially between the outer wall 2220 and the inner wall 2222 of the shelf 2218 and against an inner wall 2226 of the shelf 2218. The three walls of the shelf 2218 retain the weight 2212 within the cover 2214 so that the position of the weight 2212 is restricted or prevented from tilting relative to the cover 2214 when being moved between the locked configuration and unlocked configuration. This configuration restricts the weight 2212 from binding within the weight assembly 2202, and thus, increases performance of the weight assembly 2202.

In the example, this position of the weight 2212 within the cover 2214 can be measured by a tilt angle 2228 that is defined as an angular position of the weight 2212 relative to the outer wall 2220 of the shelf 2218. In an aspect, the tilt angle 2228 is substantially the same in both the unlocked configuration and the locked configuration. In another aspect, the tilt angle 2228 is substantially parallel to the outer wall 2220 of the shelf 2218 in both the unlocked configuration and the locked configuration. The weight 2212 has an outer surface 2230 that is positioned directly against the outer wall 2220, the inner wall 2222, and the inner wall 2226 of the cover 2214 when received within the shelf 2218. As such, the outer surface 2230 of the weight 2212 maintains its position directly against the walls of the shelf 2218 in both the unlocked configuration and locked configuration.

The weight 2212 includes a position indicator 2232 that extends at least partially out of the shelf 2218. The position indicator 2232 can be used to selectively slide the weight 2212 when the weight assembly 2202 is in the unlocked configuration. When in the locked configuration, the position indicator 2232 is visible between the cover 2214 and the body of club head so that the user can easily determine the weight characteristics of the club head. Additionally, the position indicator 2232 can be disposed within dimples (e.g., the dimples 1856 shown in FIG. 45) of the recessed channel. The weight 2212 also includes a hollow 2234 that is sized and shaped to receive a boss (e.g., the boss 1854 shown in FIG. 45) of the recessed channel. In the example, the hollow 2234 is disposed adjacent the inner wall 2222 of the shelf 2218.

The cover 2214 can also include one or more projections 2236 that are sized and shaped to be received within a corresponding chamber (not shown) of the recessed channel. The projection 2236 is configured to increase the engagement of the cover 2214 with the golf club head body so that the weight 2212 is restricted from moving or rattling when secured within the recessed channel by the cover 2214. The projection 2236 can also be used to limit the extraction of the cover 2214 from the body 2204 (shown in FIG. 54) to create a soft stop before completely unscrewing and extracting the cover 2214 from the body. In some examples, the projection 2236 may be similar to the projections described above in reference to FIGS. 36-41 and include one or more flexible arms, a tapered nose, a stop, and at least one rib.

In the example, a width 2238 of the outer wall 2220 relative to the inner wall 2226 is greater than a width 2240 of the inner wall 2222. This configuration enables the weight 2212 to be retained within the shelf 2218 without tilting and binding up within the weight assembly 2202. Additionally, the weight 2212 includes the hollow 2234 and the position indicator 2232 that can extend out from the shelf 2218 and enable the function of the weight assembly 2202 as described herein. For example, the inner wall 2226 enables the hollow 2234 of the weight 2212 to engage with corresponding structure within the recessed channel. In an aspect, the width of the outer wall is between approximately 2 to 4 times greater than the width of the inner wall. In another aspect, a ratio of the width 2238 of the outer wall 2220 to the width 2240 of the inner wall 2222 is greater than, or equal to, 2:1. In yet another aspect, the ratio of the width 2238 of the outer wall 2220 to the width 2240 of the inner wall 2222 is greater than, or equal to, 3:1. In still another aspect, the ratio of the width 2238 of the outer wall 2220 to the width 2240 of the inner wall 2222 is between approximately 2:1 and 4:1. It should be appreciated that other ratio values are also contemplated herein and may not be expressly listed above.

Figure 57:
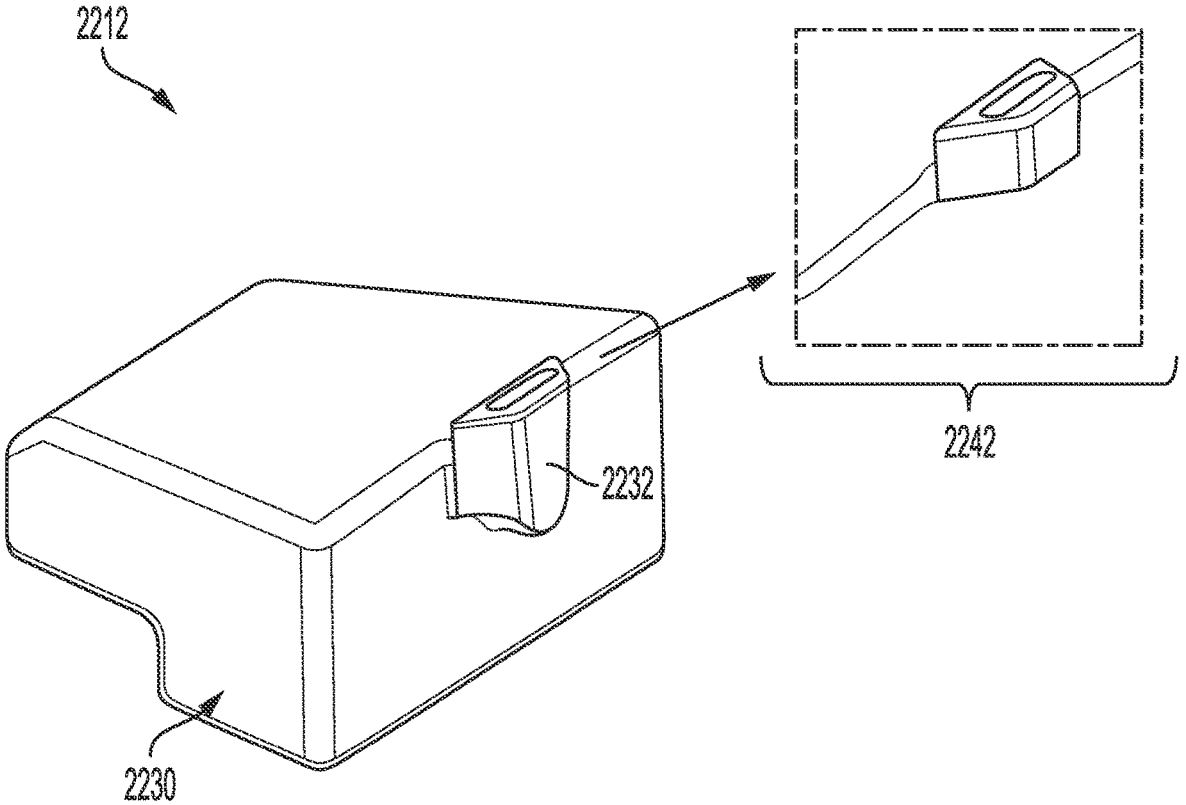
FIG. 57 is a perspective view of a weight of the weight assembly shown in FIGS. 55 and 56.
Figure 58:
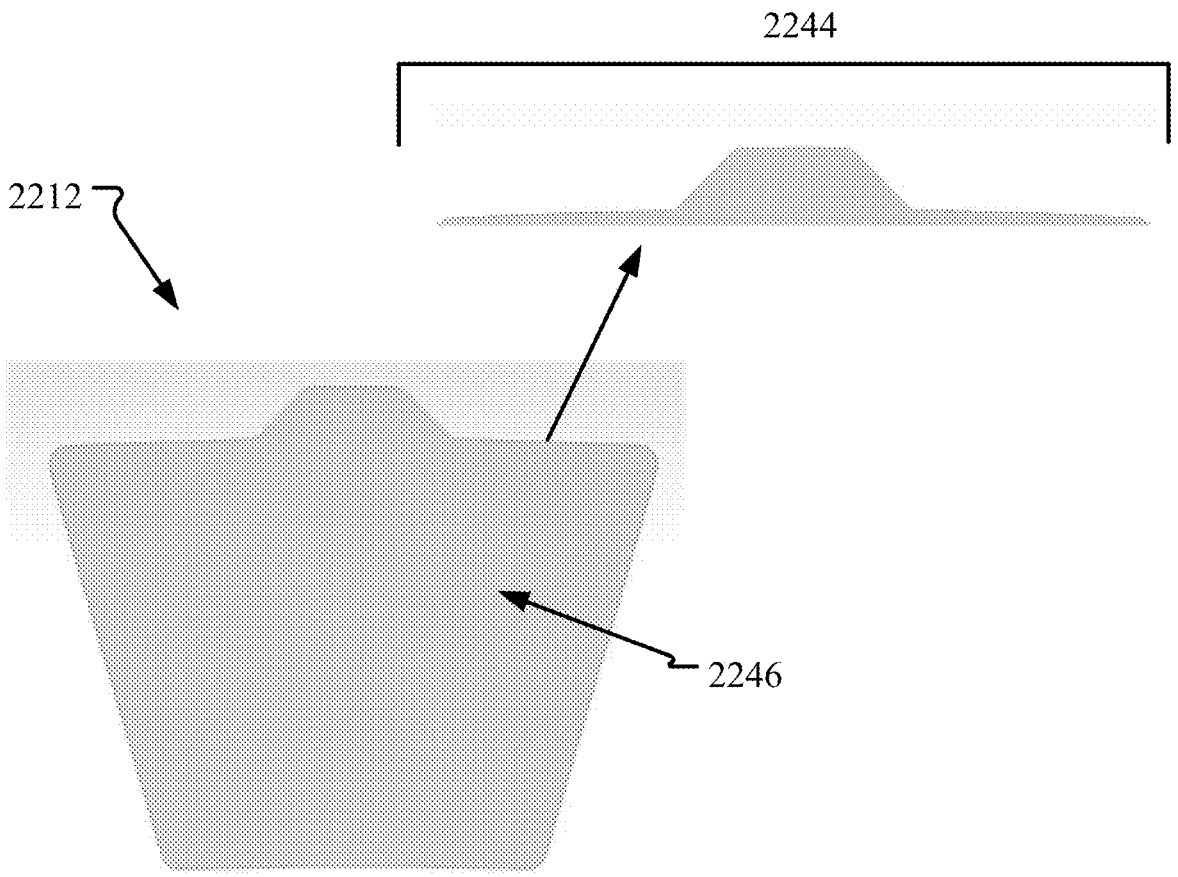
FIG. 58 is a schematic top plan view of the weight shown in FIG. 57.

FIG. 57 is a perspective view of the weight 2212. FIG. 58 is a schematic top plan view of the weight 2212. Referring concurrently to FIGS. 57 and 58, as well as FIG. 54, at least a portion of the weight 2212 is exposed and visible between the exterior surface of the cover 2214 and the outer surface 2208 of the body 2204, when the weight assembly 2202 in the locked configuration. That is, a gap is formed at least partially between a portion of the cover 2214 and the body 2204, and the weight 2212 at least partially fills this gap. For example, the position indicator 2232 may be exposed and visible on the golf club head 2200. This configuration enables the position of the weight 2212 to be easily determined. However, the weight 2212 is not entirely exposed and visible. By reducing the portions of the weight 2212 exposed on the golf club head 2200, the smoothness between the outer surface 1820 of the club head 2200 and the cover 2214 is increased. As such, the golf club head 2200 has increased performance (e.g., striking golf balls directly off the ground surface, aerodynamic performance, etc.), while also including the weight adjustable function via the weight assembly 2202 as described herein.

In the example, between approximately 0% and 30% of the weight 2212 is exposed and visible between the outer surface 2208 of the body 2204 and the exterior surface of the cover 2214 in the locked configuration. In an aspect, between approximately 10% and 20% of the weight 2212 is exposed between the outer surface 2208 of the body 2204 and the exterior surface of the cover 2214 in the locked configuration. In yet another aspect, approximately 16% of the weight 2212 is exposed. It should be appreciated that other percentage values are also contemplated herein and may not be expressly listed above. Although not shown in the figures, the weight 2212 can be completely invisible without departing from the scope and content of the present invention.

With reference to FIG. 57, the percentage of the weight 2212 visible and exposed (e.g., portion 2242) may be based on the outer surface area 2230 of the weight 2212. As used herein, the outer surface 2230 of the weight 2212 includes more than one side of the weight shape and the entire outer perimeter as illustrated in FIG. 57. For example, in an aspect, between approximately 0% and 30% of the outer surface 2230 of the weight 2212 is exposed between the outer surface 2208 of the body 2204 and the exterior surface of the cover 2214 in the locked configuration. In another aspect, between approximately 10% and 20% of the outer surface 2230 of the weight 2212 is exposed between the outer surface 2208 of the body 2204 and the exterior surface of the cover 2214 in the locked configuration. In yet another aspect, approximately 16% of the outer surface 2230 the weight 2212 is exposed. It should be appreciated that other percentage values are also contemplated herein and may not be expressly listed above.

With reference to FIG. 58, the percentage of the weight 2212 visible and exposed (e.g., portion 2244) may be based on a planar surface area 2246 of the weight 2212. As used herein, the planar surface area 2246 is the surface area only on one projection side of the weight shape (e.g., top planar area). While the top planar area is illustrated in FIG. 58, other weight sides (e.g., right planar area, left planar area, etc.) are also contemplated herein. For example, in an aspect, between approximately 0% and 30% of the planar surface area 2246 of the weight 2212 is exposed between the outer surface 2208 of the body 2204 and the exterior surface of the cover 2214 in the locked configuration. In another aspect, between approximately 10% and 20% of the planar surface area 2246 of the weight 2212 is exposed between the outer surface 2208 of the body 2204 and the exterior surface of the cover 2214 in the locked configuration. In yet another aspect, approximately 16% of the planar surface area 2246 the weight 2212 is exposed. It should be appreciated that other percentage values are also contemplated herein and may not be expressly listed above.

Figure 59:
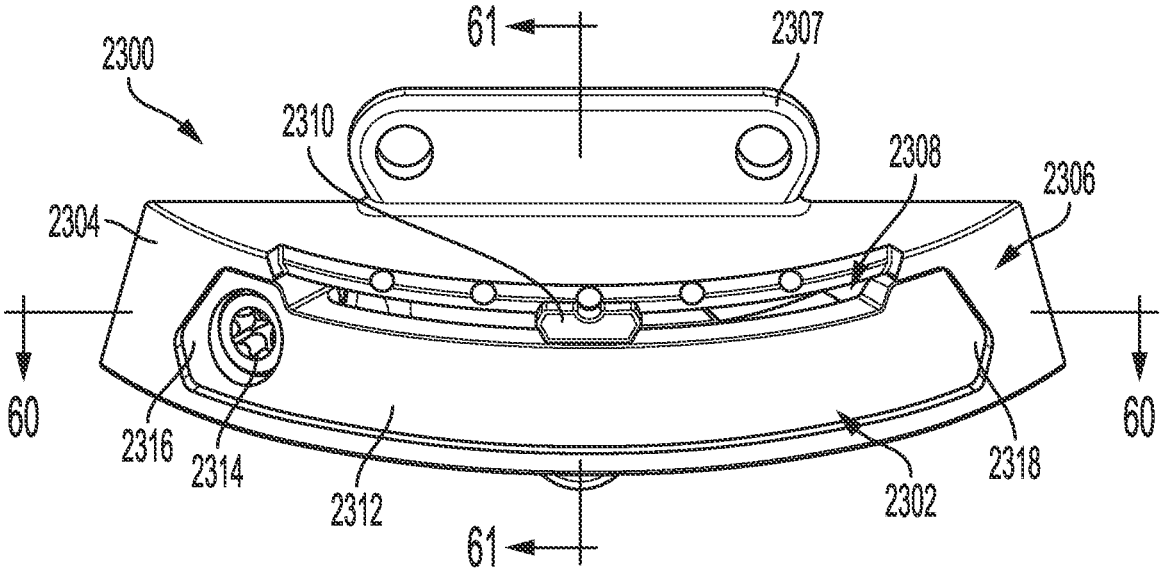
FIG. 59 is a schematic perspective view of an exemplary test mule with another weight assembly.
Figure 60:
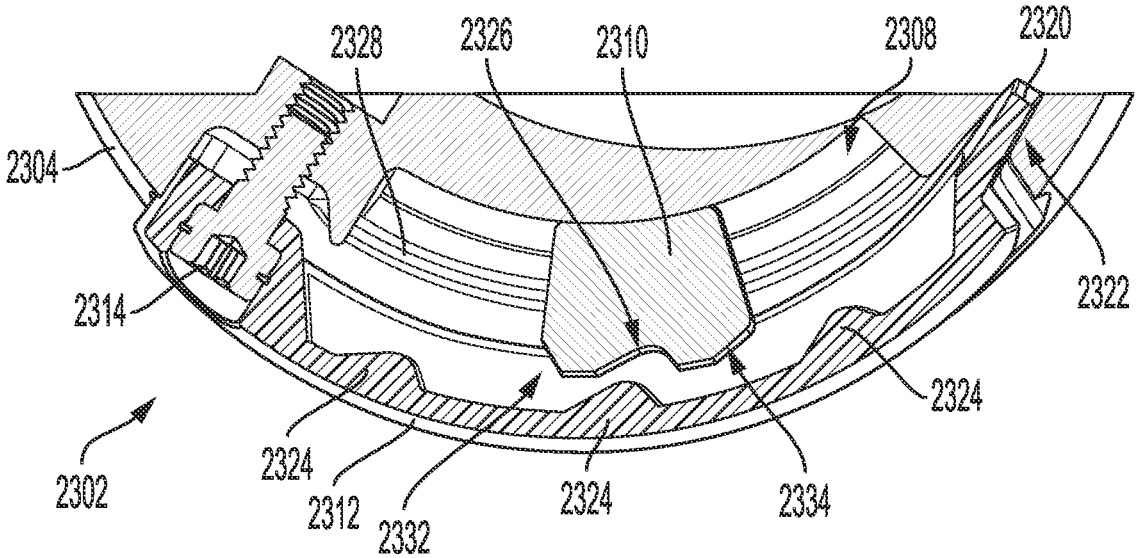
FIG. 60 is a cross-sectional view of the weight assembly taken along line 60-60 in FIG. 59.
Figure 61:
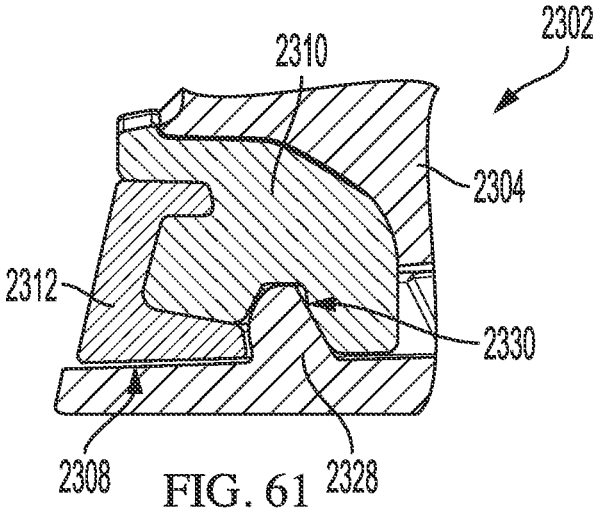
FIG. 61 is another cross-sectional view of the weight assembly taken along line 61-61 in FIG. 59.

FIG. 59 is a schematic perspective view of an exemplary test mule 2300 with another weight assembly 2302. FIG. 60 is a cross-sectional view of the weight assembly 2302 taken along line 60-60 in FIG. 59. FIG. 61 is another cross-sectional view of the weight assembly 2302 taken along line 61-61 in FIG. 59. Referring concurrently to FIGS. 59-61, the test mule 2300 represents a golf club head as described herein and can be utilized to test and develop features of the weight assembly 2302 as required or desired. The club head that the test mule 2300 represents can be any type of club head described herein as required or desired, such as, but not limited to, a metalwood-type golf club head, a fairway-metal type club head, an iron-type club head, or a hybrid-type club head. In an aspect, the club head that the test mule 2300 represents is a metalwood-type club head with a striking face, a sole extending from a lower edge of the striking face, and a crown extending from an upper edge of the striking face (all three components not shown in FIGS. 59-60). In an aspect, a transition area where the sole and the crown couple together opposite the striking face is known as a skirt of the club head, and the weight assembly 2302 is disposed at least partially on the skirt. As such, the weight assembly 2302 is disposed at a rear perimeter of the club head and proximate where the sole and the crown couple together. In an aspect, the weight assembly 2302 is disposed substantially at a rear portion of the club head opposite the striking face. One example of a weight assembly disposed on a skirt of a golf club head is shown in FIG. 8 and described above. In the example, the test mule 2300 includes a body 2304 having an outer surface 2306 that represents the body of the club head. Additionally, a bracket 2307 is coupled to the body 2304 to facilitate testing and development, and the bracket 2307 is not representative of the club head. In an aspect, the bracket 2307 is substantially triangular in shape.

In this example, a recessed channel 2308 is defined in the outer surface 2306 of the body 2304. The channel 2308 extends along a curve in a generally toe-heel direction so that the CG and the MOI of the club head can be adjusted via the weight assembly 2302. The weight assembly 2302 includes a weight 2310 disposed at least partially within the channel 2308 and configured to slide therein, a cover 2312 that extends at least partially over the channel 2308, and a fastener 2314 configured to couple the cover 2312 to the body 2304. The fastener 2314 is configured to retain the weight 2310 in the recessed channel 2308 indirectly via the cover 2312 and so that the weight 2310 can be used to adjust the CG and the MOI of the club head.

Similar to the examples described above, the weight assembly 2302 is configured to move between at least a locked configuration, shown in FIGS. 59 and 61, and an unlocked configuration, shown in FIG. 60. In the locked configuration, the cover 2312 is at least partially disposed within the recessed channel 2308, and the weight 2310 is secured within the channel 2308 with movement restricted. In the unlocked configuration, the fastener 2314 enables the cover 2312 to move along a fastener axis so that the weight 2310 can slide relative to cover 2312 and the body 2304. In an aspect, from the locked configuration, the fastener 2314 may be rotatable between about 2-3 turns to release the cover 2312 from the locked configuration and enable the weight 2310 to slide at least partially within the recessed channel 2308. In another aspect, the fastener 2314 may rotate about 2½ turns to enable the weight 2310 to slide within the weight assembly 2302.

The cover 2312 has a first end 2316 and an opposite second end 2318. The fastener 2314 is coupled to the first end 2316 (e.g., via a lock washer) of the cover 2312 and so that the fastener 2314 is used for attaching the cover 2312 to the body 2304. The second end 2318 of the cover 2312 includes a projection 2320. The projection 2320 of the second end 2318 is configured to engage with a corresponding chamber 2322 defined at the end of the recessed channel 2308. In the locked configuration, the fastener 2314 secures the first end 2316 of the cover 2312 to the body 2304, while the projection 2320 of the second end 2318 engages with the chamber 2322 of the channel 2308 so that a position of the weight 2310 within the recessed channel 2308 is retained between the first end 2316 and the second end 2318 of the cover 2312. When the weight assembly 2302 is moved towards the unlocked configuration, the fastener 2314 is used to move the cover 2312 along the fastener axis and raise the cover 2312 at least partially out of the recessed channel 2308. This configuration enables the weight 2310 to slide and be repositioned on the body 2304 of the golf club head. In this example, the projection 2320 extends in a direction that is substantially parallel to the fastener axis so that the cover 2312 can uniformly raise out of the recessed channel 2308. In an aspect, the chamber 2322 is formed as an undercut in a sidewall of the recessed channel 2308, and this undercut engages with the projection 2320 of the cover 2312. The fastener 2314 is at the opposite end of the undercut.

To assist in positioning the weight 2310 at preselected positions within the recessed channel 2308, the cover 2312 includes at least one locating lug 2324 that extends from an inner surface of the cover 2312. The weight 2310 includes a corresponding hollow 2326 shaped and sized to receive at least a portion of the locating lug 2324. As illustrated in FIG. 60, the cover 2312 has three spaced apart locating lugs 2324 so that the hollow 2326 can selectively engage the lug 2324 at three discrete locations within the recessed channel 2308. In an aspect, the locating lug 2324 may not be symmetrical, for example, one side of the lug 2324 can have a steeper angled side than an opposite more shallower angle side. Furthermore, in this example, the weight 2310 has a first inclined surface 2332 on one end and a second inclined surface 2334 on the opposite end proximate the side of the hollow 2326. The first and second inclined surfaces 2332, 2334 are different and configured to engage with one of the steeper or shallower angled sides of the locating lug 2324. This configuration allows for the weight 2310 to be positioned between two locating lugs 2324 and selectively engage therewith. As such and as illustrated in FIG. 60, the weight 2310 can engage with the cover 2312 at two more discrete locations within the recessed channel 2308 and between pairs of locating lugs 2324. When the locating lug(s) 2324 is engaged with the weight 2310, the weight 2310 is retained more tightly within the cover 2312 to reduce or prevent rattling and further movement of the weight 2310 in the locked configuration. Additionally, one or more of the locating lugs 2324 can define a position of the weight 2310 on the golf club head. In other aspects, the cover 2312 can have five spaced apart locating lugs 2324. Other numbers of locating lugs 2324 are also contemplated herein. It should also be appreciated that in other examples, a locating lug 2324 may be provided for every discrete location of the weight 2310 as required or desired.

In this example, the weight 2310 is slidably engaged with the body 2304 within the recessed channel 2308. The body 2304 includes a partial wall 2328 that is disposed within the recessed channel 2308. The partial wall 2328 extends from a bottom of the recessed channel 2308, and the weight 2310 includes a recess 2330 shaped and sized to receive at least a portion of the partial wall 2328. By slidably engaging the partial wall 2328 and the recess 2330 of the weight 2310, the weight 2310 does not move with the cover 2312 when the cover is moved towards the unlocked configuration. This retention of the weight 2310 within the recessed channel 2308 enables the locating lugs 2324 of the cover 2312 to disengage with the weight 2310 and allow the weight 2310 to slide and change positions. Additionally, the orientation of the weight 2310 within the recessed channel 2308 can be held by the partial wall 2328 when the cover 2312 is in the unlocked configuration so that the weight 2310 can slide more easily to different positions.

Figure 62:
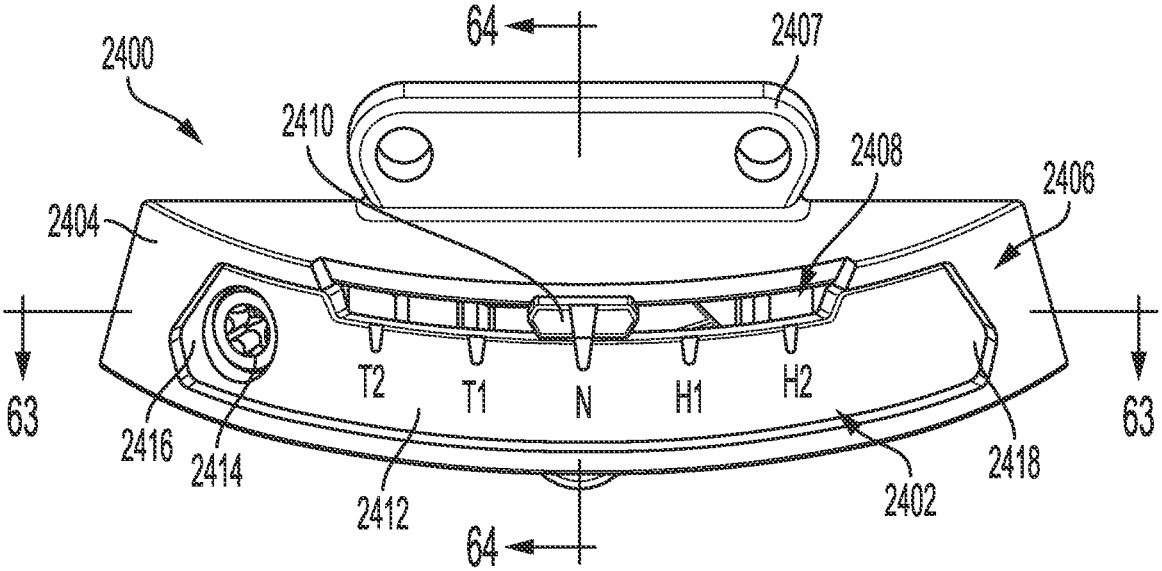
FIG. 62 is a schematic perspective view of another test mule with another weight assembly.

FIG. 62 is a schematic perspective view of another test mule 2400 with another weight assembly 2402. FIGS. 63A-E are cross-sectional views of the weight assembly 2402 taken along line 63-63 in FIG. 62 and with a weight 2410 in a variety of different positions. FIG. 64 is another cross-sectional view of the weight assembly 2402 taken along line 64-64 in FIG. 62. Referring concurrently to FIGS. 62-64, and similar to the example described above in FIGS. 59-61, the test mule 2400 represents a club head that can be any type of club head described herein as required or desired, and in an aspect, the weight assembly 2402 is disposed on a skirt of the club head and at a rear perimeter where the sole and the crown couple together. The test mule 2400 includes a body 2404 having an outer surface 2406 that represents the club head and a bracket 2407. A recessed channel 2408 is defined in the outer surface 2406 of the body 2404. The weight assembly 2402 includes the weight 2410 disposed at least partially within the channel 2408 and configured to slide therein, a cover 2412 that extends at least partially over the channel 2408, and a fastener 2414 configured to couple the cover 2412 to the body 2404. The cover 2412 has a first end 2416 and an opposite second end 2418. The fastener 2414 is coupled to the first end 2416 (e.g., via a lock washer) of the cover 2412 and so that the fastener 2414 is used for attaching the cover 2412 to the body 2404. The second end 2418 of the cover 2412 includes a projection 2420. The projection 2420 of the second end 2418 is configured to engage with a corresponding chamber 2422 defined at the end of the recessed channel 2408 and to secure the second end 2418 to the body 2404.

In this example, to assist in positioning the weight 2410 at preselected positions within the recessed channel 2408, the body 2404 includes at least one locating lug 2424 disposed within the recessed channel 2408. In an aspect, the locating lug 2424 extends from a back wall of the recessed channel 2408 relative to the outer surface 2406. In another aspect, the locating lug 2424 is substantially symmetrical with two similarly angled sides. The weight 2410 includes a corresponding hollow 2426 shaped and sized to receive at least a portion of the locating lug 2424. Furthermore, in this example, the weight 2410 has inclined surfaces 2432 on each end proximate the side of the hollow 2426. The inclined surfaces 2432 are similar to each other and configured to engage with the angled sides of the locating lugs 2424. As illustrated in FIGS. 63A-E, the cover 2412 has three spaced apart locating lugs 2424 so that the weight 2410 is selectively positionable at five discrete locations within the recessed channel 2408. Other numbers of locating lugs 2424 are also contemplated herein. The locating lugs 2424 are not evenly spaced apart in the heel-toe direction of the club head and have two different spacing distances. In the example, the locating lug 2424 proximate the fastener 2414 is spaced further apart from the locating lug 2424 in the middle than the locating lug 2424 proximate the projection 2420. In an aspect, the spacing between the fastener locating lug 2424 and the middle locating lug 2424 is approximately double the spacing between the projection locating lug 2424 and the middle locating lug 2424. Additionally, in some examples, the locating lugs 2424 can be substantially cone-shaped.

Figure 63A:
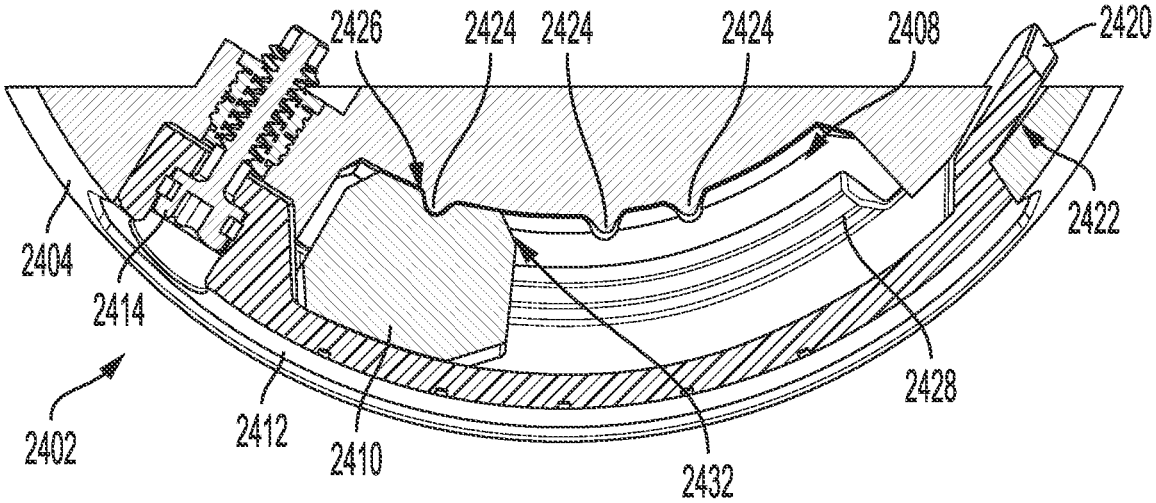
FIGS. 63A-E are cross-sectional views of the weight assembly taken along line 63-63 in FIG. 62 and with a weight in a variety of different positions.
Figure 63B:
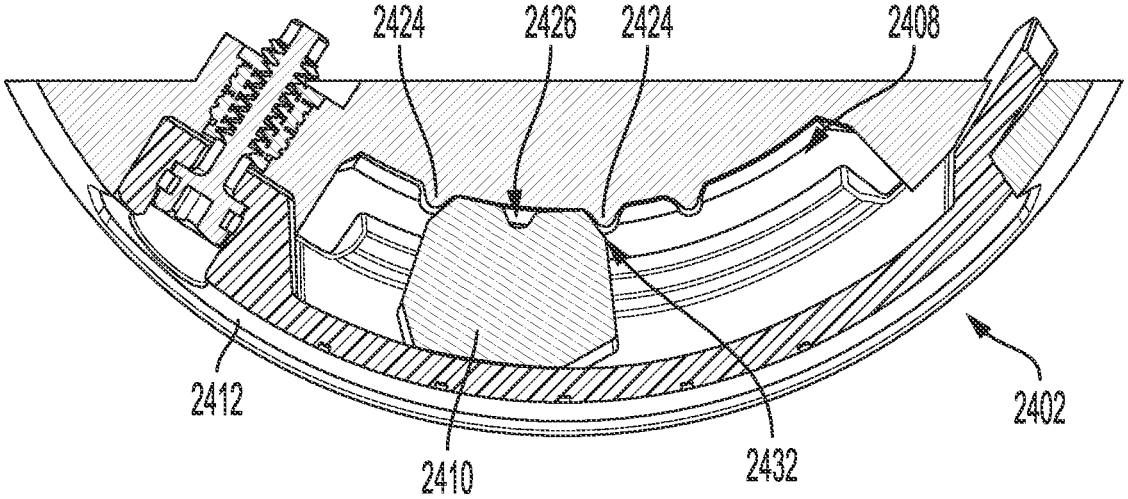
Figure 64:
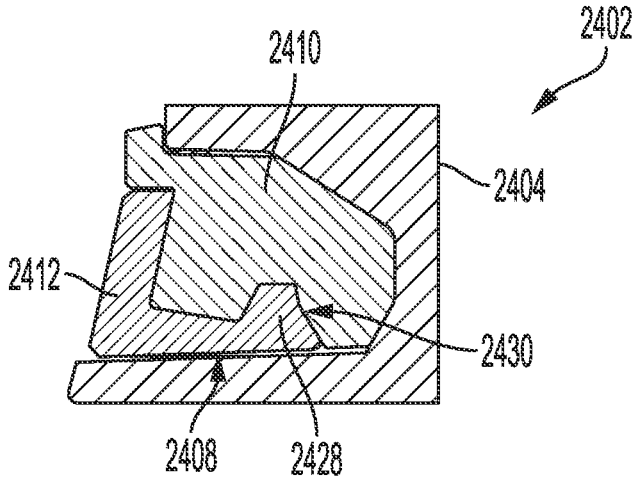
FIG. 64 is another cross-sectional view of the weight assembly taken along line 64-64 in FIG. 62.

Starting with FIG. 63A, the weight 2410 is disposed adjacent to the fastener 2414 and the hollow 2426 is engaged with the locating lug 2424 proximate the fastener 2414. As such, a portion of the weight 2410 is positioned on both sides of locating lug 2424. The weight assembly 2402 is in a locked configuration so that the position of the weight 2410 relative to the body 2404 is secured. In some aspects, the far side of the weight 2410 can be positioned directly against a portion of an end wall of the recessed channel 2408 and/or a portion of the cover 2412 that couples to the fastener 2414. Moving next to FIG. 63B, the weight assembly 2402 can be moved to an unlocked configuration (e.g., at least partially raising the cover 2412 out of the recessed channel 2408 to enable sliding movement of the weight 2410) for repositioning the weight 2410 and adjusting the CG and/or MOI of the club head. Once the weight 2410 is repositioned, the weight assembly 2402 can be moved into the locked configuration (as shown) to secure the position of the weight 2410. In this position, the weight 2410 is disposed between two locating lugs 2424 such that the hollow 2426 does not have a locating lug 2424 received therein. Rather, the inclined surfaces 2432 are engaged with a respective locating lug 2424.

Figure 63C:
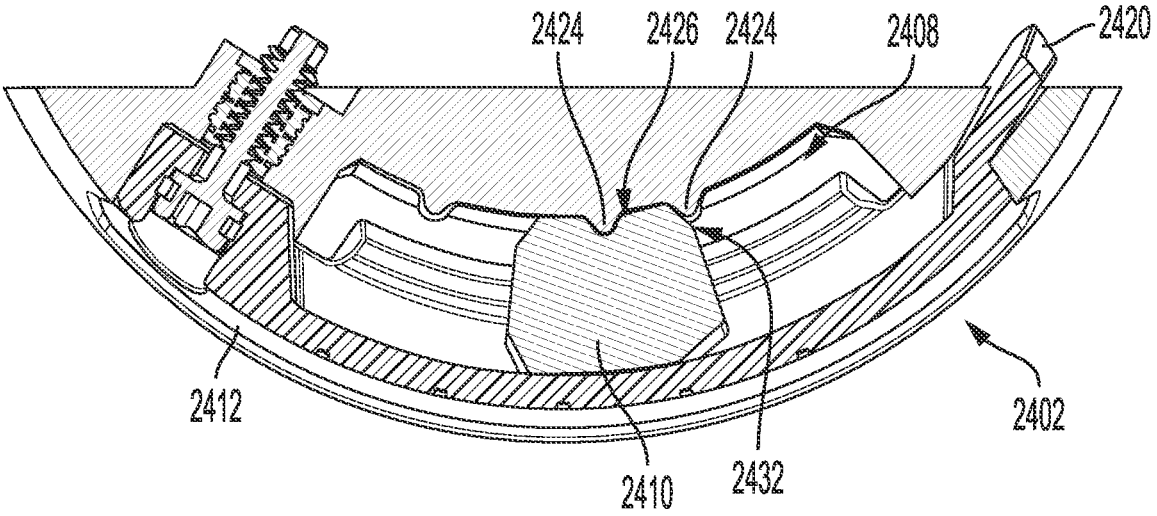
Figure 63D:
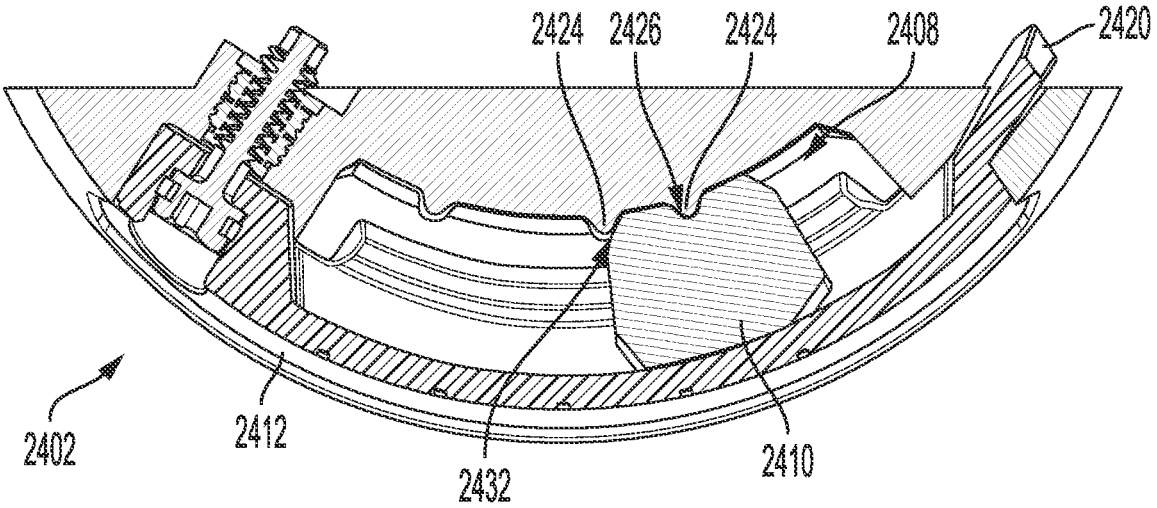
Figure 63E:
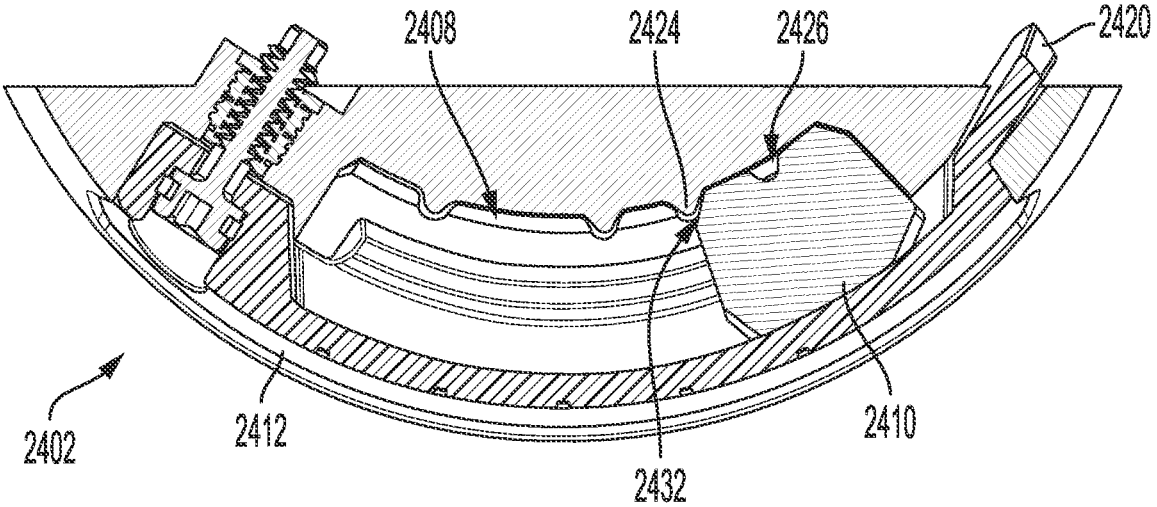

In FIG. 63C, the hollow 2426 of the weight 2410 is engaged with the locating lug 2424 in the middle. In this position, one of the inclined surfaces 2432 is also engaged with the locating lug 2424 proximate the projection 2420. In FIG. 63D, the hollow 2426 of the weight 2410 is engaged with the locating lug 2424 proximate the projection 2420. In this position, one of the inclined surfaces 2432 is engaged with the locating lug 2424 in the middle. Lastly, in FIG. 63E, the weight 2410 is disposed adjacent to the projection 2420 and between the locating lug 2424 and an end wall of the recessed channel 2408. The hollow 2426 does not have a locating lug 2424 received therein and one of the inclined surfaces 2432 is engaged with the locating lug 2424 proximate the projection 2420. In the example, the far side of the weight 2410 can be positioned directly against a portion of an end wall of the recessed channel 2408 and/or a portion of the cover 2412 proximate the projection 2420. When the locating lug(s) 2424 is engaged with the weight 2410, the weight 2410 is retained more tightly within the recessed channel 2408 to reduce or prevent rattling and further movement of the weight 2410 in the locked configuration. Additionally, one or more of the locating lugs 2424 can define a position of the weight 2410 on the golf club head. In the example, by shifting the locating lug 2424 proximate the projection 2420 inward, the weight 2410 can more easily slide between all positions without binding. It should be appreciated, that the spacing of the locating lugs 2424 can take on any other configuration as required or desired. For example, the recessed channel 2408 can have five spaced apart locating lugs 2424 such that in each position the hollow 2426 of the weight 2410 engages with a locating lug 2424. In other examples, three similarly spaced locating lugs 2424 can be used.

Additionally, the weight 2410 is slidably engaged with the cover 2412. The cover 2412 includes a flange 2428 that extends from an interior of the cover 2412 and the weight 2410 includes a groove 2430 shaped and sized to receive at least a portion of the flange 2428. By slidably engaging the flange 2428 and the groove 2430 of the weight 2410, the weight 2410 is configured to move with the cover 2412 when moved towards the unlocked configuration. This movement of the weight 2410 enables the weight 2410 to disengage with the locating lugs 2424 and so that the weight 2410 can slide and change positions.

Figure 65:
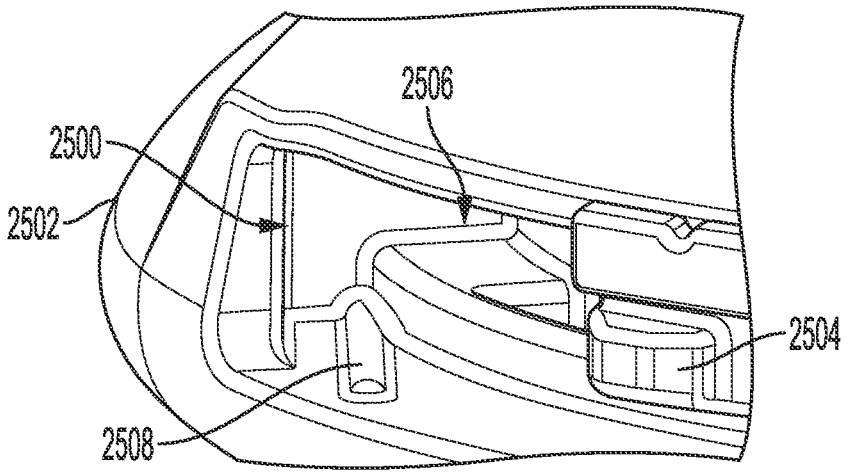
FIG. 65 is a partial perspective view of an exemplary recessed channel within a body of a test mule.
Figure 66:
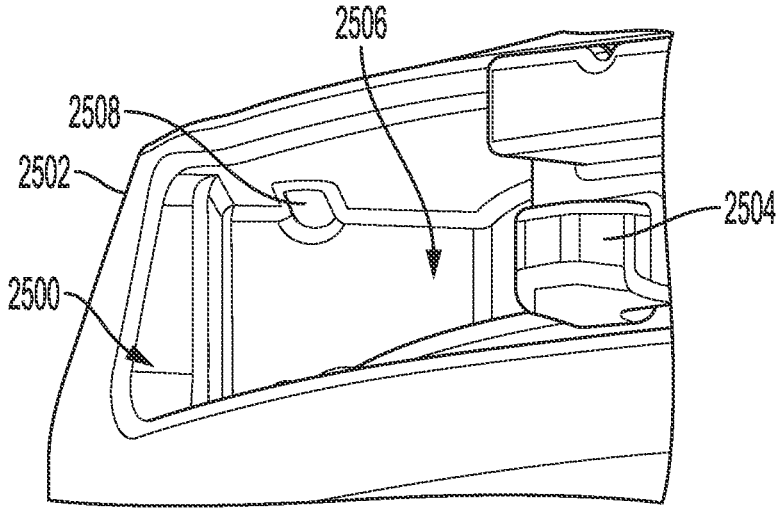
FIG. 66 is another partial perspective view of the recessed channel shown in FIG. 65.

FIG. 65 is a partial perspective view of an exemplary recessed channel 2500 within a body 2502 of a test mule. FIG. 66 is another partial perspective view of the recessed channel 2500. Referring concurrently to FIGS. 65 and 66, the body 2502 is illustrated schematically and the test mule represents a club head that can be any type of club head described herein as required or desired. The recessed channel 2500 is configured to receive a slidable weight 2504 and a cover (not shown) is configured to selectively retain the weight 2504 in different positions. The cover is coupled to the body 2502 with a fastener (not shown) that defines a fastener axis. The recessed channel 2500 includes a chamber 2506 that is sized and shaped to receive a corresponding projection (not shown) of the cover. The chamber 2506 is defined on the opposite end of the recessed channel 2500 from the fastener location so that both ends of the cover are engaged with the body 2502 and increase the retention of the weight 2504.

In this example, the recessed channel 2500 includes a lip 2508 proximate the chamber 2506. The lip 2508 extends into the recessed channel 2500 and is configured to engage with the cover at a corresponding duct (not shown). As such, when the cover is moved towards an unlocked configuration that allows the weight 2504 to slide within the recessed channel 2500, the end of the cover opposite the fastener remains at least partially engaged with the body 2502 to reduce or prevent the end of the cover from becoming loose relative to the body 2502. The lip 2508 is elongated in a direction that is substantially parallel to the fastener axis to enable movement of the cover as described herein. The lip 2508 can be positioned at a top wall of the recessed channel 2500, as illustrated in FIG. 65, at a bottom wall of the recessed channel 2500, as illustrated in FIG. 66, or both.

Figure 67:
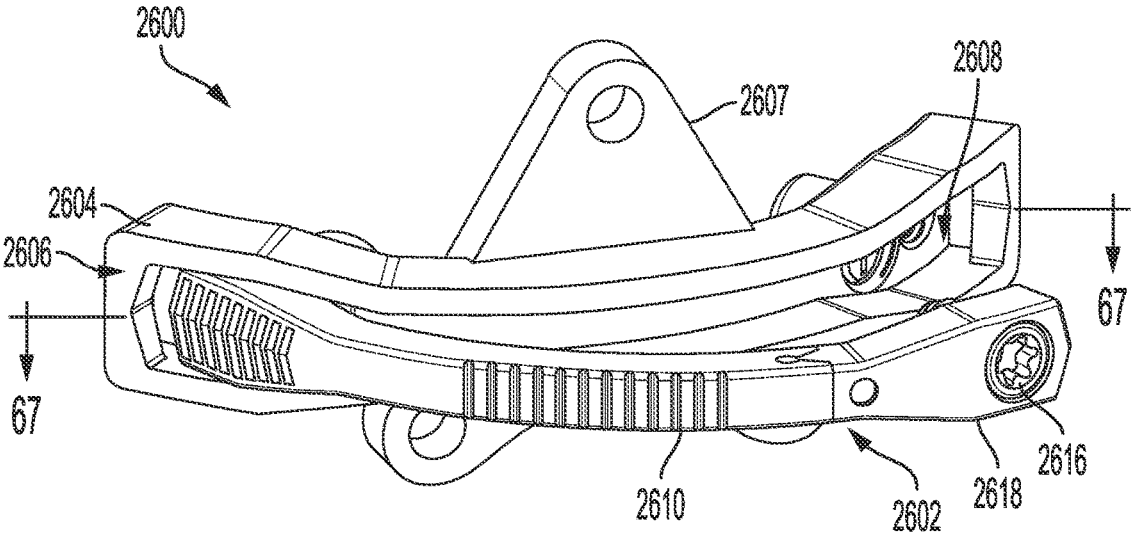
FIG. 67 is a schematic perspective view of another test mule with another weight assembly.
Figure 68:
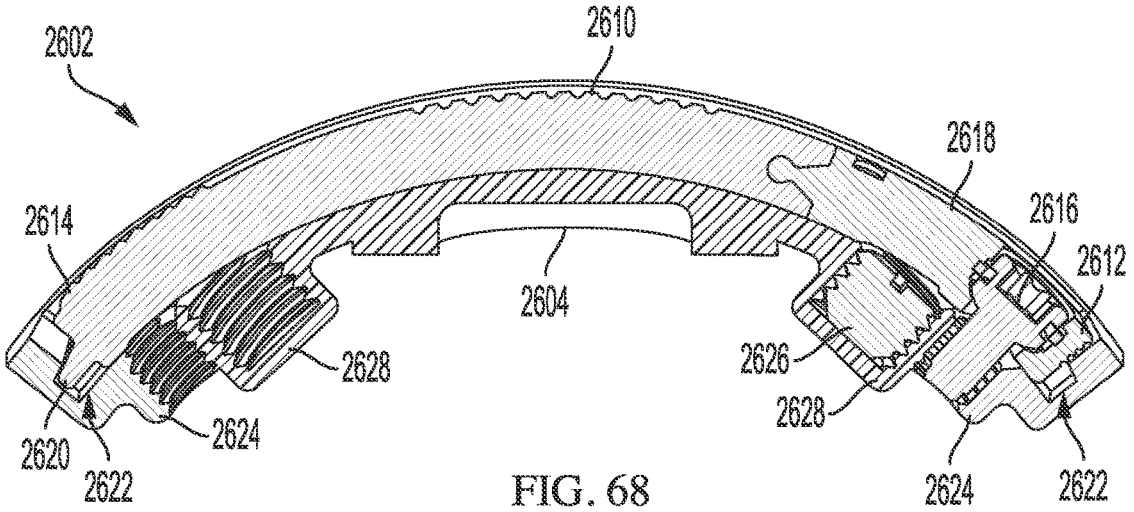
FIG. 68 is a cross-sectional view of the weight assembly in a first configuration taken along line 67-67 in FIG. 67.
Figure 69:
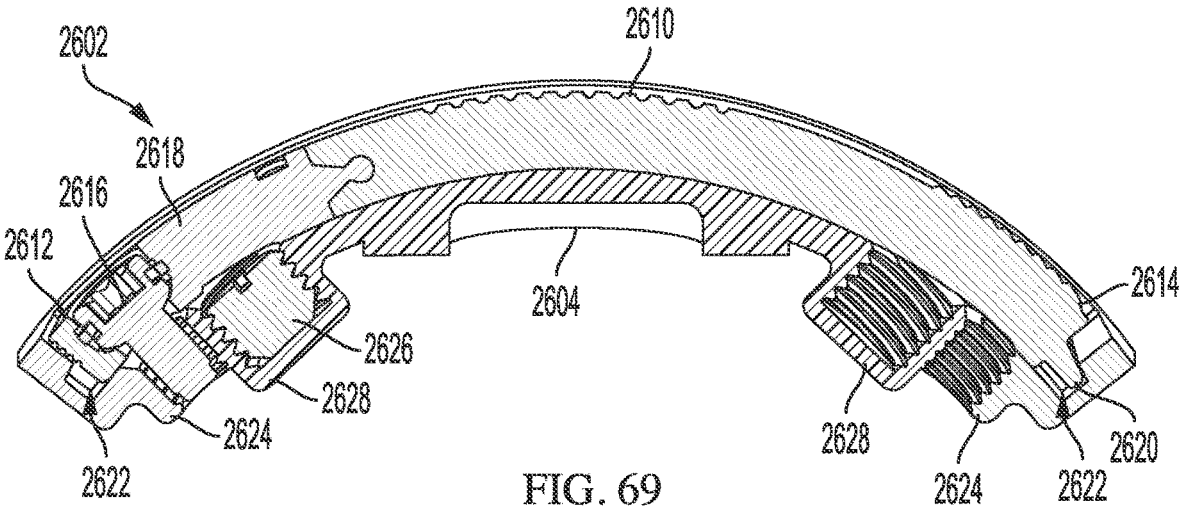
FIG. 69 is a cross-sectional view of the weight assembly in a second configuration taken along line 67-67 in FIG. 67.

FIG. 67 is a schematic perspective view of another test mule 2600 with another weight assembly 2602. FIG. 68 is a cross-sectional view of the weight assembly 2602 in a first configuration taken along line 67-67 in FIG. 67. FIG. 69 is a cross-sectional view of the weight assembly 2602 in a second configuration taken along line 67-67 in FIG. 67. Referring concurrently to FIGS. 67-69, and similar to the examples described above in FIGS. 59-64, the test mule 2600 represents a club head that can be any type of club head described herein as required or desired, and in an aspect, the weight assembly 2602 is disposed on a skirt of the club head and at a rear perimeter where the sole and the crown couple together. The test mule 2600 includes a body 2604 having an outer surface 2606 that represents the club head and a bracket 2607. A recessed channel 2608 is defined in the outer surface 2606 of the body 2604. In this example, however, the weight assembly 2602 includes a cover 2610 that is configured to be selectively oriented within the recessed channel 2608 and secured to the body 2604 to at least partially define a weight position of the club head and to adjust the CG and the MOI of the club head.

In this example, the weight assembly 2602 includes the cover 2610 that is removably coupled to the body 2604 and at least partially within the recessed channel 2608. The cover 2610 has a first end 2612 and an opposite second end 2614. A fastener 2616 is mounted (e.g., via a lock washer) on the first end 2612 of the cover 2610 and is configured to couple to the body 2604. Additionally, a first weight 2618 is disposed at the first end 2612 of the cover 2610. In this example, the first weight 2618 defines the first end 2612 of the cover 2610 itself and is removable from the second end 2614 of the cover 2610 so that different mass weights 2618 are interchangeable and can form the cover 2610 as required or desired. The second end 2614 of the cover 2610 includes a projection 2620 extending therefrom.

Each end of the recessed channel 2608 has a chamber 2622 and a fastener receiver 2624. The chamber 2622 is configured to engage with the projection 2620 of the cover 2610 and the fastener 2616 is configured to couple to the fastener receiver 2624. By having the recessed channel 2608 symmetrical at each end, the cover 2610 can be selectively coupled to the body 2604 so that the first weight 2618 can be oriented in either the first configuration (shown in FIG. 68) or the second configuration (shown in FIG. 69). In the first configuration, the first end 2612 of the cover 2610 is disposed on the heel side of the club head so that the first weight 2618 is positioned towards the heel side of the body 2604. In this configuration, the fastener 2616 is secured to the fastener receiver 2624 on the heel side and the projection 2620 of the cover 2610 engages with the chamber 2622 at the toe side. This leaves the fastener receiver 2624 on the toe side and the chamber 2622 on the heel side unused by the cover 2610. Conversely, in the second configuration, the first end 2612 of the cover 2610 is disposed on the toe side of the club head so that the first weight 2618 is positioned towards the toe side of the body 2604. In this configuration, the fastener 2616 is secured to the fastener receiver 2624 on the toe side and the projection 2620 of the cover 2610 engages with the chamber 2622 at the heel side. This leaves the fastener receiver 2624 on the heel side and the chamber 2622 on the toe side unused by the cover 2610. In this example, the cover 2610 has a dog-bone type shape so that is position within the recessed channel 2608 can be switched as required or desired.

Additionally or alternatively, a second weight 2626 may be coupled to a corresponding weight chamber 2628 defined in the body 2604 and within the recessed channel 2608. The weight chamber 2628 is positioned at both ends of the recessed channel 2608 proximate the fastener receiver 2624 and is covered by the cover 2610 when coupled to the body 2604. As such, the second weight 2626 is secured by the cover 2610 within the weight chamber 2628 and indirectly retained by the fastener 2616 of the weight assembly 2602. In an aspect, the second weight 2626 may thread at least partially into the weight chamber 2628. It should be appreciated that the position and use of the second weight 2626 does not necessarily need to correspond to the orientation of the cover 2610 and as illustrated in FIGS. 68 and 69. For example, the second weight 2626 can be used opposite of the first weight 2618 and retained at least partially by the second end 2614 of the cover 2610. In another example, only the first weight 2618 and no second weight 2626 can be utilized. In still another example, a pair of second weights 2626 may be used in the pair of weight chambers 2628. By using more than one weight 2618, 2626 the CG and the MOI of the club head can be more finely tuned as required or desired.

Figure 70:
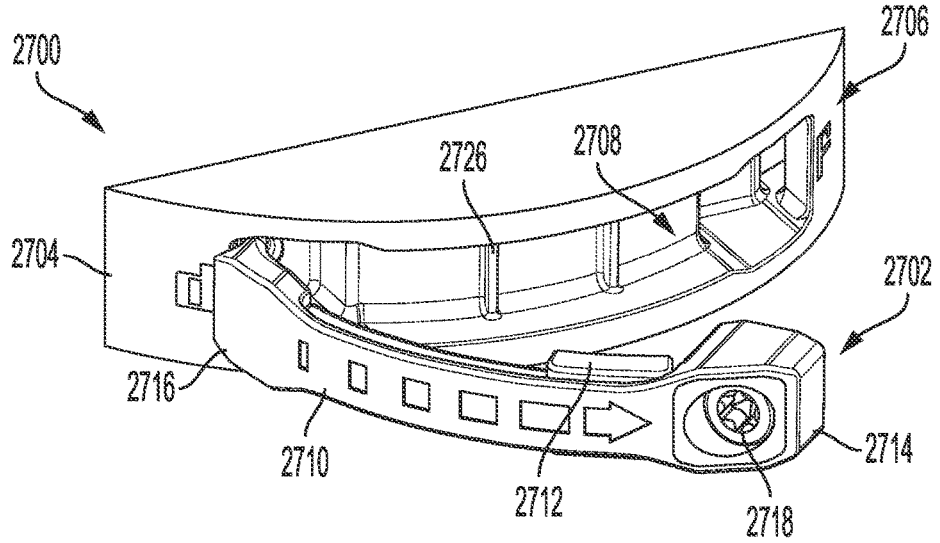
FIG. 70 is a schematic perspective view of another test mule with another weight assembly.
Figure 71:
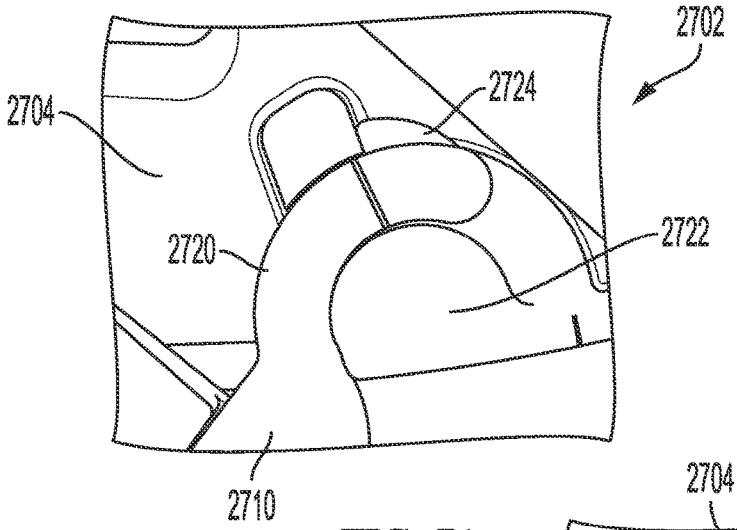
FIG. 71 is a partial cross-sectional view of the weight assembly shown in FIG. 70 in an unlocked configuration.
Figure 72:
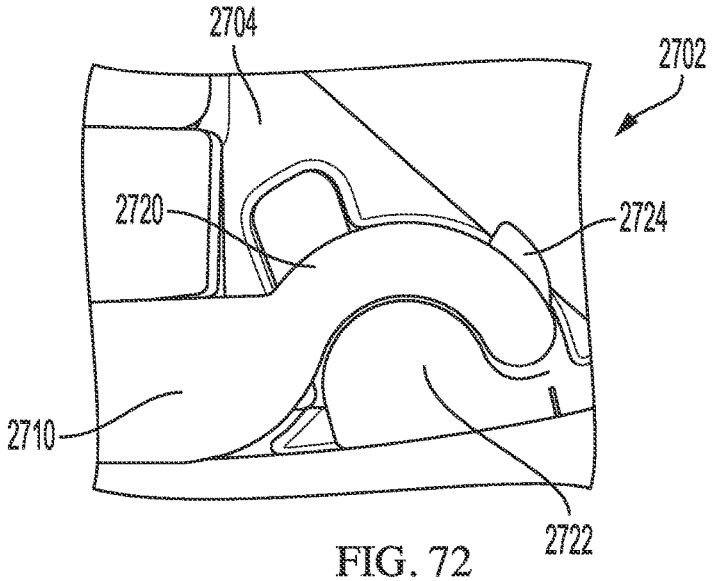
FIG. 72 is a partial cross-sectional view of the weight assembly shown in FIG. 70 in a locked configuration.

FIG. 70 is a schematic perspective view of another test mule 2700 with another weight assembly 2702. FIG. 71 is a partial cross-sectional view of the weight assembly 2702 in an unlocked configuration. FIG. 72 is a partial cross-sectional view of the weight assembly 2702 in a locked configuration. Referring concurrently to FIGS. 70-72, and similar to the examples described above in FIGS. 59-64 and 67-69, the test mule 2700 represents a club head that can be any type of club head described herein as required or desired, and in an aspect, the weight assembly 2702 is disposed on a skirt of the club head and at a rear perimeter where the sole and the crown couple together. The test mule 2700 includes a body 2704 having an outer surface 2706 that represents the club head. A recessed channel 2708 is defined in the outer surface 2706 of the body 2704. In this example, however, the weight assembly 2702 includes a cover 2710 that is pivotably coupled to the body 2704 and a slidable weight 2712 to adjust the CG and the MOI of the club head. In an aspect, the cover 2710 is lighter in density than the weight 2712 so that a larger amount of mass can be used to manipulate the CG and the MOI.

In this example, the cover 2710 has a first end 2714 and an opposite second end 2716. A fastener 2718 is mounted on the first end 2714 of the cover 2710 (e.g., via a lock washer) and is configured to secure the first end 2714 to the body 2704 of the club head. The second end 2716 of the cover 2710 is pivotably coupled to the body 2704. The weight 2712 is slidably coupled to the cover 2710 and is movable between the first end 2714 and the second end 2716. In operation, the cover 2710 is pivotable about its second end 2716 between at least a locked configuration and an unlocked configuration (shown in FIG. 70). In the locked configuration, the fastener 2718 secures the first end 2714 of the cover 2710 to the body 2704 and the weight 2712 is disposed at least partially within the recessed channel 2708 and retained therein by the cover 2710. The position of the weight 2712 within the recessed channel 2708 between the first end 2714 and the second end 2716 of the cover 2710 is thereby retained indirectly by the fastener 2718. In the unlocked configuration, the first end 2714 of the cover 2710 pivots out of the recessed channel 2708 to enable the weight 2712 to be repositioned (e.g., slide along the cover 2710) as required or desired. The unlocked configuration is illustrated in FIG. 70 and the weight 2712 moves with the cover 2710.

The second end 2716 of the cover 2710 can include a hook 2720 that pivotably engages with a post 2722 in the body 2704. The hook 2720 includes a hard stop 2724 that is configured to engage with the body 2704 in the unlocked position so as to define the pivot limit of the cover 2710. The hard stop 2724 can be tapered on one end so that the second end 2716 of the cover 2710 is more easily inserted into the body 2704 during assembly. In other example, the second end 2716 of the cover 2710 can be pivotably coupled to the body 2704 with a pin connection (not shown). The recessed channel 2708 can include one or more locating lugs 2726 to assist in positioning the weight 2712 as required or desired. In aspects, the weight 2712 can be positionable in two, four, or six discrete positions at least partially defined by the locating lugs 2726. In this example, the weight 2712 is slidably engaged with the cover 2710 and pivots therewith. In other examples, the weight can be slidably engaged with the body so that it does not pivot with the cover. This example is described below in reference to FIG. 73.

Figure 73:
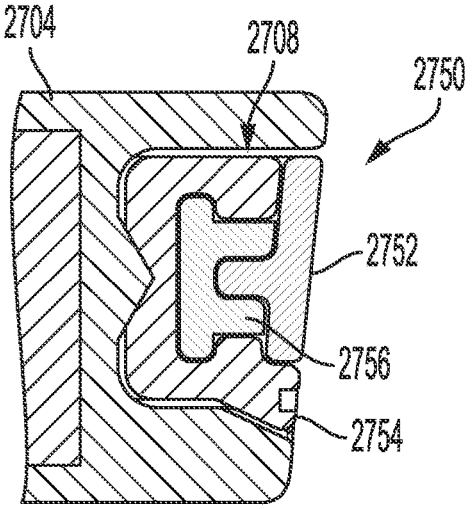
FIG. 73 is a cross-sectional view of another weight assembly that can be used with the test mule shown in FIG. 70.

FIG. 73 is a cross-sectional view of another weight assembly 2750 that can be used with the test mule 2700 (shown in FIG. 70). In this example, the weight assembly 2750 includes a pivotable cover 2752 and a slidable weight 2754. However, in this example, the weight 2754 is slidably engaged at least partially within the recessed channel 2708 of the body 2704 so that the weight 2754 does not pivot with the cover 2752. The weight assembly 2750 includes a rail 2756 that secures the weight 2754 to the body 2704 while still enabling the weight 2754 to slide. In the locked configuration as illustrated in FIG. 73, the cover 2752 secures the position of the weight 2754 relative to the body 2704 via the rail 2756.

Figure 74:
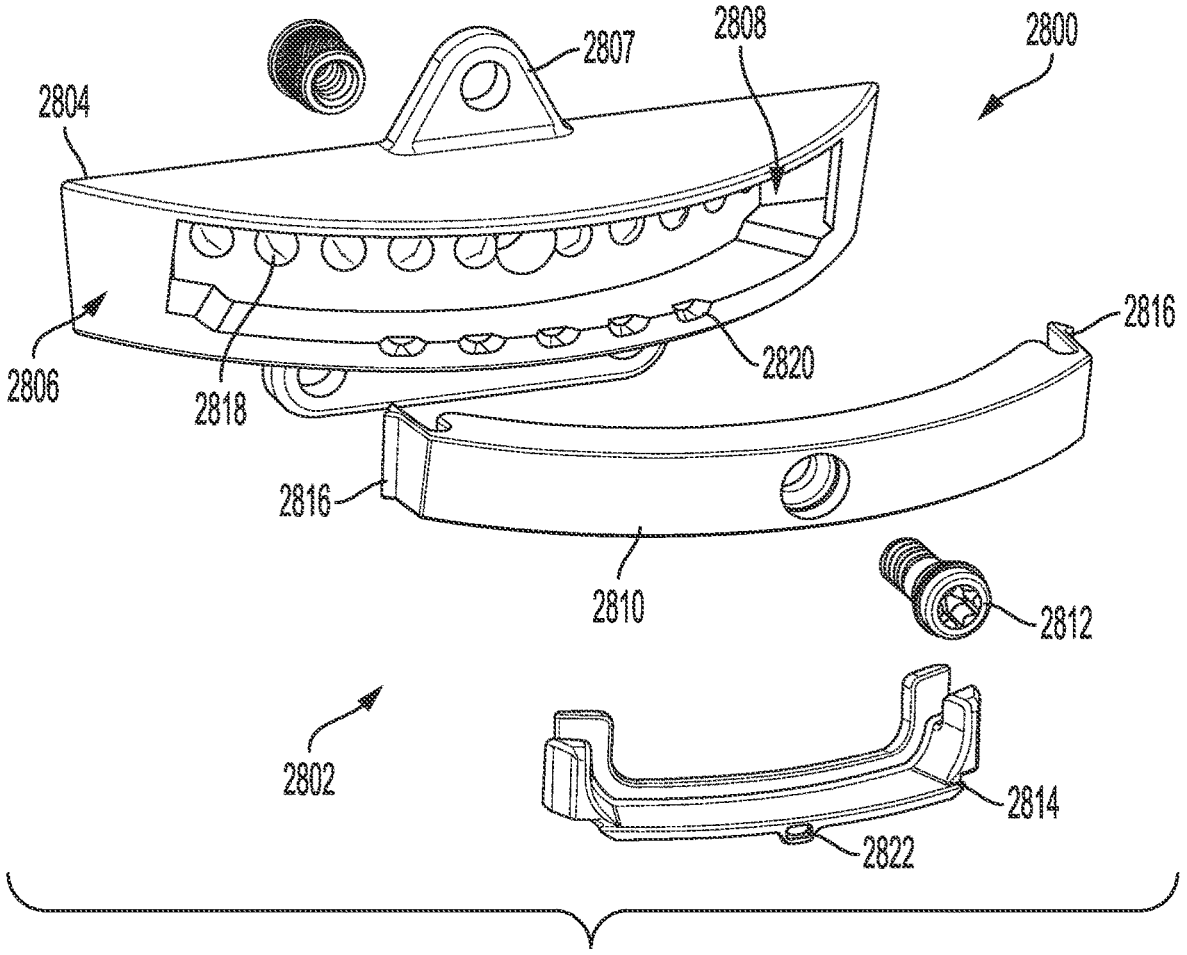
FIG. 74 is an exploded perspective view of another test mule with another weight assembly.

FIG. 74 is an exploded perspective view of another test mule 2800 with another weight assembly 2802. Similar to the examples described above in FIGS. 59-64 and 67-72, the test mule 2800 represents a club head that can be any type of club head described herein as required or desired, and in an aspect, the weight assembly 2802 is disposed on a skirt of the club head and at a rear perimeter where the sole and the crown couple together. The test mule 2800 includes a body 2804 having an outer surface 2806 that represents the club head and a bracket 2807. A recessed channel 2808 is defined in the outer surface 2806 of the body 2804. In this example, however, the weight assembly 2802 includes a cover 2810 that is coupled to the body 2804 via a fastener 2812 that is disposed proximate a center of the cover 2810. The cover 2810 is configured to secure a slidable weight 2814 while enabling a position of the weight 2814 to be selectively adjusted. The weight 2814 has an elongated U-shape so as to accommodate the center mounted fastener 2812 and a portion of the weight 2814 can be disposed on both sides of the fastener 2812. The cover 2810 has projections 2816 at each end to engage with the recessed channel 2808. The recessed channel 2808 includes locating lugs 2818 to assist in positioning the weight 2814 and dimples 2820 that receive at least a portion of a position indicator 2822 of the weight 2814.

Although specific embodiments and aspects were described herein and specific examples were provided, the scope of the technology is not limited to those specific embodiments and examples. For instance, while many of the present examples have been depicted particularly for use with a driver, a fairway metal, and an iron, any the present technology may be applied to any metal wood, fairway metal or wood, iron, or hybrid golf club. Further, each of the above examples may be combined with another and/or one or more features of some examples may be combined with other examples. One skilled in the art will recognize other embodiments or improvements that are within the scope and spirit of the present technology. Therefore, the specific structure, acts, or media are disclosed only as illustrative embodiments. In addition, if the limits of the terms "about," "substantially," or "approximately" as used in the following claims are unclear from the foregoing specification to one having skill in the art, those terms shall mean within ten percent of the value described. The scope of the technology is defined by the following claims and any equivalents therein.

What is claimed is:

1. A golf club head comprising:

a body having an outer surface;

a recessed channel defined in the outer surface of the body, wherein a chamber is defined at one end of the recessed channel; and a weight assembly comprising:

a weight at least partially disposed within the recessed channel and configured to slide therein;

a cover having a first end and an opposite second end, wherein the second end comprises a projection; and a fastener coupling the first end of the cover to the body, wherein the fastener secures the first end of the cover to the body while the projection of the second end of the cover engages with the chamber of the recessed channel to retain a position of the weight within the recessed channel between the first end and the second end of the cover, wherein the fastener defines a fastener axis that the cover moves relative to the body along, and wherein the body comprises a lip disposed within the recessed channel proximate the chamber, the lip extending substantially parallel to the fastener axis.

2. The golf club head of claim 1, wherein the body comprises at least one locating lug disposed within the recessed channel, and wherein the weight comprises a hollow shaped and sized to receive at least a portion of the at least one locating lug to at least partially define the position of the weight within the recessed channel.

3. The golf club head of claim 2, wherein the at least one locating lug comprises a plurality of locating lugs having at least two different spacing distances.

4. The golf club head of claim 1, wherein the cover comprises a flange, and wherein the weight comprises a groove shaped and sized to receive at least a portion of the flange to slidingly engage the weight with the cover.

5. The golf club head of claim 1, wherein the cover comprises at least one locating lug, and wherein the weight comprises a hollow shaped and sized to receive at least a portion of the at least one locating lug to at least partially define the position of the weight within the recessed channel.

6. The golf club head of claim 1, wherein the body comprises a partial wall disposed within the recessed channel, and wherein the weight comprises a recess shaped and sized to receive at least a portion of the partial wall to slidingly engage the weight with the body.

7. The golf club head of claim 1, wherein the body further comprises:

a striking face comprising a lower edge and an opposite upper edge;

a sole extending from the lower edge; and a crown extending from the upper edge, wherein the recessed channel and the weight assembly are disposed on a rear perimeter of the body opposite the striking face and proximate where the sole and the crown couple together.

8. The golf club head of claim 1, wherein the fastener is rotatable between about 2-3 turns to release the cover and allow the weight to slide at least partially within the recessed channel.

9. The golf club head of claim 1, wherein the golf club head is a metalwood-type golf club head.

10. A golf club head comprising:

a body comprising:

a striking face comprising a lower edge and an opposite upper edge;

a sole extending from the lower edge; and a crown extending from the upper edge, wherein one or more of the striking face, the sole, and the crown, define an outer surface of the body;

a recessed channel formed in the outer surface, wherein both a chamber and a fastener receiver are defined at each end of the recessed channel; and a weight assembly comprising:

a cover having a first end and an opposite second end, wherein the second end comprises a projection;

a weight disposed at the first end of the cover; and a fastener mounted on the first end of the cover, wherein the cover is selectively coupled to the body at the recessed channel so that the projection of the second end is engaged with the chamber at one end and the fastener is engaged with the fastener receiver at the opposite end, wherein the weight is a first weight and the weight assembly further comprises at least one second weight, and wherein a weight chamber is defined at each end of the recessed channel proximate the fastener receiver configured to receive the at least one second weight.

11. The golf club head of claim 10, wherein the weight defines the first end of the cover.

12. The golf club head of claim 10, wherein the weight is removable from the cover.

13. The golf club head of claim 10, wherein the cover secures the at least one second weight within the weight chamber.

14. The golf club head of claim 10, wherein the cover has a dog-bone type shape.

15. A golf club head comprising:

a body comprising:

a striking face comprising a lower edge and an opposite upper edge;

a sole extending from the lower edge; and a crown extending from the upper edge, wherein one or more of the striking face, the sole, and the crown, define an outer surface of the body;

a recessed channel formed in the outer surface; and a weight assembly comprising:

a cover having a first end and an opposite second end, wherein the second end is pivotably coupled to the body at the recessed channel; and a fastener mounted on the first end of the cover and configured to secure the first end of the cover to the body; and a weight slidably coupled to the cover and movable between the first end and the second end, wherein when the fastener secures the cover to the body, the weight is disposed at least partially within the recessed channel and a position of the weight within the recessed channel between the first end and the second end of the cover is indirectly retained by the fastener, wherein the recessed channel and the weight assembly are disposed on a rear perimeter of the body opposite the striking face and proximate where the sole and the crown couple together.

16. The golf club head of claim 15, wherein the second end of the cover comprises a hook with a hard stop engaged with the body.

17. The golf club head of claim 15, wherein the second end of the cover is coupled to the body at a pin.

* * * * *